US010618292B2

(12) United States Patent
Fukasawa et al.

(10) Patent No.: US 10,618,292 B2
(45) Date of Patent: Apr. 14, 2020

(54) PRINTER AND INK BOTTLE

(71) Applicant: Seiko Epson Corporation, Tokyo (JP)

(72) Inventors: Noriyuki Fukasawa, Shiojiri (JP); Taku Ishizawa, Matsumoto (JP); Tadahiro Mizutani, Shiojiri (JP); Naomi Kimura, Okaya (JP); Shoma Kudo, Shiojiri (JP); Ryoichi Tanaka, Shiojiri (JP); Tadashi Watanabe, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/905,022

(22) Filed: Feb. 26, 2018

(65) Prior Publication Data

US 2018/0250943 A1 Sep. 6, 2018

(30) Foreign Application Priority Data

Mar. 1, 2017 (JP) ..... 2017-038003

(51) Int. Cl.
*B41J 2/175* (2006.01)
*B41J 29/13* (2006.01)

(52) U.S. Cl.
CPC ..... *B41J 2/17509* (2013.01); *B41J 2/1752* (2013.01); *B41J 2/17523* (2013.01); *B41J 2/17553* (2013.01); *B41J 2/17596* (2013.01); *B41J 29/13* (2013.01)

(58) Field of Classification Search
CPC . B41J 2/17509; B41J 2/17553; B41J 2/17596
See application file for complete search history.

(56) References Cited

U.S. PATENT DOCUMENTS

| | | | |
|---|---|---|---|
| 4,749,108 A | 6/1988 | Dornsbusch et al. | |
| 5,897,033 A | 4/1999 | Okawa et al. | |
| 6,079,823 A | 6/2000 | Droege | |
| 9,090,075 B2 * | 7/2015 | Matsumoto | B41J 2/17506 |
| 9,421,781 B2 | 8/2016 | Kimura et al. | |
| 9,427,972 B2 | 8/2016 | Kimura et al. | |
| 9,505,224 B2 | 11/2016 | Kimura et al. | |

(Continued)

FOREIGN PATENT DOCUMENTS

| | | |
|---|---|---|
| JP | H06-059900 B2 | 8/1994 |
| JP | 2001-510752 A | 8/2001 |

(Continued)

*Primary Examiner* — Sharon A. Polk
(74) *Attorney, Agent, or Firm* — Foley & Lardner LLP

(57) ABSTRACT

A printer comprises a main body cover configured to change over a state between a closed state and an open state; a tank including an ink container portion configured to contain ink and an ink inlet configured to inject the ink; a tank cover configured to change over a state between a closed state and an open state; and an ink bottle including a container portion and a delivery portion. In the open state of both the main body cover and the tank cover, the ink bottle is self-supported and configured to deliver the ink from the delivery portion of the ink bottle to the ink inlet. A space is formed between the main body cover and the ink bottle when the ink bottle is self-supported. At least part of the ink bottle is located in a locus drawn by the main body cover during rotation.

2 Claims, 44 Drawing Sheets

(56) References Cited

U.S. PATENT DOCUMENTS

| | | | | |
|---|---|---|---|---|
| 9,511,591 | B2 | 12/2016 | Kimura et al. | |
| 2006/0119671 | A1* | 6/2006 | Ha | B41J 2/17509 347/84 |
| 2014/0104349 | A1 | 4/2014 | Kimura et al. | |
| 2015/0124028 | A1 | 5/2015 | Kimura et al. | |
| 2015/0283816 | A1 | 10/2015 | Kimura et al. | |
| 2016/0200111 | A1 | 7/2016 | Kimura et al. | |
| 2017/0043586 | A1 | 2/2017 | Yanagida et al. | |
| 2018/0126744 | A1* | 5/2018 | Moriyama | B41J 2/17506 |

FOREIGN PATENT DOCUMENTS

| | | | |
|---|---|---|---|
| JP | 3523021 | B2 | 4/2004 |
| JP | 2014-079908 | A | 5/2014 |
| JP | 2014-079909 | A | 5/2014 |
| JP | 2017-035818 | A | 2/2017 |

* cited by examiner

PRINTER AND INK BOTTLE

CROSS-REFERENCE TO RELATED APPLICATION

The present application claims priority from Japanese patent application 2017-038003 filed on Mar. 1, 2017, the entirety of the content of which is hereby incorporated by reference into this application.

BACKGROUND

Technical Field

The present invention relates to a printer, an ink bottle, and the like.

Related Art

A conventionally known inkjet printer as one example of an ink ejection apparatus is configured to eject ink from a print head onto a printing medium such as printing paper and thereby perform printing on the printing medium with the ink. The inkjet printer may be configured to allow the user to fill ink into a tank provided to store ink that is to be supplied to the print head (as described in, for example, JP 2014-79909M.

In the printer described in JP 2014-79909A, a scanner is placed on a housing of a printer main body. The scanner is configured to be rotatable relative to the printer main body. The operator opens the scanner relative to the printer main body, additionally opens a cover provided to cover the tank and then fills ink into an inlet of the tank. The operator is required to perform an operation of filling ink into the inlet of the tank in a narrow space between the scanner and the printer main body. This makes it difficult to stably fill ink into the inlet of the tank. This printer also has a difficulty in downsizing. This is because downsizing the printer generally provides a narrower space between the scanner and the printer main body. In order to solve the problems described above, an object of the invention is to provide a printer that ensures stable ink filling into a tank, while downsizing the printer.

SUMMARY

The invention may be implemented by aspects and applications described below.

Aspect 1. According to one aspect of the invention, there is provided a printer comprising a print head configured to eject ink; a housing configured to place the print head therein; a main body cover configured to change over a state by rotation between a closed state to cover an opening formed in the housing and an open state to open the opening; a tank including an ink container portion configured to contain the ink that is to be supplied to the print head, and an ink inlet configured such that the ink is filled through the ink inlet into the ink container portion; a tank cover configured to change over a state by rotation between a closed state to cover the ink inlet and an open state to expose the ink inlet; and an ink bottle including a container portion configured to contain the ink that is to be injected into the ink inlet, and a delivery portion configured to deliver the ink contained in the container portion toward the ink inlet. In a use attitude when the print head is in use, in a plan view of the main body cover in the closed state, the main body cover is arranged to cover at least part of the tank cover and at least part of the ink inlet. In the open state of both the main body cover and the tank cover, the ink bottle is self-supported and configured to deliver the ink from the delivery portion of the ink bottle to the ink inlet. A space is formed between the main body cover and the ink bottle when the ink bottle is self-supported, and at least part of the ink bottle is located in a locus drawn by the main body cover during rotation of the main body cover between the closed state and the open state.

The printer of this aspect enables ink to be delivered from the delivery portion of the ink bottle to the ink inlet when the ink bottle is self-supported. This does not require human intervention of manually supporting the ink bottle between the housing and the main body cover in the process of filling ink into the tank. This configuration is likely to ensure stable ink filling into the tank. In the printer of this aspect, when the ink bottle is self-supported, at least part of the ink bottle is located in the locus drawn by the main body cover during rotation of the main body cover between the closed state and the open state. This configuration enables the ink bottle to be self-supported in the space required for rotation of the main body cover and thereby enhances the use efficiency of the space. As a result, this is likely to downsize the printer.

Aspect 2. According to another aspect of the invention, there is provided an ink bottle configured to fill ink into a tank of a printer. The printer comprises a print head configured to eject ink; a housing configured to place the print head therein; a main body cover configured to change over a state by rotation between a closed state to cover an opening formed in the housing and an open state to open the opening; a tank including an ink container portion configured to contain the ink that is to be supplied to the print head, and an ink inlet configured such that the ink is filled through the ink inlet into the ink container portion; and a tank cover configured to change over a state by rotation between a closed state to cover the ink inlet and an open state to expose the ink inlet. The ink bottle comprises a container portion configured to contain the ink that is to be injected into the ink inlet, and a delivery portion configured to deliver the ink contained in the container portion toward the ink inlet. In a use attitude when the print head is in use, in a plan view of the main body cover in the closed state, the main body cover is arranged to cover at least part of the tank cover and at least part of the ink inlet. In the open state of both the main body cover and the tank cover, the ink bottle is self-supported and configured to deliver the ink from the delivery portion of the ink bottle to the ink inlet. A space is formed between the main body cover and the ink bottle when the ink bottle is self-supported, and at least part of the ink bottle is located in a locus drawn by the main body cover during rotation of the main body cover between the closed state and the open state.

The ink bottle of this aspect enables ink to be delivered from the delivery portion of the ink bottle to the ink inlet when the ink bottle is self-supported. This does not require human intervention of manually supporting the ink bottle between the housing and the main body cover in the process of filling ink into the tank. This configuration is likely to ensure stable ink filling into the tank. When the ink bottle of this aspect is self-supported, at least part of the ink bottle is located in the locus drawn by the main body cover during rotation of the main body cover between the closed state and the open state. This configuration enables the ink bottle to be self-supported in the space required for rotation of the main body cover and thereby enhances the use efficiency of the space in the printer. As a result, this is likely to downsize the printer.

Aspect 3. In the ink bottle of the above aspect, in a plan view of the printer in the use attitude, when the ink bottle is self-supported, the main body cover may overlap with at least part of the ink bottle.

In the plan view of the printer in the use attitude, at least part of the self-supported ink bottle of this aspect is arranged to overlap with the main body cover. This configuration is likely to reduce the projection area of the printer. As a result, this is likely to downsize the printer.

Aspect 4. In the ink bottle of the above aspect, the main body cover may be supported in the open state by the tank cover that is in the open state.

In the ink bottle of this aspect, the main body cover is kept in the open state by the tank cover that is in the open state. This is likely to keep a space between the main body cover and the ink bottle.

Aspect 5: In the ink bottle of the above aspect, the container portion with an opening formed on one end side of the container portion and the delivery portion that is included on the one end side of the container portion may be configured separately. The delivery portion may comprise an engagement portion in a tubular shape configured to be engaged with the container portion when the engagement portion is arranged to cover the opening of the container portion; an outlet formed on an opposite side of a container portion side of the engagement portion and configured to flow out the ink contained in the container portion to outside; a first thread formed on an inner side of the engagement portion to be engaged with a thread formed in the container portion; and a second thread formed on an outer side of the engagement portion to be engaged with a thread formed in a cover member that is configured to cover the outlet. When a direction from the opening of the container portion toward the outlet of the delivery portion is specified as a first direction, at least part of a forming area of the first thread in the first direction may overlap with a forming area of the second thread in the first direction.

In the ink bottle of this aspect, at least part of the forming area of the first thread formed on the inner side of the engagement portion overlaps with the forming area of the second thread formed on the outer side of the engagement portion. This configuration enables the first thread and the second thread to be arranged efficiently in the first direction. This is more likely to downsize the ink bottle.

Aspect 6: According to another aspect of the invention, there is provided an ink bottle configured to fill ink into a tank of a printer. The printer comprises a print head configured to eject ink; a housing configured to place the print head therein; a main body cover configured to change over a state by rotation between a closed state to cover an opening formed in the housing and an open state to open the opening; a tank including an ink container portion configured to contain the ink that is to be supplied to the print head, and an ink inlet configured such that the ink is filled through the ink inlet into the ink container portion; and a tank cover configured to change over a state by rotation between a closed state to cover the ink inlet and an open state to expose the ink inlet. The ink bottle comprises a container portion configured to contain the ink that is to be injected into the ink inlet, and a delivery portion configured to deliver the ink contained in the container portion toward the ink inlet. In a use attitude when the print head is in use, in a plan view of the main body cover in the closed state, the main body cover is arranged to cover at least part of the tank cover and at least part of the ink inlet. In the open state of both the main body cover and the tank cover, the ink bottle is self-supported and configured to deliver the ink from the delivery portion of the ink bottle to the ink inlet. When the ink bottle is self-supported, a distance from an axis to the main body cover is longer than a distance from the axis to a side face of the ink bottle in a radial direction at a position of an opposite end that is opposite to the ink inlet of the ink bottle in an axial direction about a center axis of the ink inlet.

The ink bottle of this aspect is self-supported at a position where at least part of the ink inlet is covered by the main body cover. In the ink bottle of this aspect, when the ink bottle is self-supported, the distance from the axis to the main body cover is longer than the distance from the axis to the side face of the ink bottle in the radial direction in the axial direction about the center axis of the ink inlet of the ink bottle. A space is accordingly formed between the main body cover and the ink bottle. This configuration maintains the self-supported attitude of the ink bottle without interference with the main body cover to ensure stable ink filling, while downsizing the main body of the printer.

DETAILED DESCRIPTION

The following describes an embodiment with reference to the drawings. In the respective illustrations, different scales may be employed for the respective configurations or for the respective components, in order to make the size of each of the configurations and the components recognizable.

Figure 1:
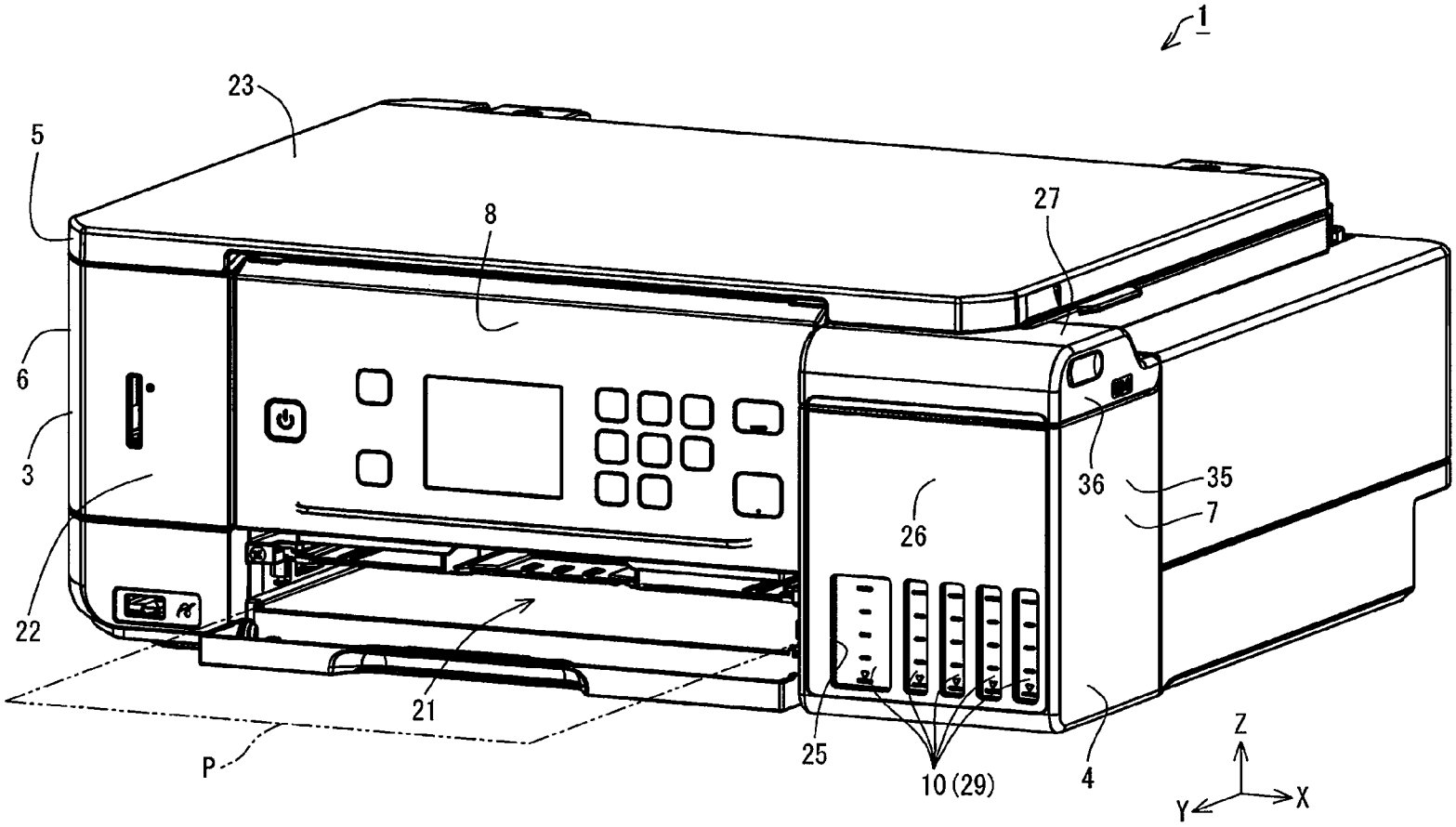
FIG. 1 is a perspective view illustrating the main configuration of a printer according to an embodiment.

As shown in FIG. 1, a printer 1 according to an embodiment includes a printing unit 3 that is one example of a liquid ejection device, a tank unit 4 and a scanner unit 5. The printing unit 3 has a housing 6. The housing 6 forms an outer shell of the printing unit 3. A mechanical unit (not shown) of the printing unit 3 is placed inside of the housing 6. The tank unit 4 has a housing 7 and a plurality of (two or more than two) tanks 10. The plurality of tanks 10 are placed in the housing 7. The plurality of tanks 10 are provided with the printing unit 3. According to this embodiment, five tanks 10 are provided. The housing 6, the housing 7 and the scanner unit 5 form an outer shell of the printer 1. A configuration with omission of the scanner unit 5 may be employed for the printer 1. The printer 1 is configured to perform printing on a printing medium P such as printing paper, with ink that is one example of a liquid. The printing medium P is one example of a medium on which printing is performed. The tank 10 is one example of a liquid container. The housing 6 includes a panel 8. A power button, operation buttons and a display unit are placed on the panel 8. The mechanical unit placed in the housing 6 includes a conveyor device (not shown) configured to convey the printing medium P in a Y-axis direction and a print head configured to eject ink. Accordingly, the housing 6 corresponds to the housing configured to place the print head therein. According to the embodiment, the number of tanks 10 is not limited to five but may be any number of more than 5 or any number of less than 5 or may be even only one.

XYZ axes that are coordinate axes orthogonal to one another are shown in FIG. 1. XYZ axes may also be shown in subsequent drawings as necessary. In this case, the XYZ axes in the respective drawings correspond to the XYZ axes in FIG. 1. FIG. 1 illustrates the state that the printer 1 is placed in an XY plane that is defined by the X axis and the Y axis. According to this embodiment, the state that the printer 1 is placed in the XY plane adjusted to a horizontal plane is called the use state of the printer 1. The attitude of the printer 1 that is placed in the XY plane adjusted to the horizontal plane is called the use attitude of the printer 1.

In the description below, when the X axis, the Y axis and the Z axis are shown in the illustration and the description of each of the components and the units included in the printer 1, the X axis, the Y axis and the Z axis indicate the X axis, the Y axis and the Z axis in the state that the component or the unit is built in (mounted in) the printer 1. The attitude of each of the components and the units in the use attitude of the printer 1 is also called the use attitude of the component or the unit. In the description below, the description of the printer 1, the component or the unit means the description in the use attitude of the printer 1, the component or the unit, unless otherwise specified.

The horizontal plane herein means a practically horizontal plane. The expression of "practically horizontal" may include some inclination in an allowable inclination range, for example, with regard to the plane on which the printer 1 is placed. The practically horizontal plane is accordingly not limited to a plane formed with high accuracy, such as a surface plate. The practically horizontal plane includes various surfaces of, for example, a desk, a rack, a shelf and a floor on which the printer 1 is mounted in use. A vertical direction is not strictly limited to a direction along the direction of gravity but includes a direction perpendicular to the practically horizontal plane. For example, when the practically horizontal plane is a surface of the desk, the rack, the shelf, the floor or the like, the vertical direction indicates the direction perpendicular to this surface.

The Z axis is an axis orthogonal to the XY plane. In the use state of the printer 1, a +Z-axis direction shown in FIG. 1 is a vertically upward direction. In the use attitude of the printer 1, a −Z-axis direction shown in FIG. 1 is a vertically downward direction. With respect to each of the X axis, the Y axis and the Z axis, the direction of an arrow indicates a +(positive) direction, and an opposite direction to the direction of the arrow indicates a −(negative) direction. The five tanks 10 described above are arrayed along the X axis. Accordingly, an X-axis direction is also defined as the direction of the array of the five tanks 10. The vertically upward direction or vertically upward means the upward direction or upward along a vertical line. Similarly, the vertically downward direction or vertically downward means the downward direction or downward along the vertical line. The upward direction or upward without the term "vertically" is not limited to the upward direction or upward along the vertical line but includes any upward direction or upward along a direction intersecting the vertical line other than the horizontal direction. Similarly, the downward direction or downward without the term "vertically" is not limited to the downward direction or downward along the vertical line but includes any downward direction or downward along the direction intersecting the vertical line other than the horizontal direction. In other words, the upward direction or upward denotes any direction including a vertically upward direction component among the directions intersecting with the vertical line. Similarly, the downward direction or downward denotes any direction including a vertically downward direction component among the directions intersecting with the vertical line.

The printing unit 3 is provided with a paper ejecting portion 21. In the printing unit 3, the printing medium P is discharged from the paper ejecting portion 21. The printing medium P is discharged in a Y-axis direction from the paper ejecting portion 21. Accordingly, the Y-axis direction is also defined as the feeding direction of the printing medium P. In the printing unit 3, a surface provided with the paper ejecting portion 21 is specified as a front surface 22. In the printer 1, the panel 8 is placed on the front surface 22. The panel 8 faces in the same direction as the front surface 22 (Y-axis direction according to this embodiment). The front surface 22 of the printing unit 3 and a front surface 22 of the scanner unit 5 are arranged to be flush with each other. In other words, a front surface 22 of the printer 1 includes the front surface 22 of the printing unit 3 and the front surface 22 of the scanner unit 5. The panel 8 and the front surface 22 of the printing unit 3 are arranged to be flush with each other.

In the printer 1, a vertically upward surface of the scanner unit 5 is specified as an upper surface 23. The tank unit 4 is provided on the front surface 22 of the printing unit 3. The housing 7 is provided with windows 25. The windows 25 are provided on a front surface 26 of the housing 7. The front surface 26 of the tank unit 4 faces in the same direction as the front surface 22 of the printing unit 3 (Y-axis direction according to this embodiment). The tank unit 4 is protruded from the front surface 22 in the Y-axis direction. More specifically, the housing 7 of the tank unit 4 is protruded from the front surface 22 in the Y-axis direction. Accordingly, the front surface 26 of the tank unit 4 is protruded in the Y-axis direction from the front surface 22 of the printing unit 3.

An upper surface 27 of the tank unit 4 is located on a −Z-axis direction side of the upper surface 23 of the scanner unit 5. In the plan view of the printer 1 in the −Z-axis direction, the scanner unit 5 overlaps with part of the tank unit 4. The scanner unit 5 is located on a +Z-axis direction side of the upper surface 27 of the tank unit 4. Accordingly, part of the upper surface 27 of the tank unit 4 is covered with the scanner unit 5.

In the tank unit 4, the windows 25 have optical transparency. The five tanks 10 described above are provided in locations overlapping with the respective windows 25. Each of the tanks 10 has an ink containing portion 29. Ink is contained in the ink containing portion 29 of the tank 10. The window 25 is provided at a position overlapping with the ink containing portion 29 of the tank 10. This configuration enables an operator using the printer 1 to visually check the ink containing portions 29 of the five tanks 10 via the respective windows 25 across the housing 7. According to this embodiment, the windows 25 are provided as openings formed in the housing 7. According to this embodiment, different windows 25 are provided for the respective tanks 10. This configuration enables the operator to visually check the five tanks 10 via the windows 25 formed as the openings. The window 25 is, however, not limited to the opening but may be formed of a material having optical transparency. The configuration of the windows 25 is not limited to the configuration that one window 25 is provided corresponding to one tank 10 but may be a configuration that one window 25 is provided corresponding to a plurality of tanks 10.

According to this embodiment, at least part of a wall of the ink containing portion 29 of each tank 10 that faces the window 25 has optical transparency. Ink contained in the ink containing portion 29 is visible from the part of optical transparency of each ink containing portion 29. The operator can thus visually check the five tanks 10 via the windows 25 and thereby visually check the amounts of inks contained in the ink containing portions 29 of the respective tanks 10. Accordingly, at least part of a region of the tank 10 facing the window 25 is usable as a visible portion that allows the amount of ink to be visually checked. This configuration enables the operator to visually check the visible portions of the five tanks 10 via the windows 25 across the housing 7. The entire wall of the ink containing portion 29 may be configured to have optical transparency. The entire region of the tank 10 facing the window 25 may be used as the visible portion that allows the amount of ink to be visually checked.

The ink herein is not limited to one of water-based ink and oil-based ink. The water-based ink herein may be configured by dissolving a solute such as a dye in an aqueous solvent or by dispersing a dispersoid such as a pigment in an aqueous dispersion medium. The oil-based ink herein may be configured by dissolving a solute such as a dye in an oily solvent or by dispersing a dispersoid such as a pigment in an oily dispersion medium.

In the printer 1, the printing unit 3 and the scanner unit 5 are arranged to overlap with each other. In the use state of the printing unit 3, the scanner unit 5 is located vertically above the printing unit 3. The scanner unit 5 is a flat bed type and includes an original cover that is rotated to be openable and closable and an original placement plane (not shown) that is exposed when the original cover is opened. The scanner unit 5 includes an imaging element (not shown) such as an image sensor. The scanner unit 5 is configured to read an image provided on an original such as a sheet of paper placed on the original placement plane, in the form of image data via the imaging element. Accordingly, the scanner unit 5 serves as a reading device of images and the like.

Figure 2:
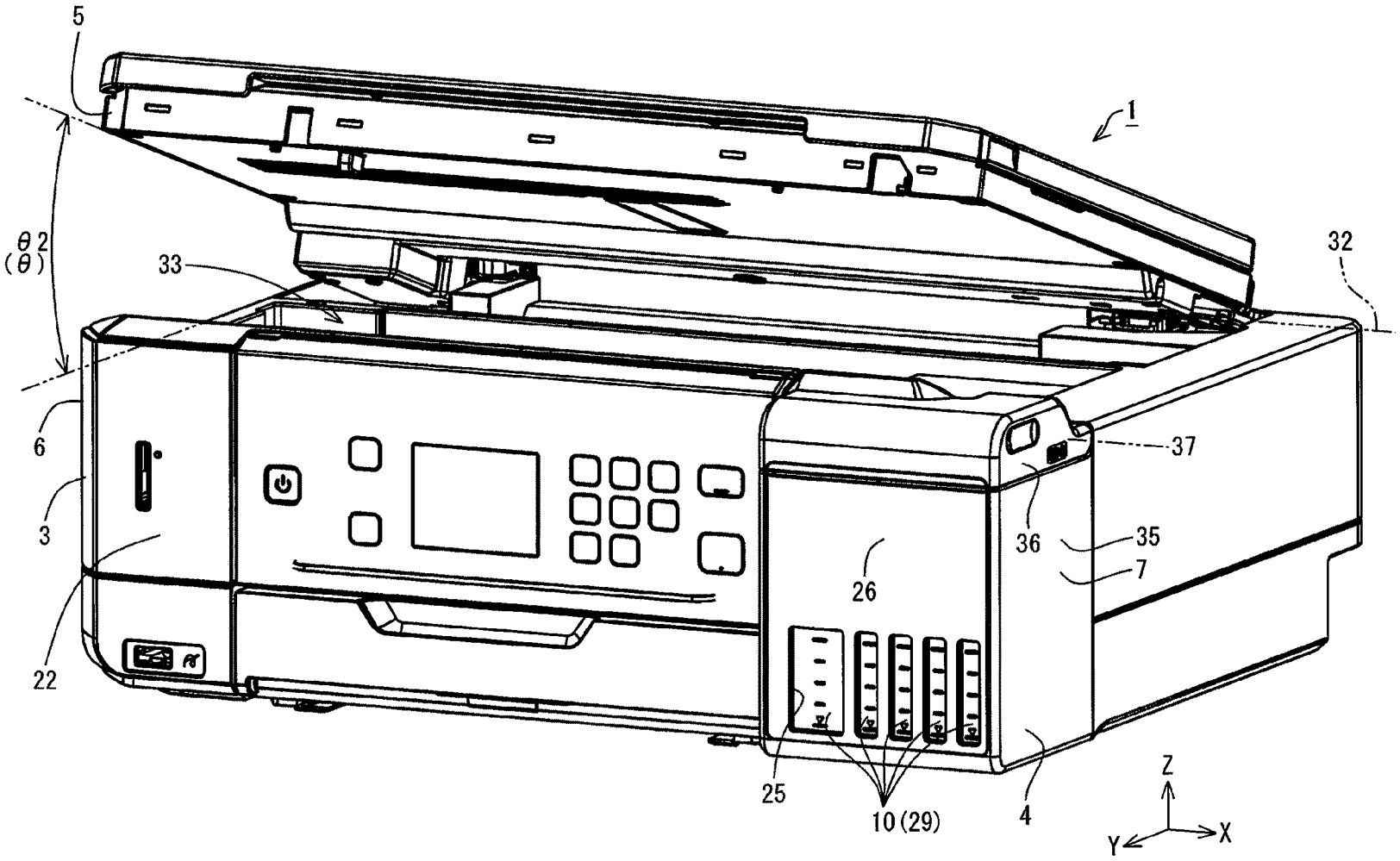
FIG. 2 is a perspective view illustrating the main configuration of the printer according to the embodiment.

As shown in FIG. 2, the scanner unit 5 is configured to be rotatable relative to the printing unit 3. The scanner unit 5 is configured to be rotatable about a rotating axis 32 that is extended along the X axis. An opening 33 is formed in the housing 6 of the printing unit 3. The scanner unit 5 also serves as a cover to cover the opening 33 of the housing 6 of the printing unit 3. The operator lifts up the scanner unit 5 in the Z-axis direction, so as to rotate the scanner unit 5 relative to the printing unit 3. The scanner unit 5 serving as the cover of the printing unit 3 can thus be opened relative to the printing unit 3. Opening the scanner unit 5 relative to the printing unit 3 causes the opening 33 of the housing 6 to be exposed. FIG. 2 illustrates the state that the scanner unit 5 is opened relative to the printing unit 3 and that the opening 33 of the housing 6 is exposed.

The state that the scanner unit 5 is opened relative to the printing unit 3 and that the opening 33 of the housing 6 is exposed is called open state. The state that the scanner unit 5 is closed relative to the printing unit 3 and that the opening 33 of the housing 6 is covered by the scanner unit 5 is, on the other hand, called closed state. In the printer 1, the scanner unit 5 is configured as a main body cover that is changed over between the closed state to cover the opening 33 formed in the housing 6 and the open state to make the opening 33 exposed. The state of the scanner unit 5 that is one example of a main body cover is changed from the closed state to the open state by rotating the scanner unit 5 and changing the attitude of the scanner unit 5 relative to the housing 6. In the printer 1, the state of the scanner unit 5 as one example of the main body cover is accordingly changed from the closed state to the open state by rotation.

Figure 3:
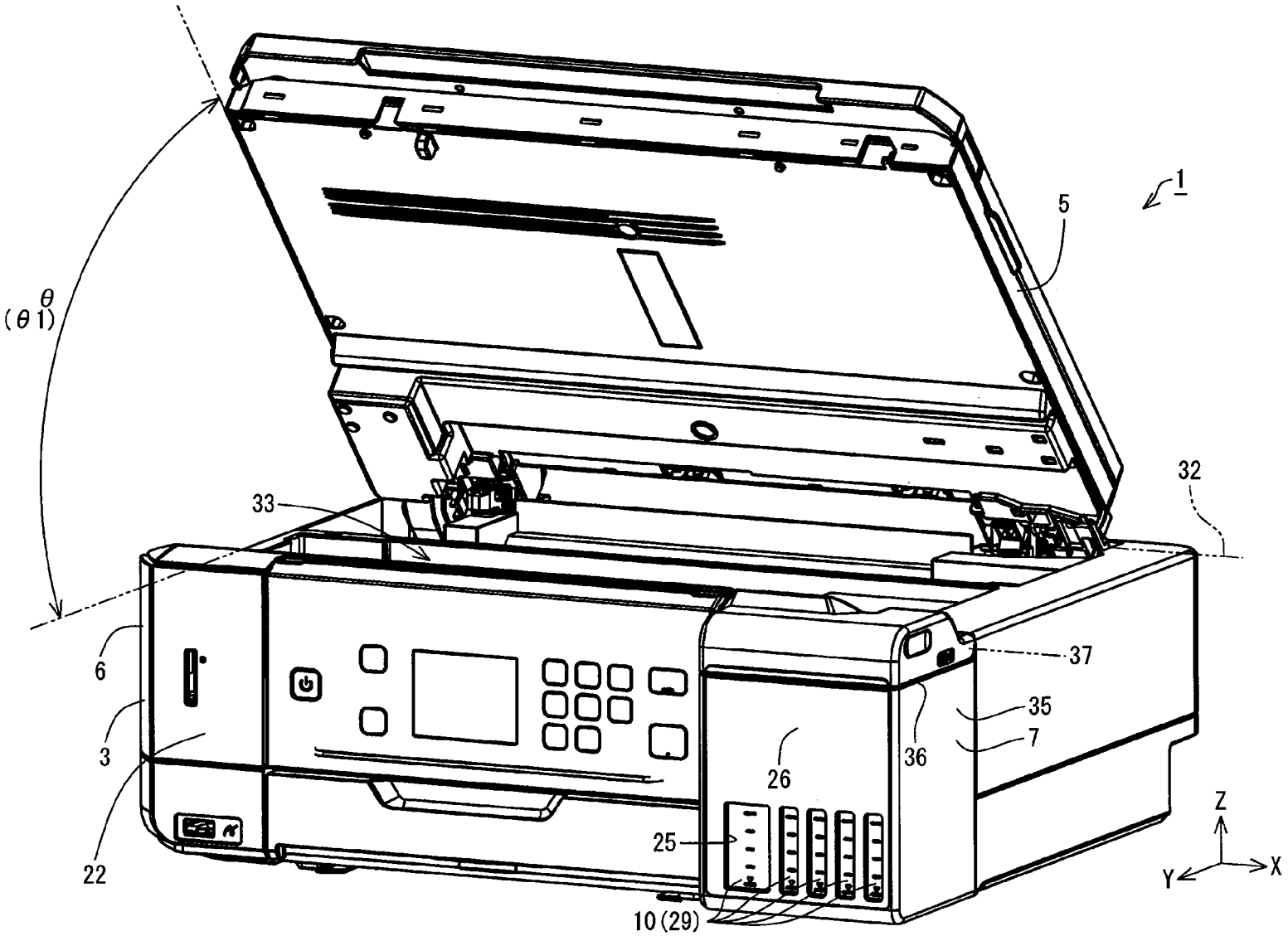
FIG. 3 is a perspective view illustrating the main configuration of the printer according to the embodiment.

According to this embodiment, the scanner unit 5 and the housing 6 are coupled with each other via a hinge mechanism (not shown). The scanner unit 5 is configured to be rotatable relative to the housing 6 by this hinge mechanism. The hinge mechanism serves to limit a rotation range of the scanner unit 5 relative to the housing 6. As shown in FIG. 3, the rotation range of the scanner unit 5 relative to the housing 6 is specified by an angle θ of rotation of the scanner unit 5 relative to the housing 6. According to this embodiment, the angle θ is smaller than 90 degrees. More specifically, the angle θ is 0 degree in the state that the scanner unit 5 is closed relative to the housing 6 (closed state). The angle θ is smaller than 90 degrees when the scanner unit 5 is opened relative to the housing 6 to an upper limit of the rotation range. The angle θ of the scanner unit 5 opened relative to the housing 6 to the upper limit of the rotation range is equal to an angle θ1. The position of the scanner unit 5 relative to the housing 6 at the angle θ1 is called first open position. FIG. 3 illustrates the state that the scanner unit 5 is at the first open position.

FIG. 2, on the other hand, illustrates the state that the angle θ is equal to an angle θ2. The angle θ2 is smaller than the angle θ1. More specifically, FIG. 2 illustrates the state that the scanner unit 5 is moved in a closing direction from the first open position relative to the housing 6. The scanner unit 5 is, however, still in the open state in FIG. 2. In other words, the angle θ2 is larger than 0 degree. The position of the scanner unit 5 relative to the housing 6 at the angle θ2 is called second open position. FIG. 2 illustrates the state that the scanner unit 5 is at the second open position.

The angle θ in the closed state of the scanner unit 5 is 0 degree and is expressed as an angle θ0. The angle θ0, the angle θ1 and the angle θ2 have the following relationship shown by Expression (1):

$$\text{angle } \theta 0 < \text{angle } \theta 2 < \text{angle } \theta 1 \quad (1)$$

The main body cover configured to change over the state between the closed state and the open state is not limited to the scanner unit 5. The main body cover may have any configuration that enables the state to be changed over between the closed state to cover the opening 33 formed in the housing 6 and the open state to make the opening 33 exposed. The main body cover may be a simple main body cover having only the function of the cover. Accordingly, a main body cover configured to change over the state of the housing 6 with the opening 33 formed therein between the closed state and the open state may be employed for the printer 1 without the scanner unit 5.

Figure 4:
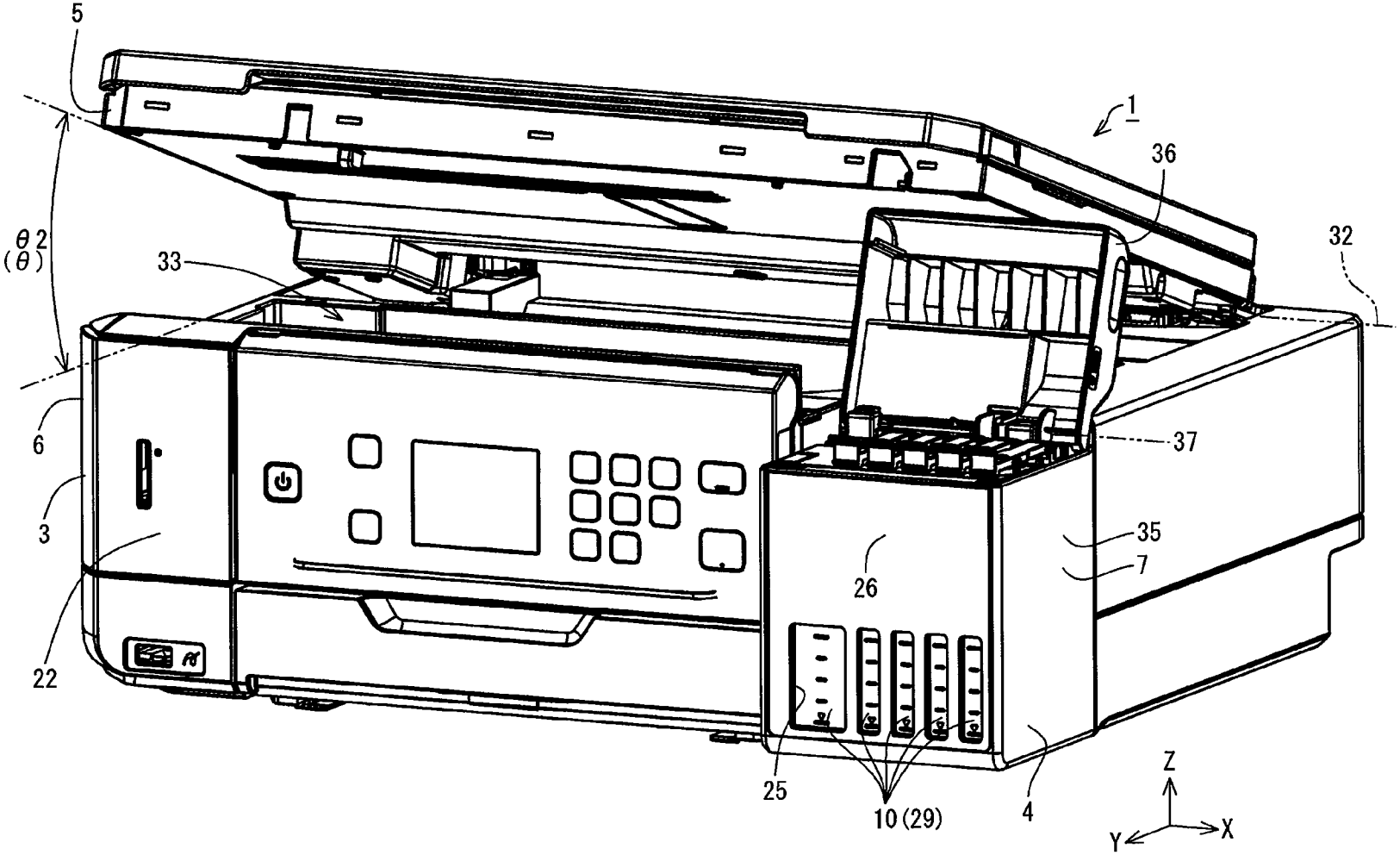
FIG. 4 is a perspective view illustrating the main configuration of the printer according to the embodiment.

As shown in FIG. 4, the housing 7 includes a main body portion 35 and a tank cover 36. The tank cover 36 is configured to be rotatable relative to the main body portion 35 and thereby to be opened and closed relative to the main body portion 35. The tank cover 36 is configured to be rotatable about a rotating axis 37 that is extended along the X axis. The tanks 10 are placed in the main body portion 35. The tank cover 36 serves as a cover to cover the main body portion 35. Application of a force in the Z-axis direction to the tank cover 36 causes the tank cover 36 to be rotated relative to the main body portion 35. The tank cover 36 serving as the cover of the main body portion 35 is accordingly opened relative to the main body portion 35. The state of the tank cover 36 is changed from the closed state to the open state by rotating the tank cover 36 and changing the attitude of the tank cover 36 relative to the main body portion 35. In the printer 1, the state of the tank cover 36 is accordingly changed from the closed state to the open state by rotation.

In the printer 1, as shown in FIG. 1, in the closed state of both the tank cover 36 and the scanner unit 5, the scanner unit 5 overlaps with part of the tank cover 36. In the use attitude, in the plan view of the scanner unit 5 in the closed state in the −Z-axis direction, the scanner unit 5 covers part of the tank cover 36. Accordingly, the tank cover 36 is in the closed state when the scanner unit 5 is in the closed state. As shown in FIG. 4, the tank cover 36 is allowed to be in the open state when the scanner unit 5 is in the open state.

Figure 5:
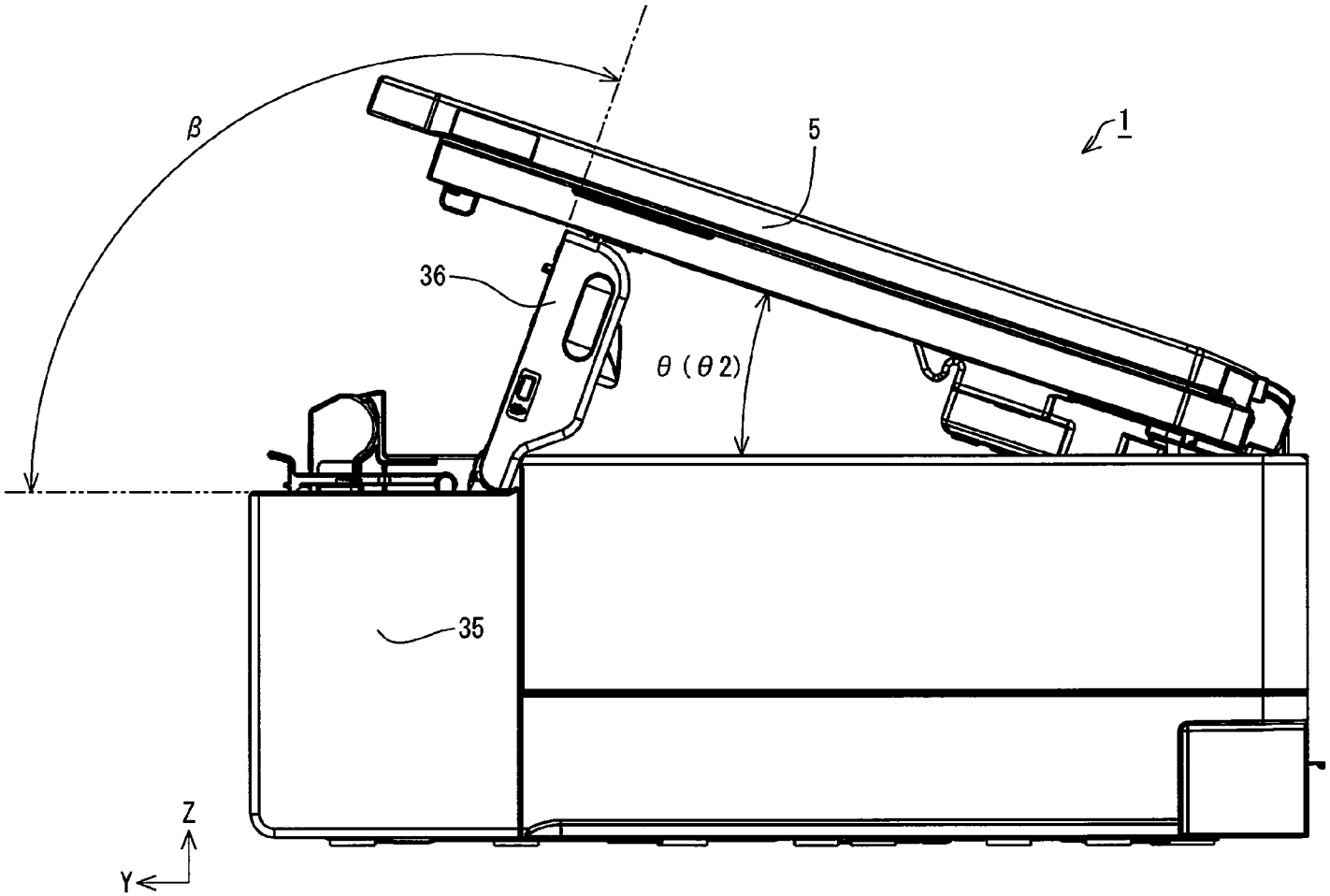
FIG. 5 is a side view illustrating the main configuration of the printer according to the embodiment.

According to this embodiment, as shown in FIG. 5, a rotatable angle β of the tank cover 36 relative to the main body portion 35 is larger than 90 degrees and is smaller than 180 degrees. According to this embodiment, the scanner unit 5 is supported by the tank cover 36 in the state that the tank cover 36 is opened to a position that maximizes the angle β. Accordingly, the scanner unit 5 is kept in the open state by the tank cover 36 that is in the open state. In the state that the tank cover 36 supports the scanner unit 5, the scanner unit 5 is located at the second open position. In other words, in the state that the tank cover 36 supports the scanner unit 5, the angle θ is the angle θ2. The second open position that provides the angle θ2 may thus be defined as a position where the scanner unit 5 is kept in the open state by the tank cover 36. The above configuration causes the tank cover 36 to serve as a support portion to keep the scanner unit 5 as one example of the main body cover in the open state.

Figure 6:
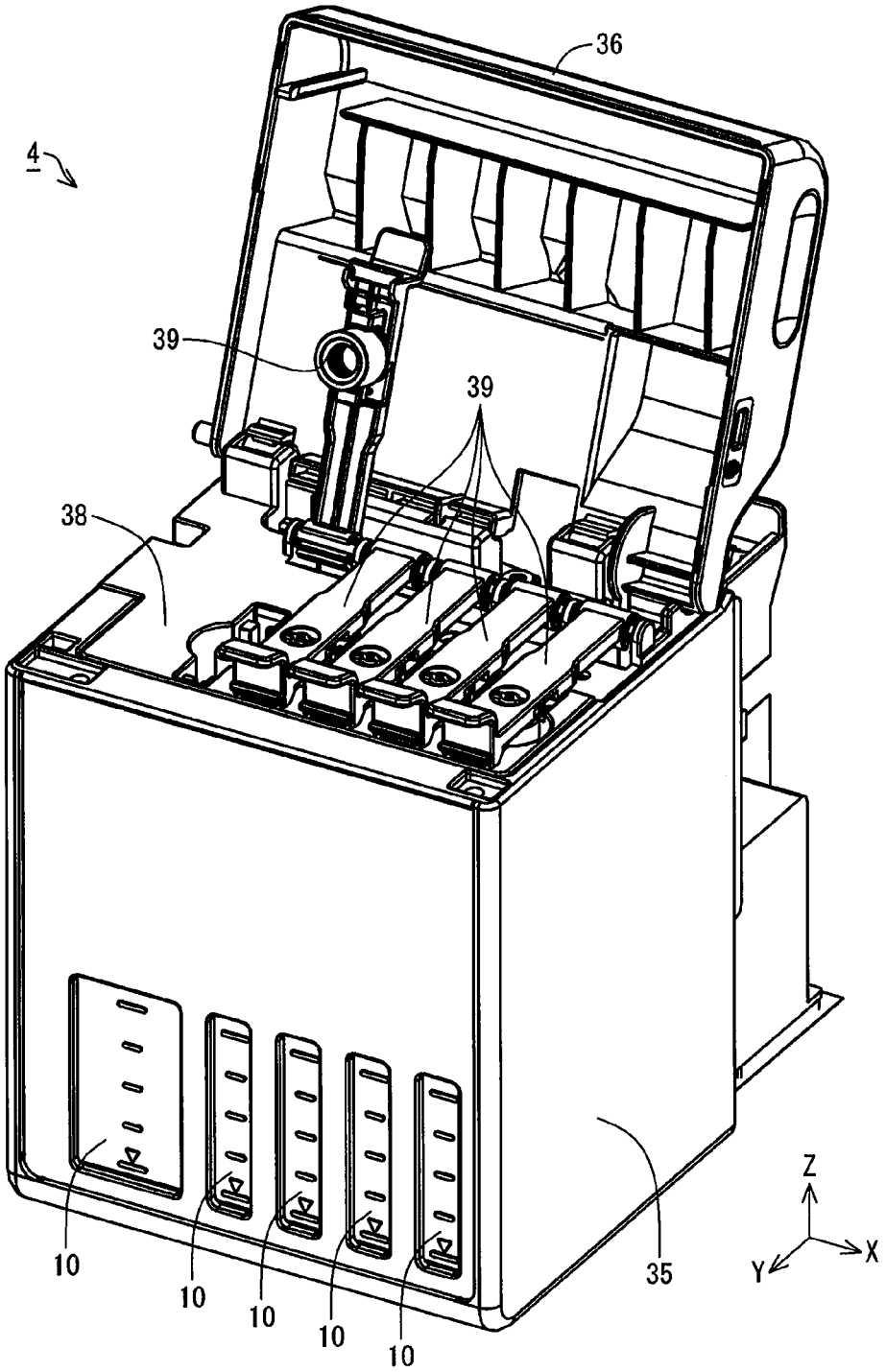
FIG. 6 is a perspective view illustrating the main configuration of a tank unit according to the embodiment.

As shown in FIG. 6, the tank unit 4 include an adapter 38 and a plurality of cover members 39. According to this embodiment, the cover members 39 are provided corresponding to the number of the tanks 10. The adapter 38 is placed on a +Z-axis direction end of the main body portion 35 to close the +Z-axis direction side of the main body portion 35. The plurality of tanks 10 are located on a −Z-axis direction side of the adapter 38. The cover members 39 are configured to be rotatable relative to the adapter 38. The cover members 39 are configured to close ink supply ports (described later)) of the respective tanks 10 that pass through the adapter 38 to be exposed.

Application of a force in the Z-axis direction to the cover member 39 causes the cover member 39 to be rotated relative to the adapter 38 and thereby opens the cover member 39 relative to the adapter 38. The state of the cover member 39 is changed from the closed state to the open state by rotating the cover member 39 and changing the attitude of the cover member 39 relative to the adapter 38. In the printer 1, the state of the cover member 39 is accordingly changed from the closed state to the open state by rotation. According to this embodiment, five cover members 39 are provided corresponding to the number of the tanks 10. This means that one cover member 39 is provided corresponding to one tank 10. FIG. 6 illustrates the state that one cover member 39 out of the five cover members 39 is in the open state and the other cover members 39 are in the closed state.

Figure 7:
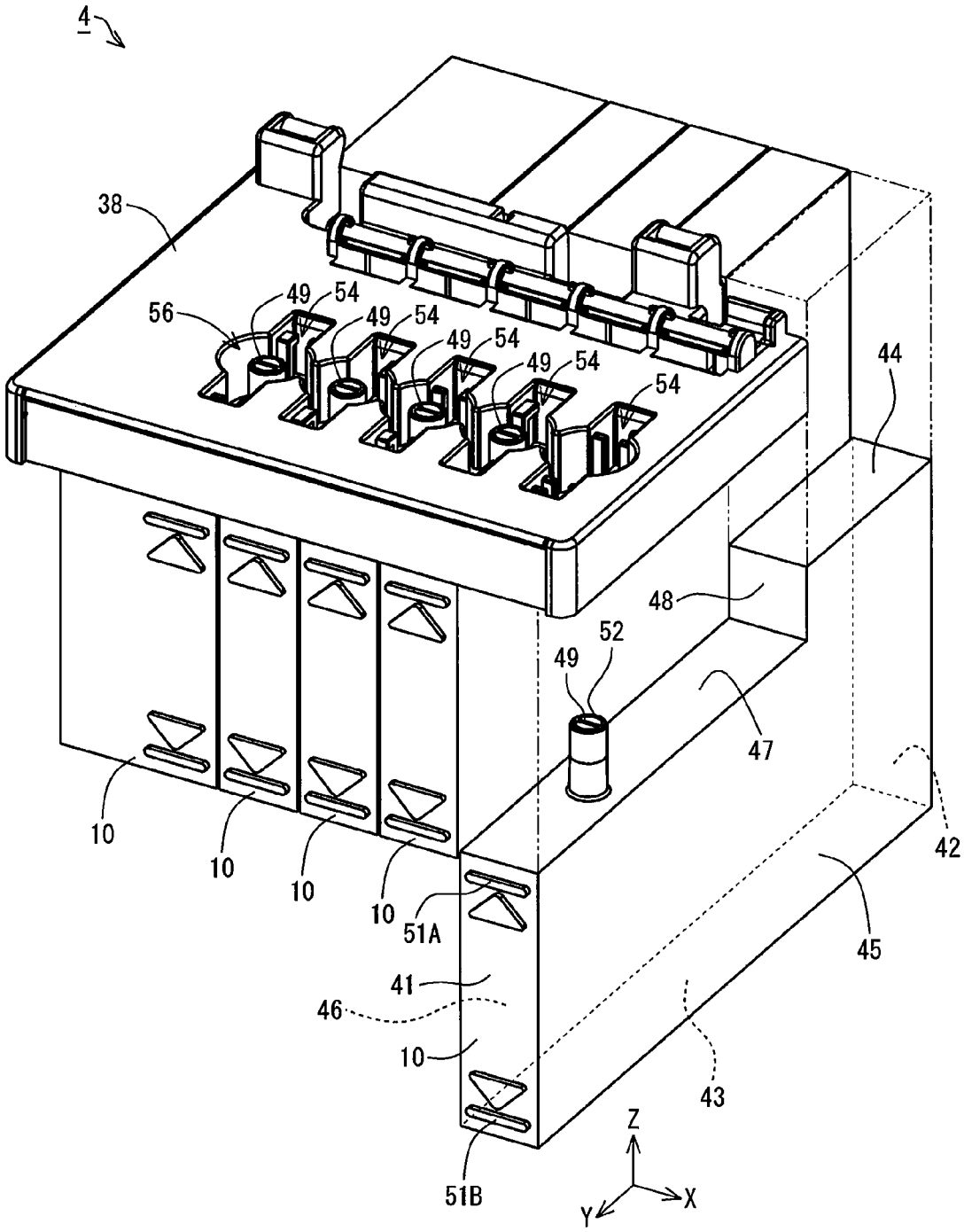
FIG. 7 is a perspective view illustrating the main configuration of the tank unit according to the embodiment.

According to this embodiment, as shown in FIG. 7, the plurality of tanks 10 are integrated by the adapter 38. For the purpose of easy understanding of the configuration, FIG. 7 illustrates the state that one tank 10 among the plurality of tanks 10 is detached from the adapter 38. The plurality of tanks 10 have identical configurations and shapes but may include tanks of different ink capacities. According to this embodiment, different types of inks may be contained respectively in the plurality of tanks 10 or an identical type of ink may be contained in the plurality of tanks 10. The type of ink herein means, for example, the color of ink. For example, according to this embodiment, different colors of inks may be contained respectively in the plurality of tanks 10 or an identical color of ink may be contained in the plurality of tanks 10. The different colors of inks may be, for example, black, yellow, magenta and cyan.

The tank 10 is configured to have a larger length dimension along the Y axis than a width dimension along the X axis. The tank 10 is also configured to have a smaller height dimension along the Z axis than the length dimension along the Y axis. The dimensions of the tank 10 are, however, not limited to this configuration, but any suitable dimensions may be employed for the tank 10. The tank 10 includes a first wall 41, a second wall 42, a third wall 43, a fourth wall 44, a fifth wall 45, a sixth wall 46, a seventh wall 47 and an eighth wall 48. The tank 10 also includes a connection tube 49. The first wall 41 to the eighth wall 48 define an outer shell of the tank 10. The number of the walls defining the outer shell of the tank 10 is not limited to the eight walls of the first wall 41 to the eighth wall 48 but may be a number of walls less than eight or a number of walls greater than eight.

The first wall 41 is arranged to face in the +Y-axis direction and is extended along an XZ plane. The first wall 41 has optical transparency and is configured to cause the ink contained in the tank 10 to be visually checked through the first wall 41. The first wall 41 is accordingly provided as a visible wall that causes the amount of ink contained in the tank 10 to be visible. For example, an upper limit mark 51A and a lower limit mark 51B are provided on the first wall 41. The operator can check the amount of ink contained in the tank 10 using the upper limit mark 51A and the lower limit mark 51B as guides or rough indications.

A sign or mark used to inform the amount of ink contained in the tank 10 is not limited to the upper limit mark 51A and the lower limit mark 51B but may be, for example, a scale indicating the amount of ink. According to a modification, a scale may be provided in addition to the upper limit mark 51A and the lower limit mark 51B, or a scale may be provided with omission of the upper limit mark 51A and the lower limit mark 51B. A sign or mark indicating the type of ink contained in each of the tanks 10 may also be provided as the sign or mark of the tank 10. For example, the sign or mark indicating the type of ink may be a sign or mark indicating the color of ink. The sign or mark indicating the color of ink may be any of various indicators, for example, letters such as "Bk" indicating black ink, "C" indicating cyan ink, "M" indicating magenta ink and "Y" indicating yellow ink or color representation.

The second wall 42 is arranged to be opposed to the first wall 41 and to face in the −Y-axis direction. The second wall 42 is extended along the XZ plane. The third wall 43 is arranged to intersect with the first wall 41 and the second wall 42. The arrangement that two surfaces intersect with each other indicates the positional relationship that the two surfaces are not parallel to each other. The arrangement that two surfaces intersect with each other includes not only the arrangement that two surfaces are adjacent to each other and are directly in contact with each other but the arrangement that two surfaces are not directly in contact with each other and are away from each other but have the positional relationship that an extension of one surface intersects with an extension of the other surface. The angle formed by the two surfaces intersecting with each other may be any of a right angle, an acute angle and an obtuse angle.

The third wall 43 is arranged to intersect with the first wall 41 and the second wall 42. The third wall 43 is located on a −Z-axis direction side of the first wall 41 and the second wall 42 and is arranged to face in the −Z-axis direction. The third wall 43 is extended along an XY plane. A +Y-axis direction end of the third wall 43 is connected with a −Z-axis direction end of the first wall 41. A −Y-axis direction end of the third wall 43 is connected with a −Z-axis direction end of the second wall 42.

The fourth wall 44 is arranged to be opposed to the third wall 43 and to face in the +Z-axis direction. The fourth wall 44 is arranged to intersect with the second wall 42 and is extended along the XY plane. The fourth wall 44 is located on a +Z-axis direction side of the second wall 42. The fourth wall 44 is located on a −Y-axis direction side of the first wall 41. A −Y-axis direction end of the fourth wall 44 is connected with a +Z-axis direction end of the second wall 42.

The fifth wall 45 is arranged to intersect with the first wall 41, the second wall 42, the third wall 43 and the fourth wall 44. The fifth wall 45 is located on a +X-axis direction side of the first wall 41, the second wall 42, the third wall 43 and the fourth wall 44. The fifth wall 45 is arranged to face in the +X-axis direction and is extended along a YZ plane. A +Y-axis direction end of the fifth wall 45 is connected with a +X-axis direction end of the first wall 41. A −Y-axis direction end of the fifth wall 45 is connected with a +X-axis direction end of the second wall 42. A −Z-axis direction end of the fifth wall 45 is connected with a +X-axis direction end of the third wall 43. A +Z-axis direction end of the fifth wall 45 is connected with a +X-axis direction end of the fourth wall 44.

The sixth wall 46 is arranged to intersect with the first wall 41, the second wall 42, the third wall 43 and the fourth wall 44. The sixth wall 46 is located on a −X-axis direction side of the first wall 41, the second wall 42, the third wall 43 and the fourth wall 44 and is arranged to be opposed to the fifth wall 45. The sixth wall 46 is arranged to face in the −X-axis direction and is extended along the YZ plane. A +Y-axis direction end of the sixth wall 46 is connected with a −X-axis direction end of the first wall 41. A −Y-axis direction end of the sixth wall 46 is connected with a −X-axis direction end of the second wall 42. A −Z-axis direction end of the sixth wall 46 is connected with a −X-axis direction end of the third wall 43. A +Z-axis direction end of the sixth wall 46 is connected with a −X-axis direction end of the fourth wall 44.

The seventh wall 47 is located on a +Z-axis direction side of the first wall 41 and is arranged to intersect with the first wall 41. The seventh wall 47 is arranged to face in the +Z-axis direction and is extended along the XY plane. The seventh wall 47 is located between the third wall 43 and the fourth wall 44. A +Y-axis direction end of the seventh wall 47 is connected with a +Z-axis direction end of the first wall 41. In other words, the tank 10 has a difference in level between the fourth wall 44 and the seventh wall 47. A+X-axis direction end of the seventh wall 47 is connected with the fifth wall 45. A −X-axis direction end of the seventh wall 47 is connected with the sixth wall 46.

The eighth wall 48 is located on a −Y-axis direction of the seventh wall 47 and is arranged to face in the +Y-axis direction. The eighth wall 48 is located on a +Y-axis direction side of the fourth wall 44. The eighth wall 48 is extended along the XZ plane. A −Z-axis direction end of the eighth wall 48 is connected with a −Y-axis direction end of the seventh wall 47. A +Z-axis direction end of the eighth wall 48 is connected with a +Y-axis direction end of the fourth wall 44. In other words, the fourth wall 44 and the seventh wall 47 having the level difference are connected with each other by the eighth wall 48 in the tank 10.

A connection tube 49 that is one example of a connecting portion is provided on a +Z-axis direction side face of the seventh wall 47. The connection tube 49 is protruded in the +Z-axis direction from the seventh wall 47. The connection tube 49 is formed in a hollow tubular shape and is extended in the +Z-axis direction. In other words, the connection tube 49 is in a chimney-like form. An ink inlet 52 is open on a +Z-axis direction end of the connection tube 49. The ink inlet 52 is an opening formed in the connection tube 49. The connection tube 49 is arranged to communicate with inside of the tank 10. The ink to be filled into the tank 10 is injected from the ink inlet 52 through the connection tube 49 into the tank 10.

Figure 8:
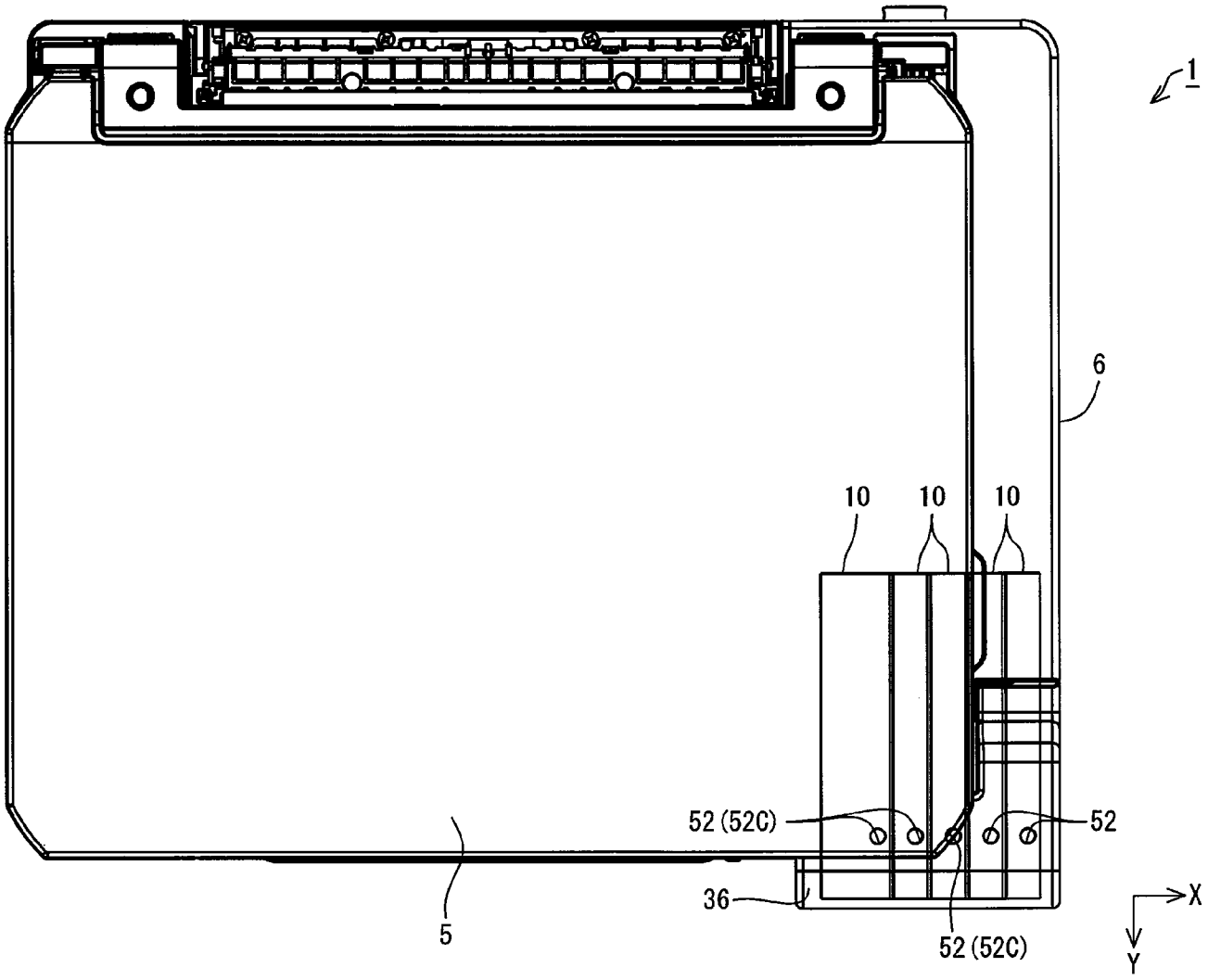
FIG. 8 is a plan view illustrating the main configuration of the printer according to the embodiment.

According to this embodiment, as shown in FIG. 8, in the plan view of the scanner unit 5 in the closed state in the −Z-axis direction, the scanner unit 5 covers at least part of the tank cover 36 and at least part of the ink inlets 52. More specifically, two ink inlets 52 among five ink inlets 52 are covered by the scanner unit 5. Two other ink inlets 52 among the remaining ink inlet 52 are located outside of the area of the scanner unit 5. In other words, these two other ink inlets 52 do not overlap with the scanner unit 5. Part of last one ink inlet 52 is covered by the scanner unit 5, while a remaining part of the last one ink inlet 52 is located outside of the area of the scanner unit 5. Among the five ink inlets 52, each ink inlet 52 at least partly overlapping with the scanner unit 5 is called ink inlet 52C.

Figure 9:
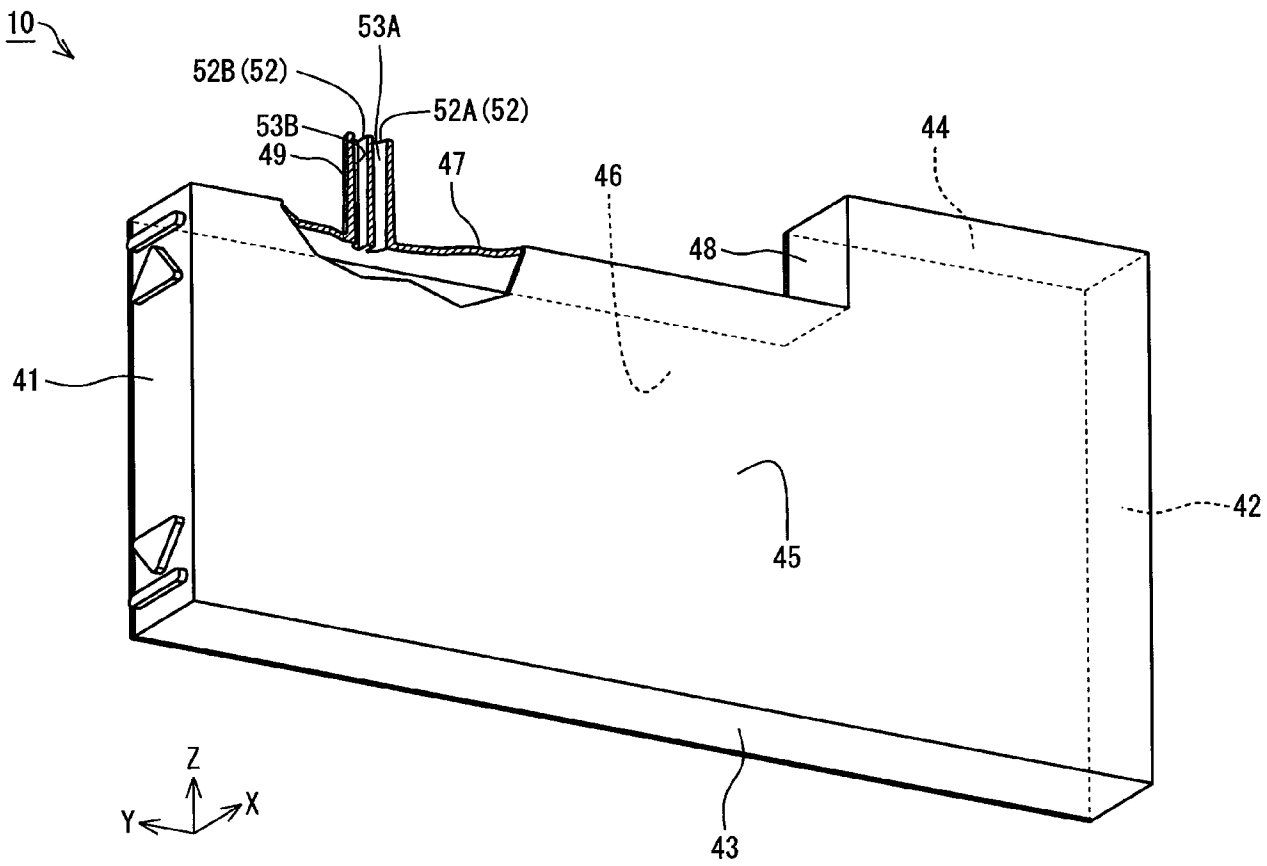
FIG. 9 is a perspective view illustrating the tank according to the embodiment.

In the tank 10, as shown in FIG. 9, the inside of the connection tube 49 is divided along the Z axis into two flow paths 53A and 53B. Accordingly, each ink inlet 52 is also divided into two ink inlets 52A and 52B. The ink inlet 52A is an opening of the flow path 53A, and the ink inlet 52B is an opening of the flow path 53B. The two flow paths 53A and 53B are respectively arranged to communicate with the inside of the tank 10. For the purpose of easy understanding of the inside of the connection tube 49, FIG. 9 is a partly cutaway diagram illustrating the tank 10 including the connection tube 49.

As illustrated in FIG. 7, the adapter 38 is configured to have a dimension extended across the plurality of tanks 10 arrayed along the X axis. The adapter 38 is located on a +Z-axis direction side of the seventh walls 47 of the tanks 10. A plurality of slot portions 54 are formed in the adapter 38. The adapter 38 includes the slot portions 54 provided respectively corresponding to the plurality of tanks 10 arrayed along the X axis. The number of slot portions 54 may be larger than the number of the plurality of tanks 10 arrayed along the X axis.

The slot portion 54 is formed to be recessed in the −Z-axis direction from a +Z-axis direction-side upper surface of the adapter 38. A through hole 55 described later is formed in the bottom of the slot portion 54. This through hole 55 is formed to pass through the adapter 38 along the Z axis. The through hole 55 is formed to have such a size that allows for insertion of the connection tube 49 of the tank 10 therein. The adapter 38 is mounted to respective level difference portions between the fourth walls 44 and the seventh walls 47 of the respective tanks 10.

When the adapter 38 is mounted to the tanks 10, the connection tubes 49 of the respective tanks 10 are inserted through the through holes 55 into the slot portions 54 of the adapter 38 in the tank unit 4. In the state that the adapter 38 is mounted to the tanks 10, the connection tubes 49 of the respective tanks 10 are accordingly exposed via the slot portions 54 of the adapter 38. The slot portion 54 of the adapter 38 and the internal configuration of the slot portion 54 (including the connection tube 49) in the state that the adapter 38 is mounted to the tanks 10 is collectively called ink filling portion 56.

Figure 10:
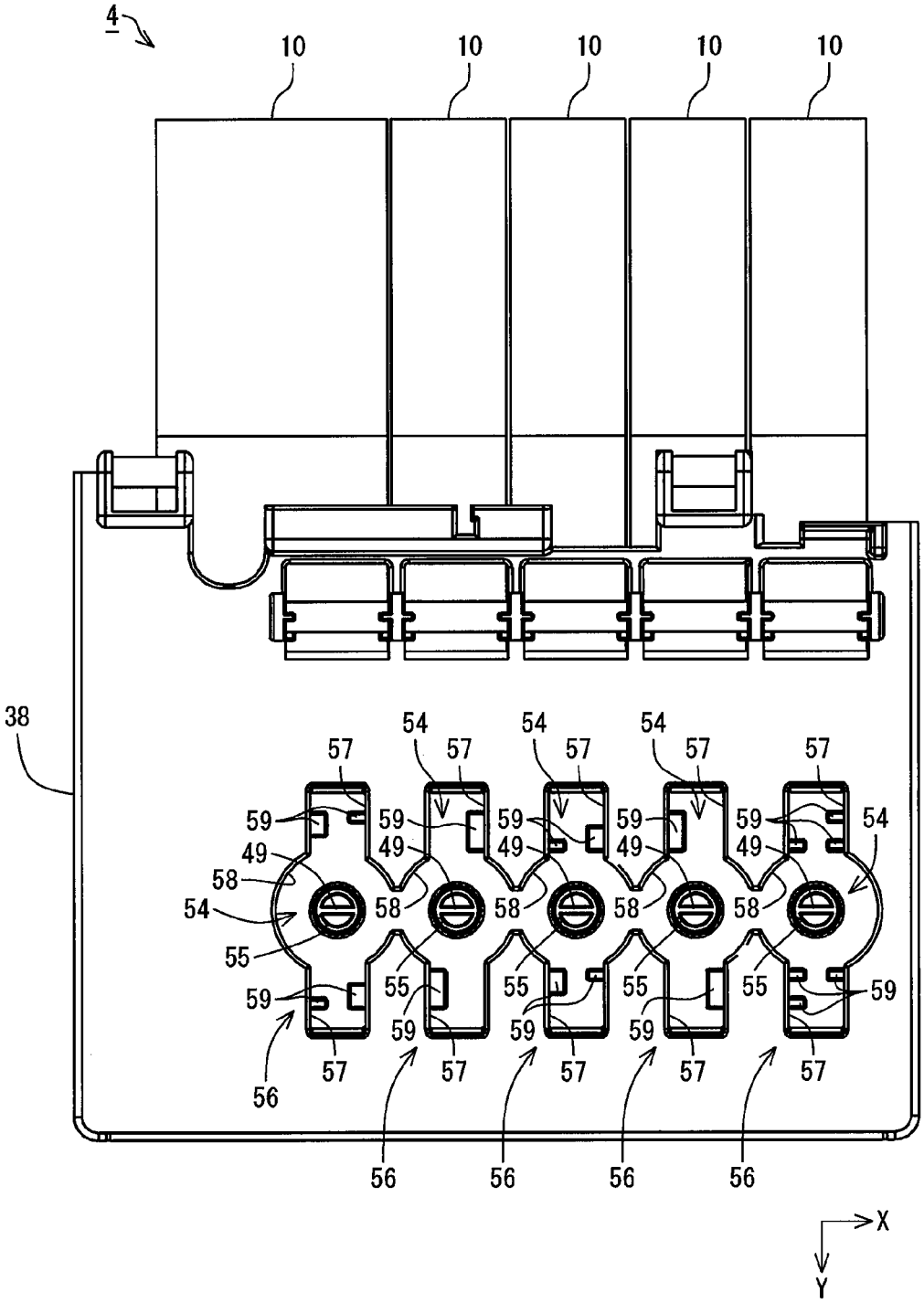
FIG. 10 is a plan view illustrating the tank and an adapter according to the embodiment.

As illustrated in FIG. 10, each of the slot portions 54 is formed in such an outer shape that rectangular portions 57 in a rectangular shape extended along the Y axis are arranged to overlap with a circular portion 58 in a circular shape located in the middle of the rectangular portions 57 along the Y axis. The through hole 55 is formed in the bottom of the circular portion 58. According to this embodiment, the circular portions 58 of respective adjacent slot portions 54 that are adjacent to one another along the X axis are interconnected. The connection tube 49 of the tank 10 is located at a position overlapping with the through hole 55 of the circular portion 58.

First projections 59 are provided on inner walls extended along the YZ plane out of inner walls of the rectangular portions 57. In each of the slot portions 54, the first projections 59 are provided in the rectangular portions 57 that are opposed to each other across the circular portion 58. In each of the slot portions 54, the first projections 59 are provided symmetrically with respect to a center point of the connection tube 49. Accordingly, the slot portion 54 has a symmetrical configuration with respect to the center point of the connection tube 49. The plurality of slot portions 54 provided in the adapter 38 respectively include the first projections 59 of different configurations. This means that the plurality of slot portions 54 provided in the adapter 38 respectively have different configurations.

An ink bottle 62 described later, on the other hand, includes recesses that are provided corresponding to the configuration of each of the plurality of slot portions 54 provided in the adapter 38, such as to mate with the first projections 59 of the corresponding slot portion 54. This specifies the configuration of the ink bottle 62 mating with each of the plurality of slot portions 54 provided in the adapter 38. In other words, the plurality of slot portions 54 provided in the adapter 38 may serve as keyholes of respectively different configurations. The ink bottles 62 respectively mating with the plurality of slot portions 54 provided in the adapter 38 may serve as keys fit in the keyholes. Ink is thus allowed to be injected from the ink bottle 62 that is fit in the keyhole, through the connection tube 49 into the tank 10. On the contrary, ink is not allowed to be injected into the tank 10 from the ink bottle 62 that is not fit in the keyhole.

Figure 11:
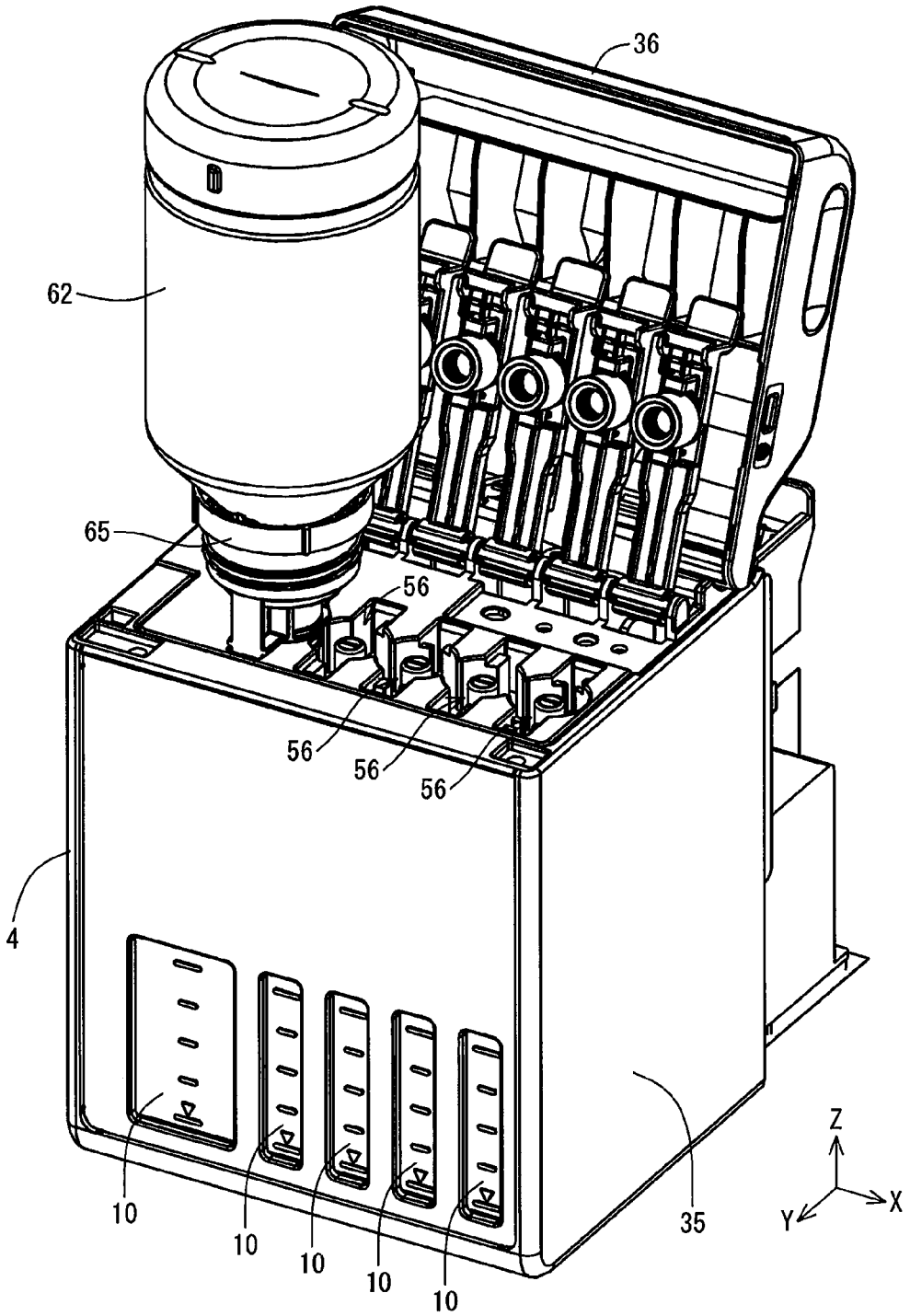
FIG. 11 is a perspective view illustrating an ink bottle and the tank unit according to the embodiment.

According to this embodiment, the ink bottle 62 inserted into the mating ink filling portion 56 is self-supported relative to the tank unit 4 in the use attitude as shown in FIG. 11. The term "self-supported" herein means the state of being stood without human intervention. The ink bottle 62 inserted in the ink filling portion 56 is supported by the ink filling portion 56. This configuration enables the ink bottle 62 to be self-supported relative to the tank unit 4 in the use attitude.

Figure 12:
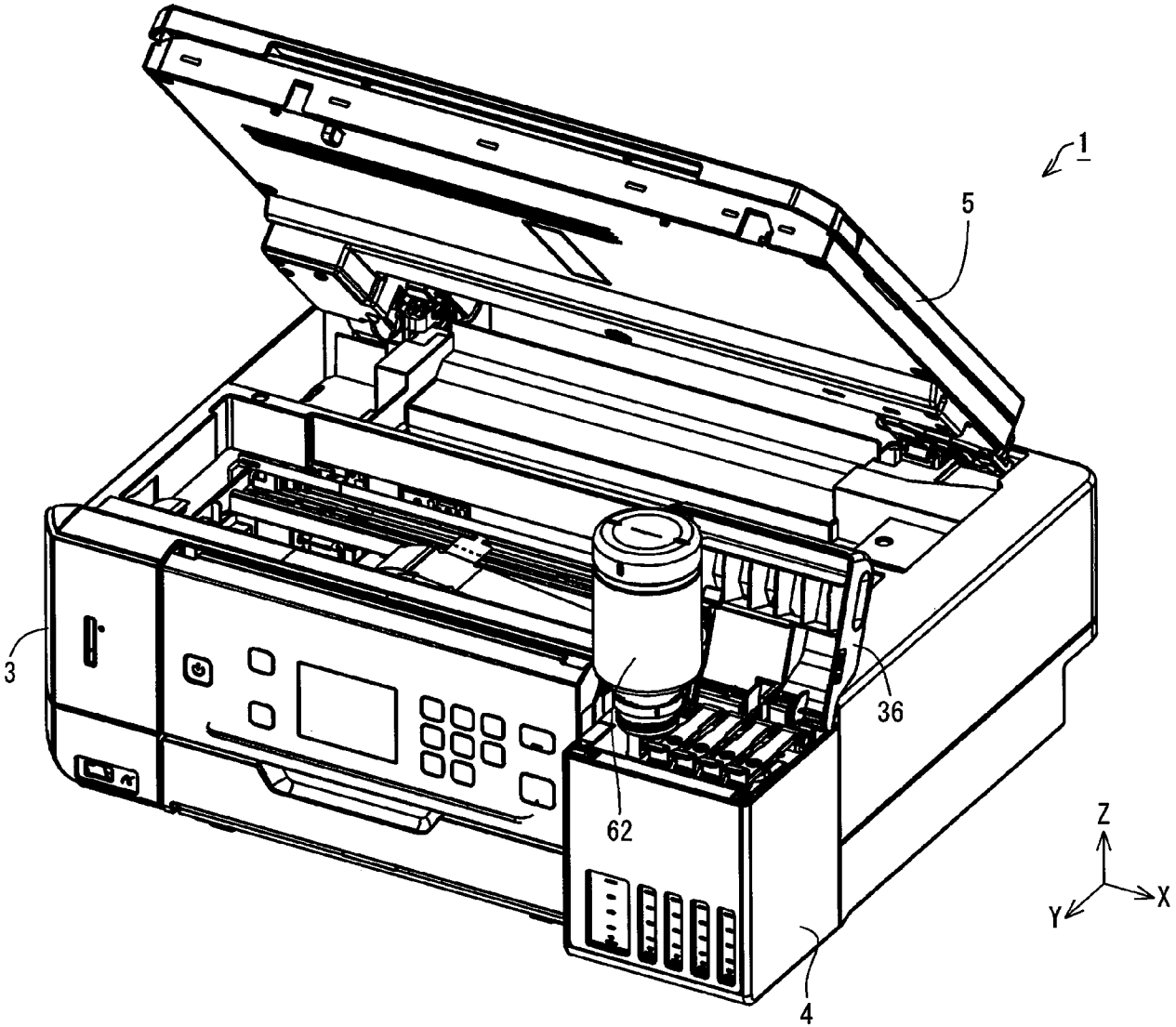
FIG. 12 is a perspective view illustrating the printer and an ink bottle according to the embodiment.

According to this embodiment, as shown in FIG. 12, in the open state of both the scanner unit 5 and the tank cover 36, ink contained in the self-supported ink bottle 62 is allowed to be filled into the tank 10. Accordingly, when the ink bottle 62 is self-supported in the ink filling portion 56, ink contained in the ink bottle 62 can be filled into the tank 10 without human intervention. According to this embodiment, ink contained in the ink bottle 62 may thus be filled into the tank 10 by simply inserting the ink bottle 62 into the ink filling portion 56. This configuration does not require human intervention of manually supporting the ink bottle 62 between the housing 6 and the scanner unit 5 in the process of ink filling into the tank 10. This configuration ensures stable ink filling into the tank 10.

Figure 13:
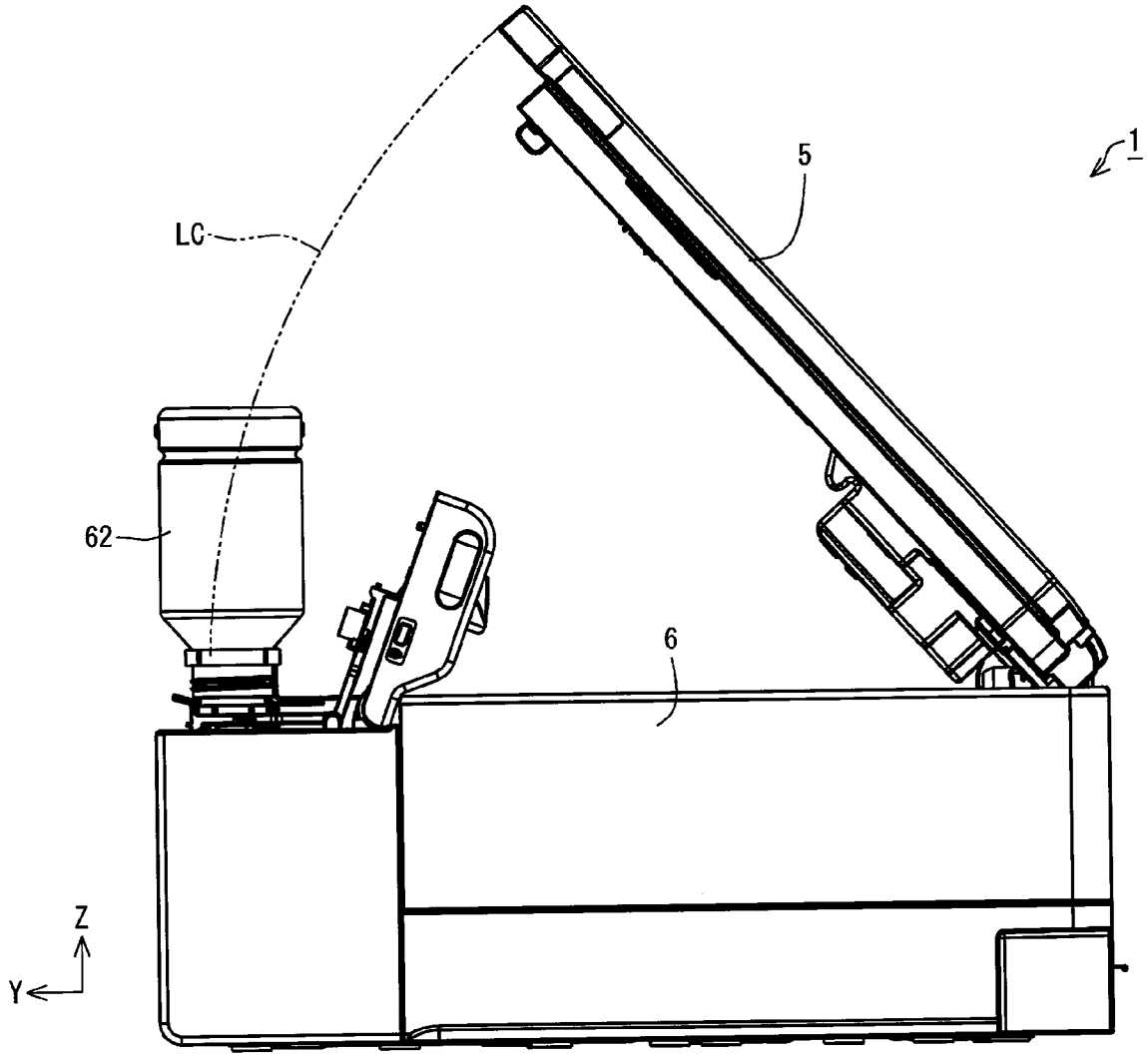
FIG. 13 is a side view illustrating the printer and the ink bottle according to the embodiment.

When the ink bottle 62 is self-supported relative to the ink inlet 52C described above, there is a space between the scanner unit 5 and the ink bottle 62. Accordingly, when the ink bottle 62 is self-supported in the open state of both the scanner unit 5 and the tank cover 36, the scanner unit 5 and the ink bottle 62 do not interfere with each other. The same applies to any of the five ink inlets 52. As shown in FIG. 13, at least part of the ink bottle 62 is located inside of a locus LC drawn by the scanner unit 5 when the scanner unit 5 is rotated between the closed state and the open state at the first open position. The inside of the locus LC denotes an area placed between the scanner unit 5 in the open state and the housing 6.

Figure 14:
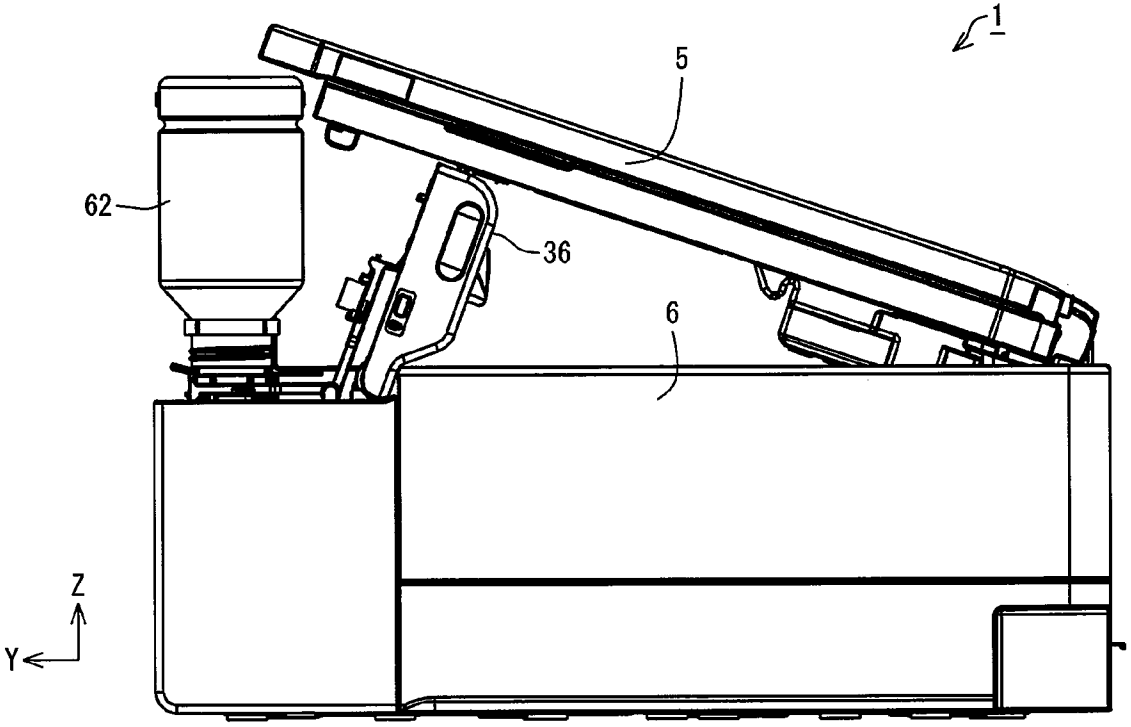
FIG. 14 is a side view illustrating the printer and the ink bottle according to the embodiment.

Even when the scanner unit 5 is rotated from the first open position to the second open position, as shown in FIG. 14, the scanner unit 5 and the self-supported ink bottle 62 do not interfere with each other. In other words, even when the scanner unit 5 is kept in the open state by the tank cover 36, the ink bottle 62 is maintained in the self-supported state relative to the tank unit 4. Even in this state, there is still a space between the scanner unit 5 and the ink bottle 62. For example, even when the scanner unit 5 is rotated in the closing direction from the first open position in the self-supported state of the ink bottle 62, the tank cover 36 stops the rotation of the scanner unit 5 before the scanner unit 5 collides with the ink bottle 62. This configuration ensures stable ink filling into the tank 10.

Figure 15:
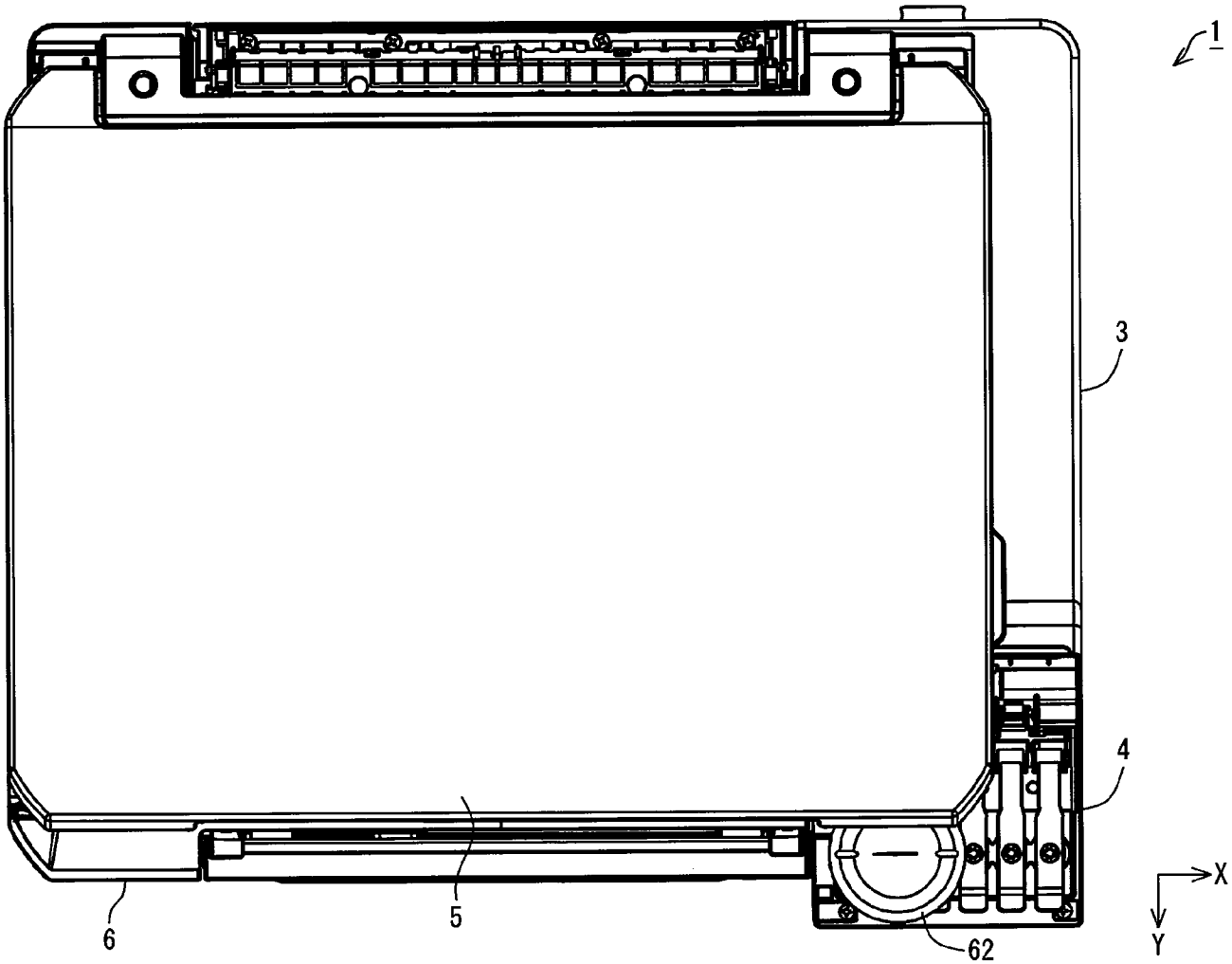
FIG. 15 is a plan view illustrating the printer and the ink bottle according to the embodiment.

In the plan view of the printer 1 in the −Z-axis direction, as shown in FIG. 15, the scanner unit 5 overlaps with part of the ink bottle 62. This configuration that causes the scanner unit 5 to overlap with part of the self-supported ink bottle 62 is likely to reduce the projected area of the printer 1. As a result, this is likely to downsize the printer 1. In the plan view of the printer 1 in the −Z-axis direction, a configuration that causes the scanner unit 5 to overlap with the entire ink bottle 62 may also be employed as the configuration of the printer 1. This configuration is more likely to downsize the printer 1. According to the embodiment, in the plan view of the printer 1 in the state that the ink bottle 62 is self-supported relative to the tank unit 4 in the use attitude, the employable configuration causes the scanner unit 5 as one example of the main body cover to overlap with at least part of the ink bottle 62. This configuration is likely to downsize the printer 1.

Figure 16:
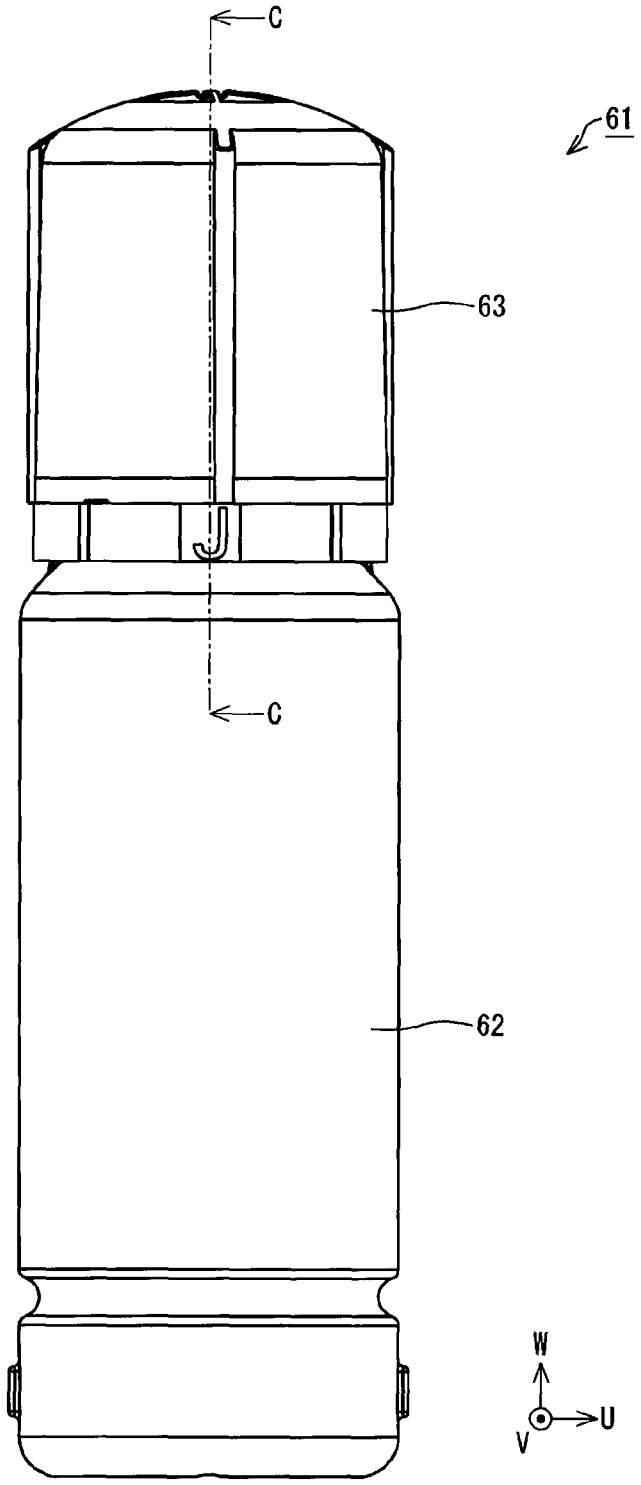
FIG. 16 is an appearance view illustrating a bottle set according to the embodiment.

According to this embodiment, a bottle set 61 shown in FIG. 16 may be used for filling ink into the tank 10. Ink that is to be supplied to the tank 10 described above is contained in the bottle set 61. The bottle set 61 includes the ink bottle 62 described above and a cover member 63. U, V and W axes orthogonal to one another are illustrated in FIG. 16. The U, V and W axes are used for illustration of the bottle set 61 and the components of the bottle set 62 independently of the use attitude of the printer 1 and the components of the printer 1. Accordingly, the U, V and W axes indicate the directions applied to the bottle set 61 and the components of the bottle set 61. The W axis is an axis along a direction in which the ink bottle 62 and the cover member 63 are arrayed. The U axis is an axis perpendicular to the W axis. The V axis is an axis perpendicular to both the W axis and the U axis. With respect to each of the U axis, the V axis and the W axis, the direction of an arrow indicates a +(positive) direction, and an opposite direction to the direction of the arrow indicates a −(negative) direction. A direction from the ink bottle 62 toward the cover member 63 is a W-axis direction.

Figure 17:
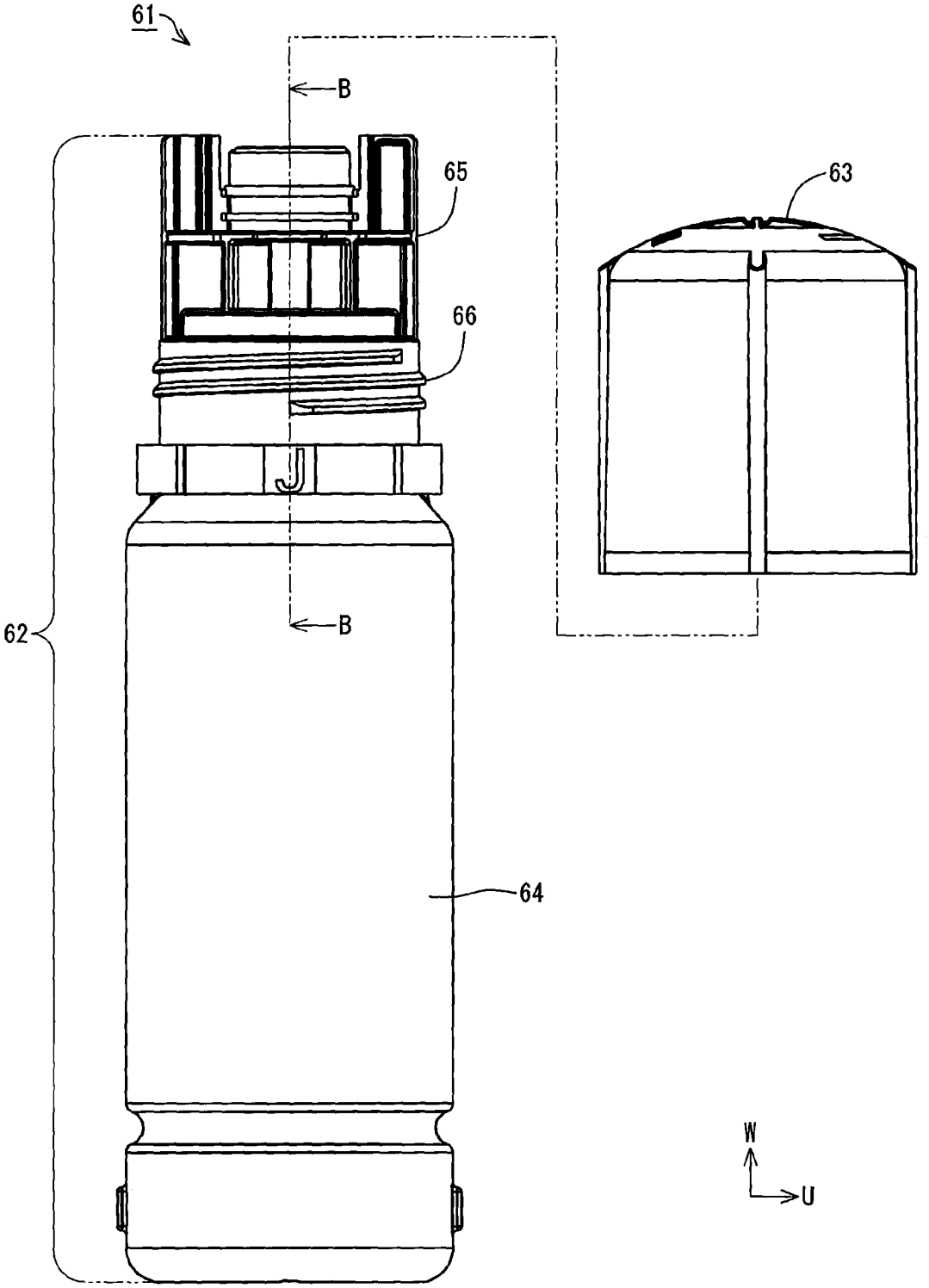
FIG. 17 is an exploded view illustrating the bottle set according to the embodiment.

As shown in FIG. 17, the cover member 63 is configured to be detachably mounted to the ink bottle 62. The ink bottle 62 includes an ink container portion 64 and an ink outlet forming portion 65 that is one example of a delivery portion. The ink container portion 64 is a portion that causes ink to be contained therein. The ink outlet forming portion 65 is a portion that causes the ink contained in the ink container portion 64 to be delivered to outside of the ink bottle 62.

The cover member 63 is configured to cover part of the ink outlet forming portion 65 when the cover member 63 is mounted to the ink bottle 62. An ink outlet 95 described later is formed in the ink outlet forming portion 65. The ink contained in the ink container portion 64 is flowed out of the ink bottle 62 through the ink outlet 95 provided in the ink outlet forming portion 65. The cover member 63 is configured to cover the ink outlet 95 provided in the ink outlet forming portion 65 when the cover member 63 is mounted to the ink bottle 62. With respect to the bottle set 61, the state that the cover member 63 is mounted to the ink bottle 62 (shown in FIG. 16) is called covered state. The covered state denotes the state that the cover member 63 is mounted to the ink bottle 62 such as to cover the ink outlet 95.

As shown in FIG. 17, the cover member 63 is configured to be engaged with the ink outlet forming portion 65 via threads 66 formed in the ink outlet forming portion 65. In other words, according to this embodiment, the cover member 63 is configured to be mounted to the ink bottle 62 by engagement via the threads 66. The cover member 63 includes threads (not shown) that are formed to be engageable with the threads 66 formed in the ink outlet forming portion 65. The cover member 63 is mounted to the ink bottle 62 by engagement of the threads provided in the cover member 63 with the threads 66 provided in the ink outlet forming portion 65.

Figure 18:
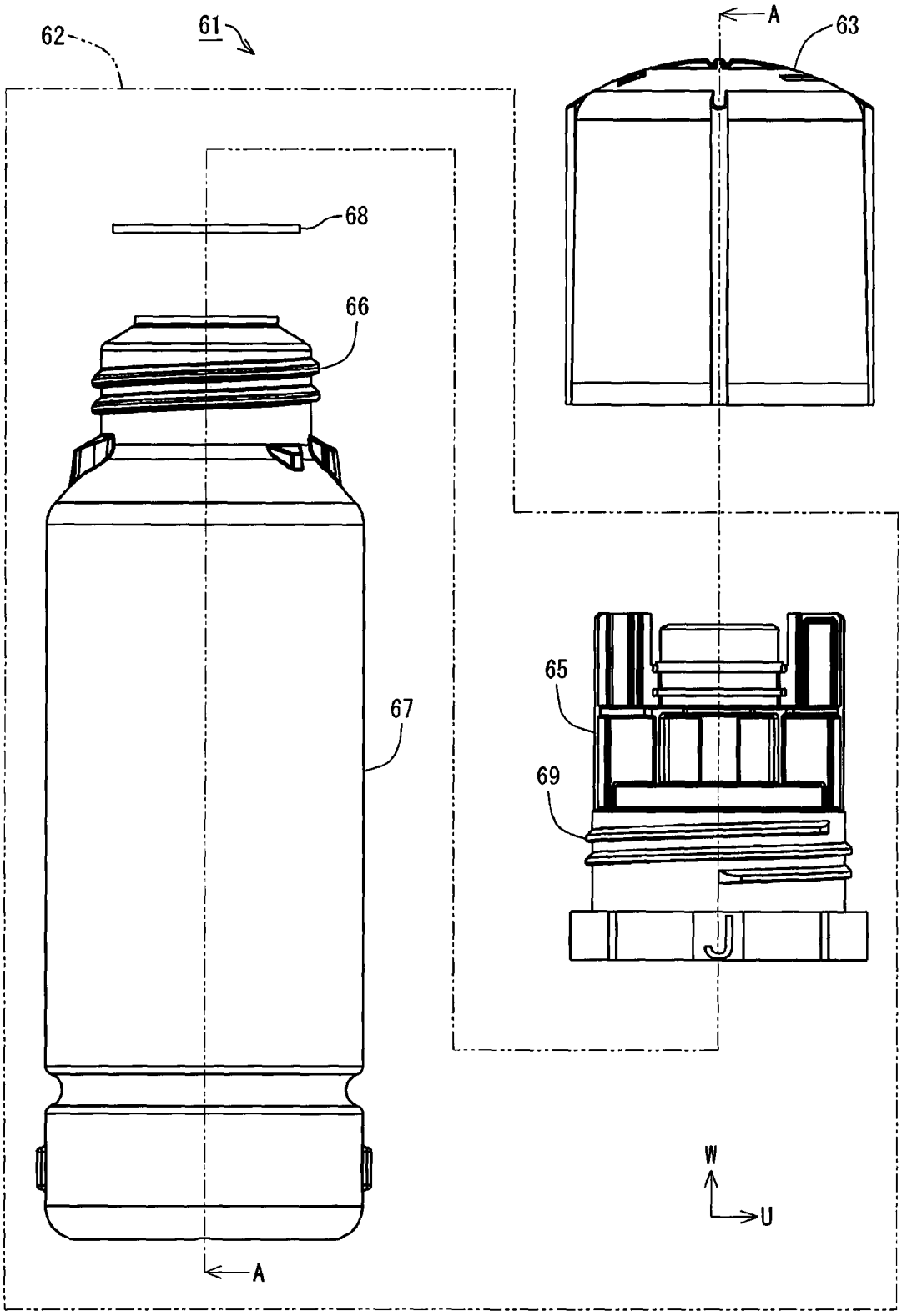
FIG. 18 is an exploded view illustrating the bottle set according to the embodiment.
Figure 19:
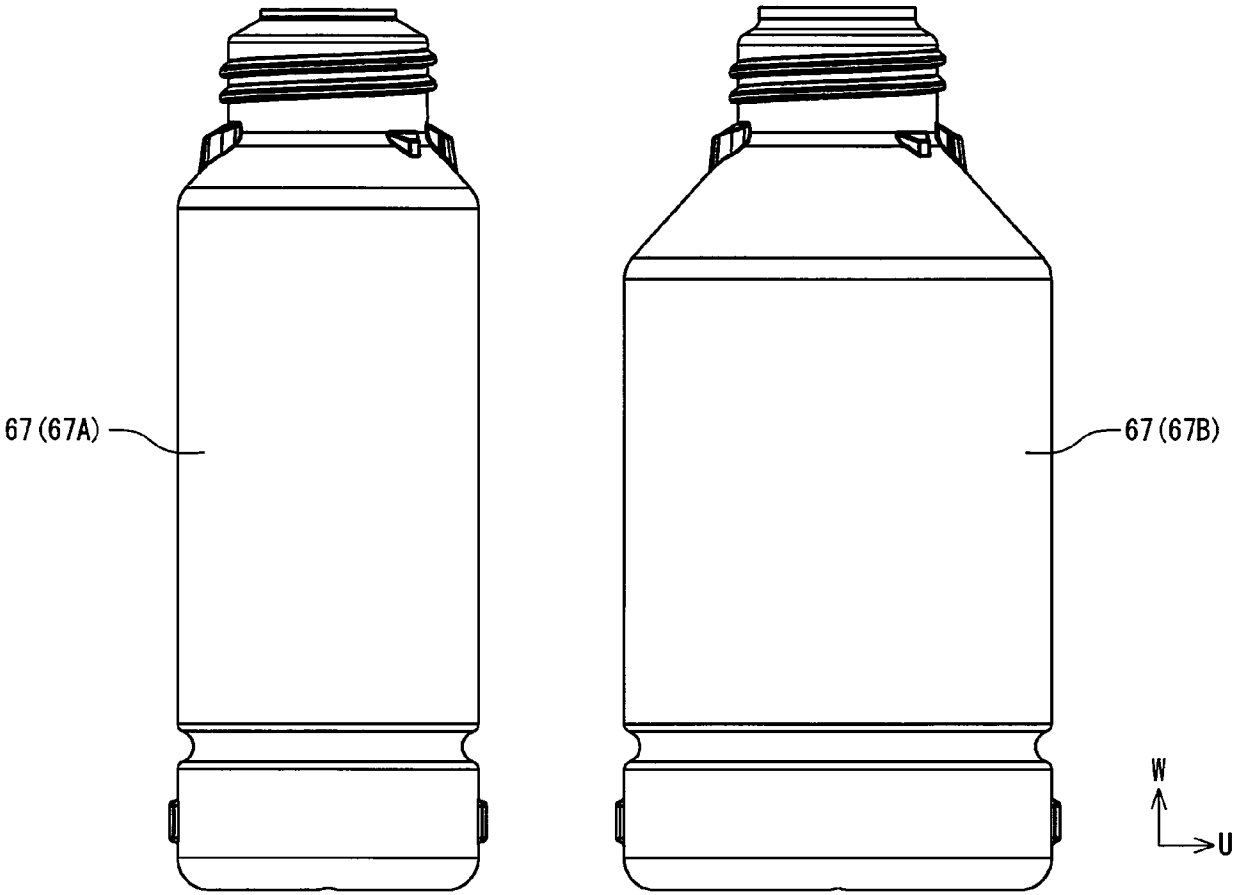
FIG. 19 is an appearance view illustrating a container main body according to the embodiment.

According to this embodiment, as shown in FIG. 18, the ink bottle 62 includes a container main body 67 that is one example of a container portion, a seal member 68 and the ink outlet forming portion 65. This embodiment provides two different types of bottle sets 61 having different capacities of inks that are contained in the respective ink bottles 62. The two different types of bottle sets 61 have different sizes of container main bodies 67 as shown in FIG. 19 but otherwise have similar configurations. In the description below, when the two different container main bodies 67 are to be distinguished from each other, the two container main bodies 67 are respectively expressed as container main body 67A and container main body 67B. The capacity of the container main body 67B is larger than the capacity of the container main body 67A.

The container main body 67A and the container main body 67B have different capacities of inks that are contained therein but otherwise have similar configurations. The following describes the bottle set 61 including the container main body 67A as an example. The configuration of the container main body 67B is shown using the like reference signs to those used for the configuration of the container main body 67A, and its detailed description is omitted.

The above requirements shown in FIG. 13, FIG. 14, FIG. 15 and FIG. 16 are applied to both the container main body 67A and the container main body 67B. More specifically, as shown in FIG. 13, the requirement that there is a space between the scanner unit 5 and the ink bottle 62 in the state that the ink bottle 62 is self-supported in the printer 1 is applied to both the container main body 67A and the container main body 67B. As shown in FIG. 14, the requirement that the self-supported state of the ink bottle 62 relative to the tank unit 4 is maintained even when the scanner unit 5 is kept in the open state by the tank cover 36 is applied to both the container main body 67A and the container main body 67B. As shown in FIG. 15, the requirement that the scanner unit 5 overlaps with part of the ink bottle 62 is applied to both the container main body 67A and the container main body 67B.

As shown in FIG. 18, the ink outlet forming portion 65 is provided at one end of the container main body 67. According to this embodiment, assembling the container main body 67 with the ink outlet forming portion 65 forms an outer shell of the ink bottle 62. The seal member 68 is placed between the container main body 67 and the ink outlet forming portion 65. The container main body 67 and the ink outlet forming portion 65 are assembled across the seal member 68 by engagement via threads 66 to be integrated as one ink bottle 62. The ink outlet forming portion 65 includes threads (described later) that are formed to be engageable with the threads 66 of the container main body 67. Engagement of the threads of the ink outlet forming portion 65 with the threads 66 of the container main body 67 assembles and integrates the container main body 67 and the ink outlet forming portion 65 as one ink bottle 62.

Figure 20:
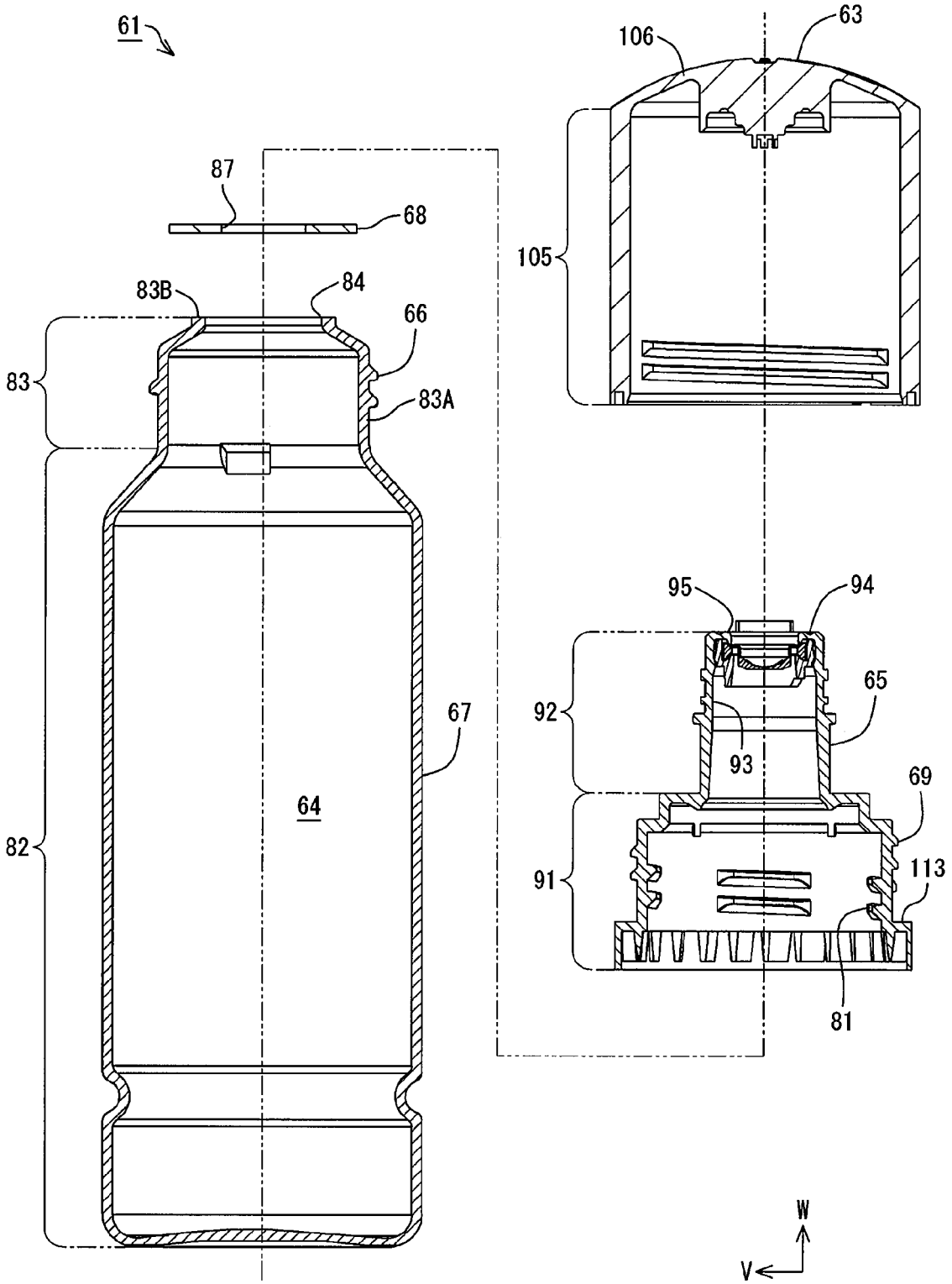
FIG. 20 is a sectional view taken on a line A-A in FIG. 18.

As shown in FIG. 20 that is a sectional view taken on a line A-A in FIG. 18, the container main body 67 is configured as a container to contain ink therein. The container main body 67 and the ink outlet forming portion 65 are configured as separate bodies. Threads 81 are formed in the ink outlet forming portion 65. The container main body 67 and the ink outlet forming portion 65 are configured to be engageable with each other via the threads 66 formed in the container main body 67 and the threads 81 formed in the ink outlet forming portion 65. The container main body 67 and the ink outlet forming portion 65 are also configured to be mountable to and demountable from each other. The ink outlet forming portion 65 is detached from the container main body 67 by twisting (turning) the ink outlet forming portion 65 relative to the container main body 67.

Ink is contained in the container main body 67. According to this embodiment, the container main body 67 is made of a material having elasticity. The container main body 67 includes a tubular body portion 82, a tubular engagement portion 83 and an opening portion 84 that is one example of an opening. The material usable for the container main body 67 may be, for example, a resin material such as polyethylene terephthalate (PET), nylon, polyethylene, polypropylene or polystyrene or a metal material such as iron material or aluminum. The body portion 82 and the engagement portion 83 are formed integrally with each other. The body portion 82 is located on an opposite side of the engagement portion 83 that is opposite to the seal member 68-side. The engagement portion 83 is located on the seal member 68-side of the body portion 82. The engagement portion 83 is formed to be smaller in diameter than the body portion 82. Threads 66 are formed in a side portion 83A outside of the engagement portion 83. The threads 66 are provided to be protruded from the side portion 83A. The opening portion 84 is arranged to communicate with the ink container portion 64 inside of the container main body 67 and is formed at an opposite end 83B of the engagement portion 83 that is opposite to the body portion 82-side. The opening portion 84 is open toward the seal member 68-side.

The container main body 67 of the above configuration is formed as a hollow container including the body portion 82 and the engagement portion 83. The ink bottle 62 is configured to contain an amount of ink specified by the total volume of the body portion 82 and the engagement portion 83. In the ink bottle 62, the total inner space defined by the body portion 82 and the engagement portion 83 of the container main body 67 forms the ink container portion 64.

An opening portion 87 is formed in the seal member 68. The ink contained in the container main body 67 is flowed through the opening 87 of the seal member 68 and is flowed out to the ink outlet forming portion 65. In this configuration, the seal member 68 is placed between the end 83B of the container main body 67 and the ink outlet forming portion 65. This configuration suppresses leakage of ink from between the container main body 67 and the ink outlet forming portion 65. The material usable for the seal member 68 may be any of various materials, for example, a foam material of polyethylene or an elastic material such as a rubber or an elastomer.

As shown in FIG. 20, the ink outlet forming portion 65 includes a joint portion 91 and a cylindrical portion 92. The joint portion 91 and the cylindrical portion 92 are formed integrally with each other. The material usable for the ink outlet forming portion 65 may be a resin material such as polyethylene terephthalate (PET), nylon, polyethylene, polypropylene or polystyrene. The joint portion 91 has a cylindrical outer shape. The threads 81 are formed on an inner side face of the joint portion 91. The joint portion 91 is a part that is engaged with the container main body 67 by means of the threads 81. The joint portion 91 is configured to have a larger inner diameter than the outer diameter of the engagement portion 83 of the container main body 67. The threads 81 are formed on the inner side of the joint portion 91, and the threads 66 are formed on the outer side of the engagement portion 83 of the container main body 67. The ink outlet forming portion 65 and the container main body 67 are engaged with each other by engagement of the threads 81 formed on the inner side of the joint portion 91 with the threads 66 formed on the outer side of the engagement portion 83. In the state that the ink outlet forming portion 65 is engaged with the container main body 67, the joint portion 91 of the ink outlet forming portion 65 covers the engagement portion 83 of the container main body 67. The joint portion 91 is one example of an engagement portion that is to be engaged with the container main body 67 when the joint portion 91 covers the opening portion 84 of the container main body 67.

Figure 21:
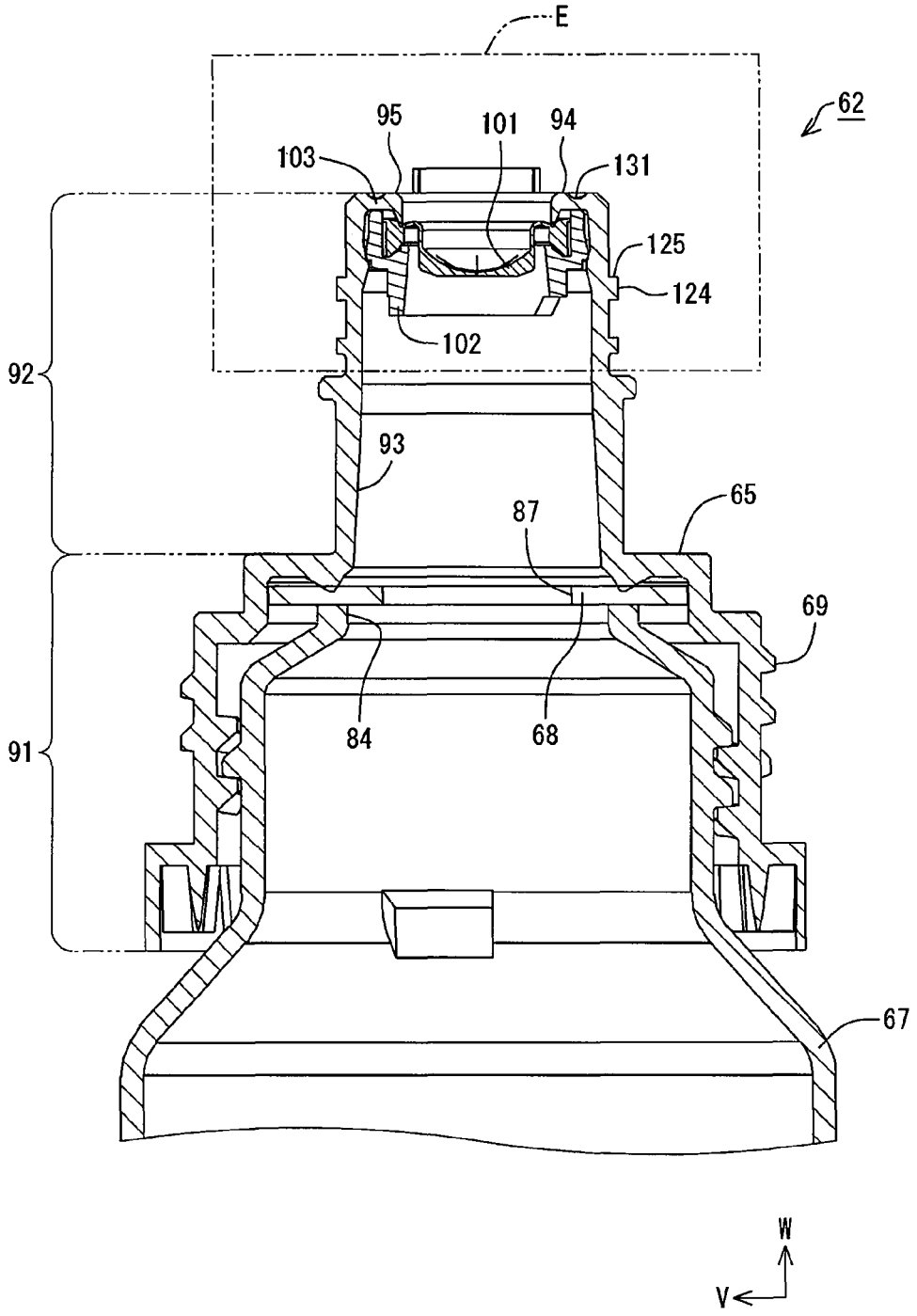
FIG. 21 is a sectional view taken on a line B-B in FIG. 17.

As shown in FIG. 21 that is a sectional view taken on a line B-B in FIG. 17, the cylindrical portion 92 is protruded from the joint portion 91 to an opposite side that is opposite to the container main body 67-side. The cylindrical portion 92 is in a cylindrical (tubular) form. A delivery passage 93 is formed inside of the cylindrical portion 92. The delivery passage 93 is provided in a region overlapping with the region of the opening portion 84 in the plan view of the ink outlet forming portion 65 in a direction from the opening portion 84-side toward the cylindrical portion 92-side. The delivery passage 93 is a hollow region of the cylindrical portion 92 that overlaps with the region of the opening portion 84 in the plan view.

An ink outlet 95 is formed on an end face 94 of the cylindrical portion 92 that is opposite to the joint portion 91-side, such as to cause the ink from the container main body 67 to flow out. The ink outlet 95 is one example of an outlet. The end face 94 is arranged to face to an opposite side that is opposite to the container main body 67-side. The ink outlet 95 is open toward an opposite side of the cylindrical portion 92 that is opposite to the joint portion 91-side. The ink outlet 95 is open in the end face 94. Accordingly, the end face 94 is arranged to surround the ink outlet 95. The ink outlet 95 is located at a terminal end of the delivery passage 93. In other words, the delivery passage 93 is arranged to introduce the ink contained in the container main body 67 to the ink outlet 95. A direction from the opening portion 84 of the container main body 67 toward the ink outlet 95 of the ink outlet forming portion 65 is the W-axis direction that corresponds to a first direction.

The ink contained in the container main body 67 is flowed through the delivery passage 93 of the cylindrical portion 92 and is flowed out from the ink outlet 95. As a result, the ink contained in the container main body 67 may be flowed from the opening portion 84 through the delivery passage 93 and the ink outlet 95 to be out of the container main body 67. When the user intends to fill the ink contained in the ink bottle 62 into the tank 10, the user inserts the ink outlet 95 into the ink filling portion 56 of the tank 10. The user then injects the ink contained in the container main body 67 through the ink filling portion 56 into the tank 10. When the user intends to fill the ink contained in the ink bottle 62 into the tank 10, the user detaches the cover member 63 (shown in FIG. 18) from the ink bottle 62 and then performs the ink filling operation.

As shown in FIG. 21, a valve 101 and a holder 102 are provided in the ink outlet forming portion 65. The valve 101 is configured to seal the ink outlet 95 in an openable and closable manner. In the ink outlet forming portion 65, the valve 101 is provided inside of the delivery passage 93 to seal the ink outlet 95 such as to open and close the ink outlet 95 relative to the delivery passage 93. In other words, the valve 101 is configured to block the delivery passage 93 in an openable and closable manner. The valve 101 is made of an elastic material such as a rubber or an elastomer and is configured to seal the ink outlet 95 under no application of an external force. When the connection tube 49 of the tank 10 is inserted into the ink outlet 95 to apply a pressing force to the valve 101, the valve 101 is opened. When the connection tube 49 is pulled out from the ink outlet 95 to release the external force applied to the valve 101, the valve 101 is closed.

Figure 22:
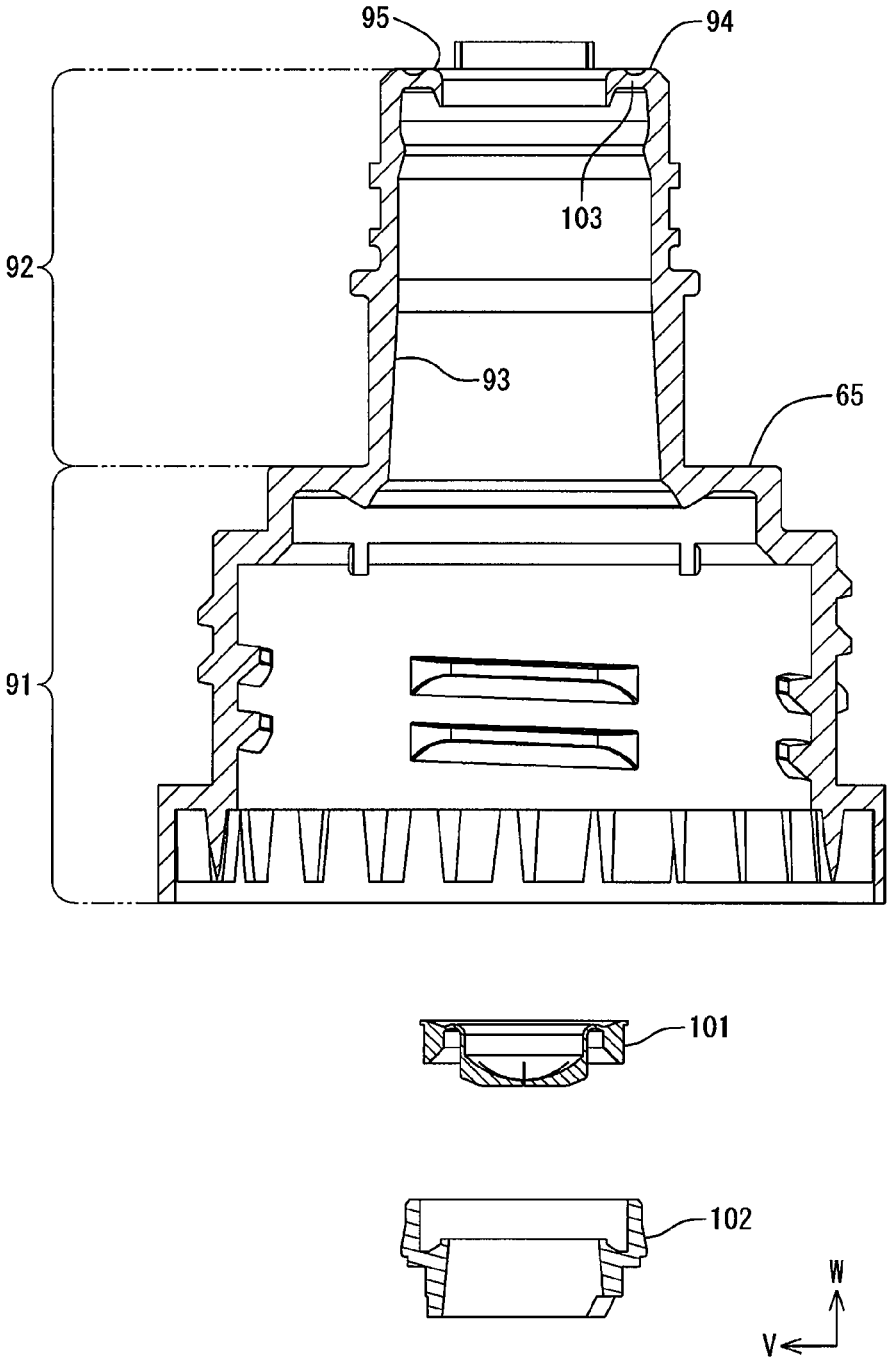
FIG. 22 is an exploded sectional view illustrating an ink outlet forming portion, a valve and a holder according to the embodiment.

As shown in FIG. 22, the valve 101 and the holder 102 are configured to be separable from the ink outlet forming portion 65. In other words, the ink outlet forming portion 65, the valve 101 and the holder 102 are configured as separate bodies. The valve 101 is inserted from the joint portion 91-side of the ink outlet forming portion 65 into the delivery passage 93. The holder 102 is a member configured to suppress dropout of the valve 101 and is provided on the joint portion 91-side of the valve 101 as shown in FIG. 21. The holder 102 is also inserted from the joint portion 91-side of the ink outlet forming portion 65 into the delivery passage 93. The valve 101 is placed between the holder 102 and a flange portion 103 of the ink outlet forming portion 65. This assembles and integrates the ink outlet forming portion 65, the valve 101 and the holder 102 with one another. The flange portion 103 is a wall that is extended inward in the radial direction of the cylindrical portion 92 from an inner side face of the cylindrical portion 92. An opposite side face of the flange portion 103 that is opposite to the joint portion 91-side corresponds to the end face 94.

Figure 23:
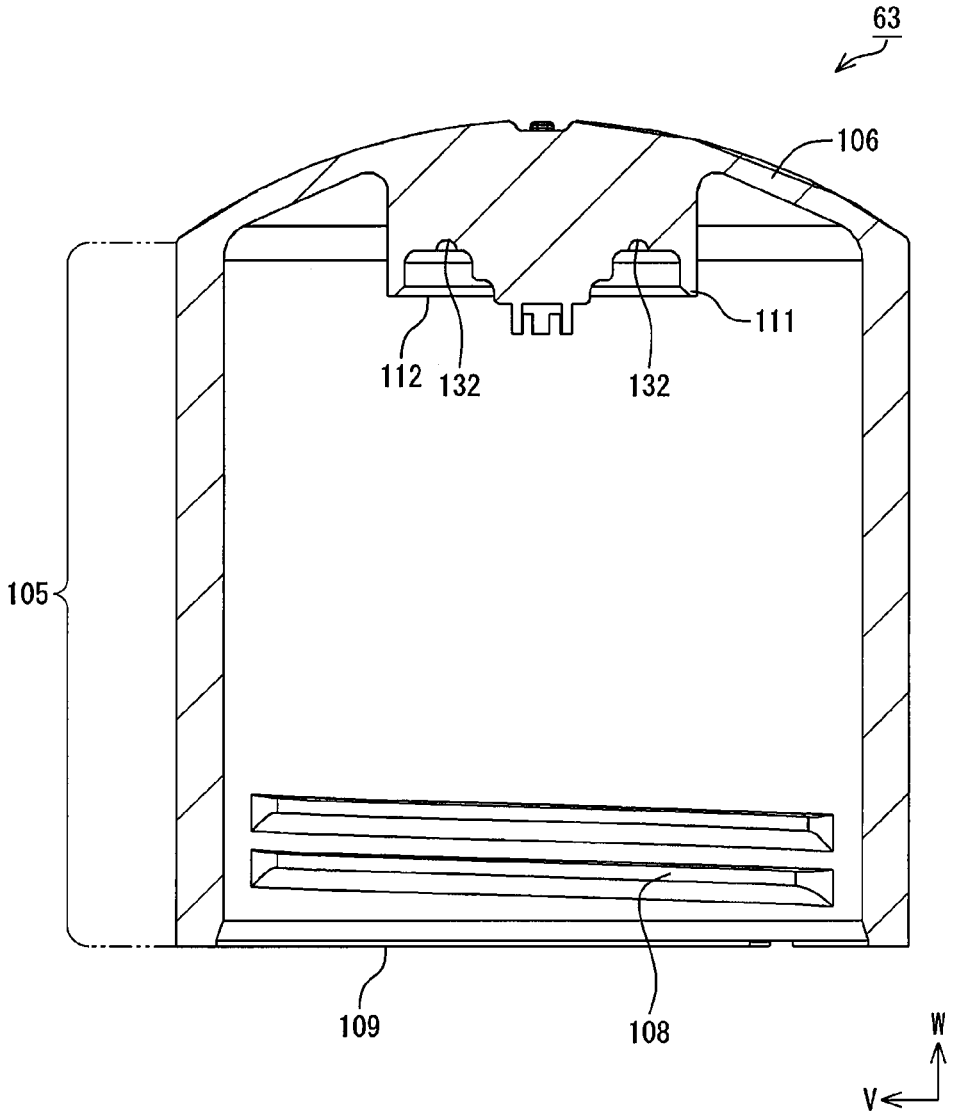
FIG. 23 is a diagram illustrating close-up of a cover member shown in FIG. 20.

The cover member 63 is made of a material having elasticity and is configured to include a body portion 105 in a tubular shape and a top board portion 106 as shown in FIG. 23 that is a diagram illustrating close-up of the cover member 63 shown in FIG. 20. The material usable for the cover member 63 may be a resin material such as polyethylene terephthalate (PET), nylon, polyethylene, polypropylene or polystyrene. According to this embodiment, the cover member 63 is formed by injection molding of the resin material.

The body portion 105 and the top board portion 106 are formed integrally with each other. As shown in FIG. 20, in the bottle set 61, the body portion 105 of the cover member 63 is located on the ink outlet forming portion 65-side. As shown in FIG. 23, the top board portion 106 is located at one end of the body portion 105. According to this embodiment, the top board portion 106 is located on an opposite side of the body portion 105 that is opposite to the ink outlet forming portion 65-side. The body portion 105 in the tubular shape is protruded from the top board portion 106 toward the ink container portion 64 (shown in FIG. 20). The top board portion 106 is configured to close one end of the body portion 105 in the tubular shape. In other words, a member provided to close one end of the body portion 105 in the tubular shape is the top board portion 106. An opening may be formed in the top board portion 106. Even in such a configuration with an opening, since the top board portion 106 is extended in a direction intersecting with the body portion 105 in the tubular shape, it is regarded that the top board portion 106 closes one end of the body portion 105 in the tubular shape.

In the illustrated example of FIG. 23, the top board portion 106 is formed in a curved plate-like shape. The top board portion 106 may, however, be configured by any of various plates such as a flat plate, a plate with concaves and convexes and a corrugated plate. The top board portion 106 is not limited to the plate-like shape but may be in any of various shapes such as a spherical shape, a columnar shape and a cone shape. A member in any shape configured to close one end of the body portion 105 in the tubular shape corresponds to the top board portion 106.

Threads 108 are provided in an inner side face of the body portion 105. The body portion 105 is a portion that is to be engaged with the ink outlet forming portion 65 (shown in FIG. 21) by means of the threads 108. The threads 108 are provided at a position nearer to an end 109 of the body portion 105 than the top board portion 106. The threads 108 are formed on an inner side of the body portion 105, whereas the threads 69 are formed on an outer side of the joint portion 91 of the ink outlet forming portion 65. The cover member 63 and the ink outlet forming portion 65 are engaged with each other by engagement of the threads 108 formed on the inner side of the body portion 105 with the threads 69 formed on the outer side of the joint portion 91 of the ink outlet forming portion 65. In the state that the cover member 63 is engaged with the ink outlet forming portion 65, the cover member 63 covers the cylindrical portion 92 of the ink outlet forming portion 65. In other words, the covered state denotes the state that the cover member 63 is engaged with the ink outlet forming portion 65.

As shown in FIG. 23, a plug element 111 is provided in the top board portion 106 of the cover member 63. The plug element 111 is provided on the ink outlet forming portion 65-side (shown in FIG. 20) of the top board portion 106, i.e., on the end 109-side of the top board portion 106. The plug element 111 is protruded from the top board portion 106 toward the end 109-side. The plug element 111 is provided in a center region of the top board portion 106. The plug element 111 is provided at a position that faces (opposed to) the ink outlet 95 of the cylindrical portion 92 when the cover member 63 is mounted to the ink bottle 62. The plug element 111 has a tubular outer shape.

Figure 24:
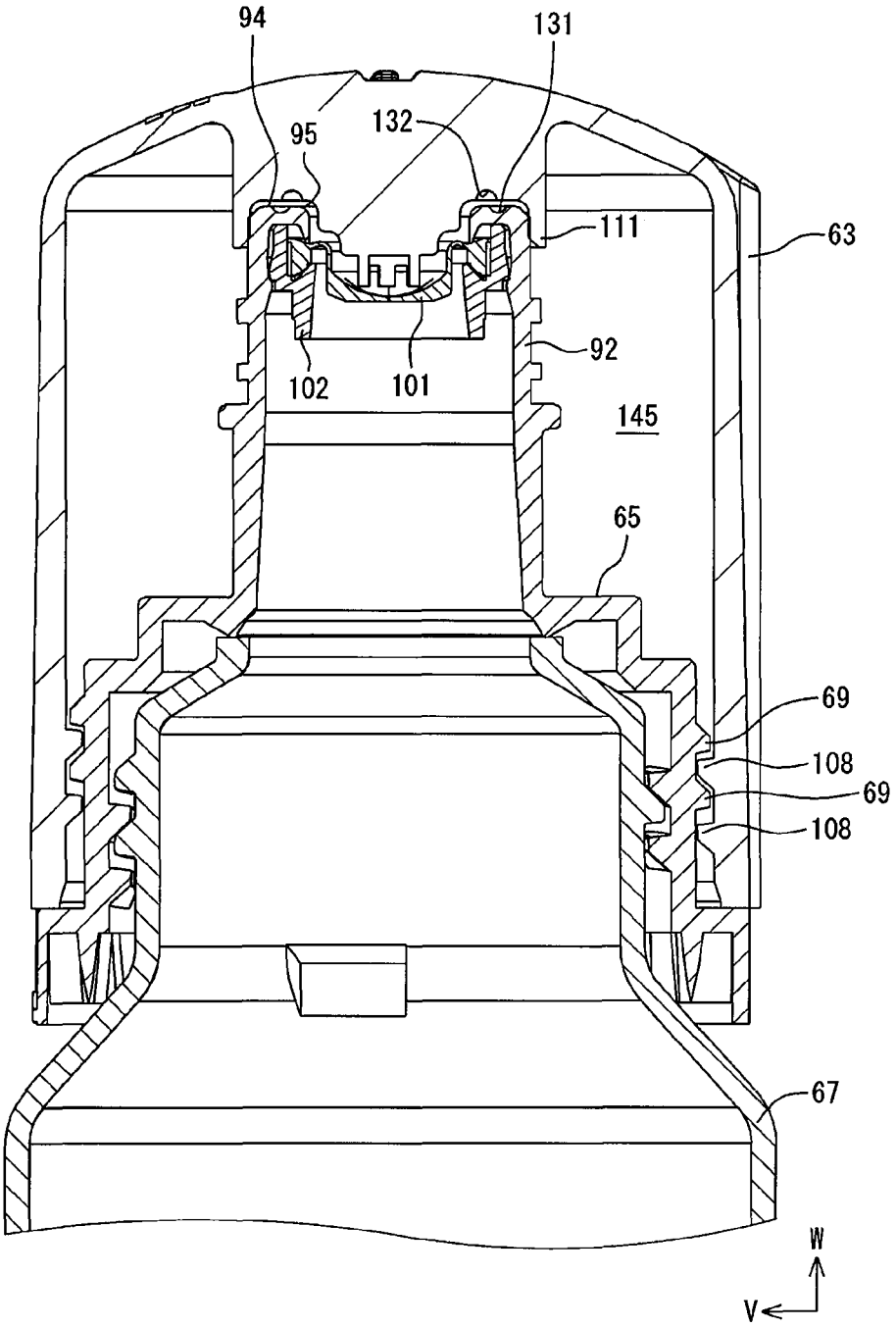
FIG. 24 is a sectional view taken on a line C-C in FIG. 16.

According to this embodiment, as shown in FIG. 23, the distance (depth) from the end 109 of the body portion 105 to an end 112 of the plug element 111 is shorter (shallower) than the distance from an end 113 of the joint portion 91 of the ink outlet forming portion 65 (shown in FIG. 20) to the end face 94 of the cylindrical portion 92. As shown in FIG. 24 that is a sectional view taken on a line C-C in FIG. 16, when the cover member 63 is mounted to the ink bottle 62, the plug element 111 covers the end face 94 from outside of the cylindrical portion 92. The inner diameter of the plug element 111 in the tubular shape is slightly smaller than the outer diameter of an end face 94-side end of the cylindrical portion 92. This configuration causes the ink outlet 95 of the ink outlet forming portion 65 to be sealed by the plug element 111 when the cover member 63 is mounted to the ink outlet forming portion 65. More specifically, in the state that the cover member 63 is mounted to the ink bottle 62, the plug element 111 comes into contact with the cylindrical portion 92 to seal the ink outlet 95. The cover member 63 is configured not to be in contact with an inner diameter portion of the ink outlet 95 in this state. The cover member 63 is also configured not to be in contact with the valve 101 in this state.

This configuration enables the ink outlet 95 to be sealed. For example, when the ink contained in the container main body 67 is not fully filled into the tank 10 but remains in the container main body 67, this configuration enables the ink to be stored in the ink bottle 62 in the state that the ink outlet 95 is closed by the cover member 63. This configuration accordingly enables ink to be stored with the enhanced airtightness in the container main body 67 after unsealing. As a result, this configuration suppresses vaporization of the liquid component of ink contained in the ink bottle 62 and degradation of the ink.

Figure 25:
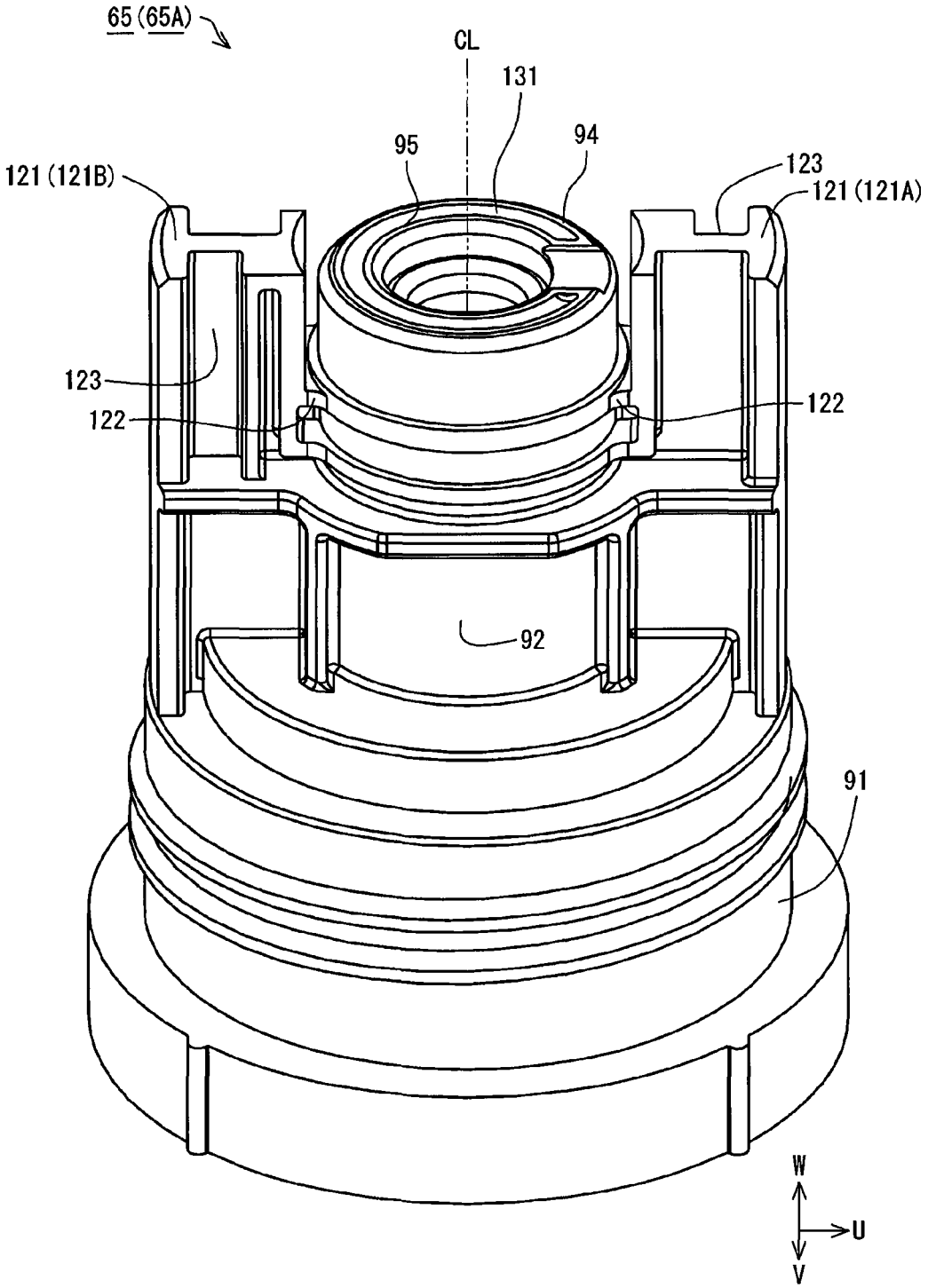
FIG. 25 is a perspective view illustrating the ink outlet forming portion according to the embodiment.

A plurality of (two according to the embodiment) positioning elements 121 are provided in the ink outlet forming portion 65 as shown in FIG. 25. In the description below, when the two positioning elements 121 are to be distinguished from each other, the two positioning elements 121 are respectively expressed as positioning element 121A and positioning element 121B. The positioning element 121A and the positioning element 121B are located outside of the cylindrical portion 92 in the plan view of the ink outlet forming portion 65 in a direction from the cylindrical portion 92 toward the joint portion 91.

The positioning element 121A and the positioning element 121B are provided in the joint portion 91 of the ink outlet forming portion 65. The positioning element 121A and the positioning element 121B are provided at positions opposed to each other across the cylindrical portion 92 in the plan view of the ink outlet forming portion 65 in the direction from the cylindrical portion 92 toward the joint portion 91. The positioning element 121A and the positioning element 121B are protruded from the joint portion 91 toward the end face 94-side. Each of the positioning element 121A and the positioning element 121B is joined with the cylindrical portion 92 via a coupling element 122.

The positioning element 121A and the positioning element 121B respectively includes recesses 123. The recesses 123 are configured to be engaged with the first projections 59 formed in each of the slot portions 54 of the adapter 38 of the tank unit 4 (shown in FIG. 10). The first projections 59 of the slot portion 54 are fit in the recesses 123 of the positioning elements 121, so that the ink outlet forming portion 65 is inserted in the slot portion 54. As described above, the first projections 59 are arranged symmetrically with respect to the center point of the connection tube 49 in each of the slot portions 54. The positioning element 121A and the positioning element 121B are thus arranged symmetrically with respect to a center axis CL of the ink outlet 95 in the plan view of the ink outlet forming portion 65 in the direction from the cylindrical portion 92 toward the joint portion 91. The positioning element 121A and the positioning element 121B are formed at equal intervals of a phase angle of 180 degrees with respect to the center axis CL of the ink outlet 95. The center axis CL is an axis that perpendicularly passes through the center of a region surrounded by the periphery of the ink outlet 95 in the plan view of the ink outlet forming portion 65 in the direction from the cylindrical portion 92 toward the joint portion 91.

A recess 131 is formed in an outer side portion of the ink outlet 95 at the end face 94 of the cylindrical portion 92. As shown in FIG. 21, the recess 131 is formed to be recessed toward the container main body 67-side. The recess 131 is thus likely to block the ink dripping from the ink outlet 95 onto the end face 94. This configuration is thus likely to prevent the ink dripping from the ink outlet 95 onto the end face 94 from being diffused toward the container main body 67-side. The ink bottle 62 of this configuration accordingly has the improved convenience.

According to this embodiment, as shown in FIG. 23, a recess 132 is formed in the cover member 63. As shown in FIG. 24, the recess 132 is formed to be recessed in an opposite direction that is opposite to the container main body 67-side, i.e., to be recessed in the W-axis direction. The recess 132 is formed in a ring shape to surround the ink outlet 95. Additionally, the recess 132 is formed on an inner side of the recess 131. The ink dripping from the ink outlet 95 onto the end face 94 is thus likely to be blocked by the recess 132 prior to the recess 131. This configuration is more likely to prevent the ink dripping from the ink outlet 95 onto the end face 94 from being diffused toward the container main body 67-side. The ink bottle 62 of this configuration accordingly has the more improved convenience. The recess 132 is not limited to the fully ring-shaped configuration but may be formed only partly in a partial ring-shaped configuration. Forming the recess 132 only partly still provides the effect of blocking ink.

Figure 26:
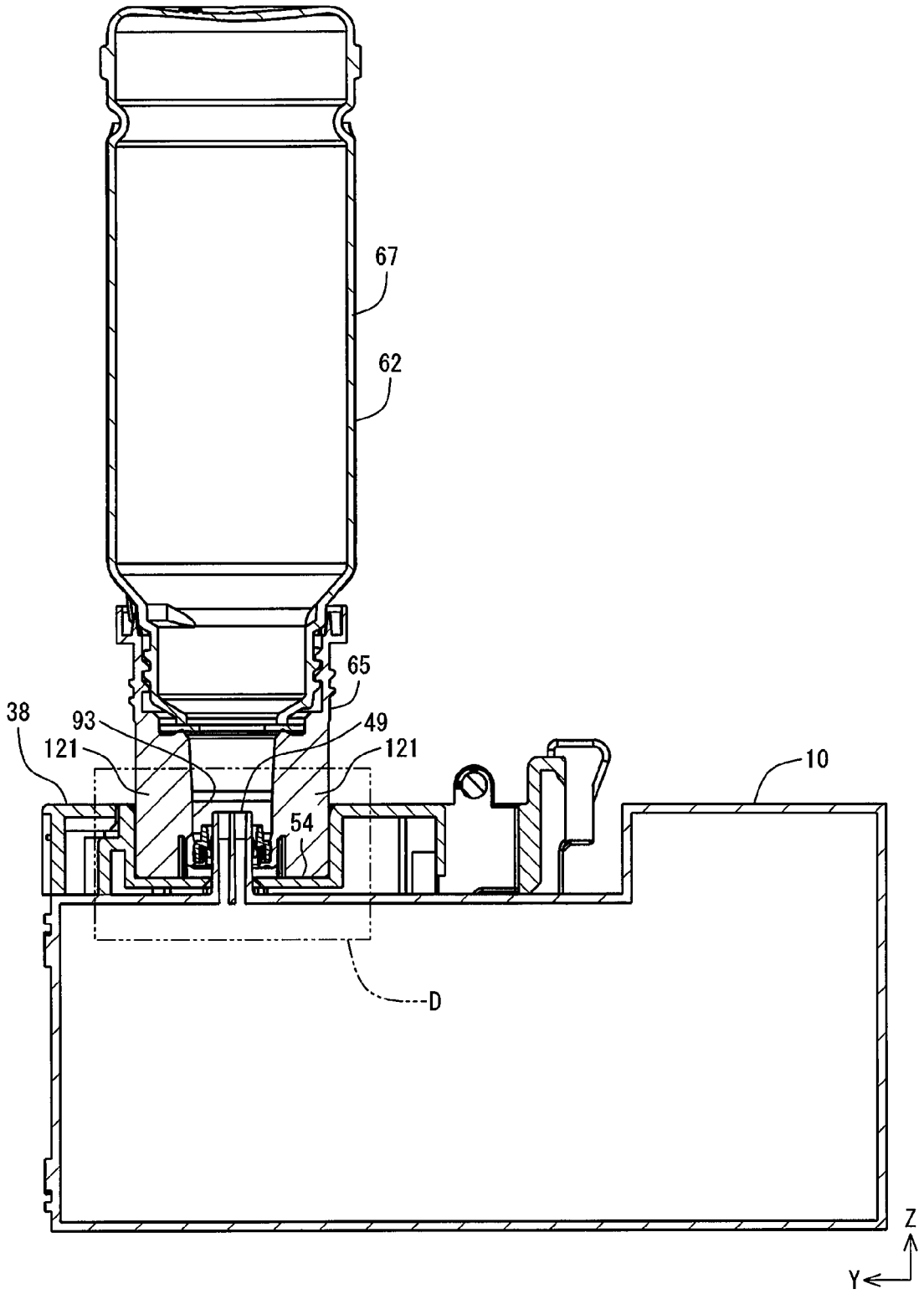
FIG. 26 is a sectional view illustrating the ink bottle and the tank unit according to the embodiment.
Figure 27:
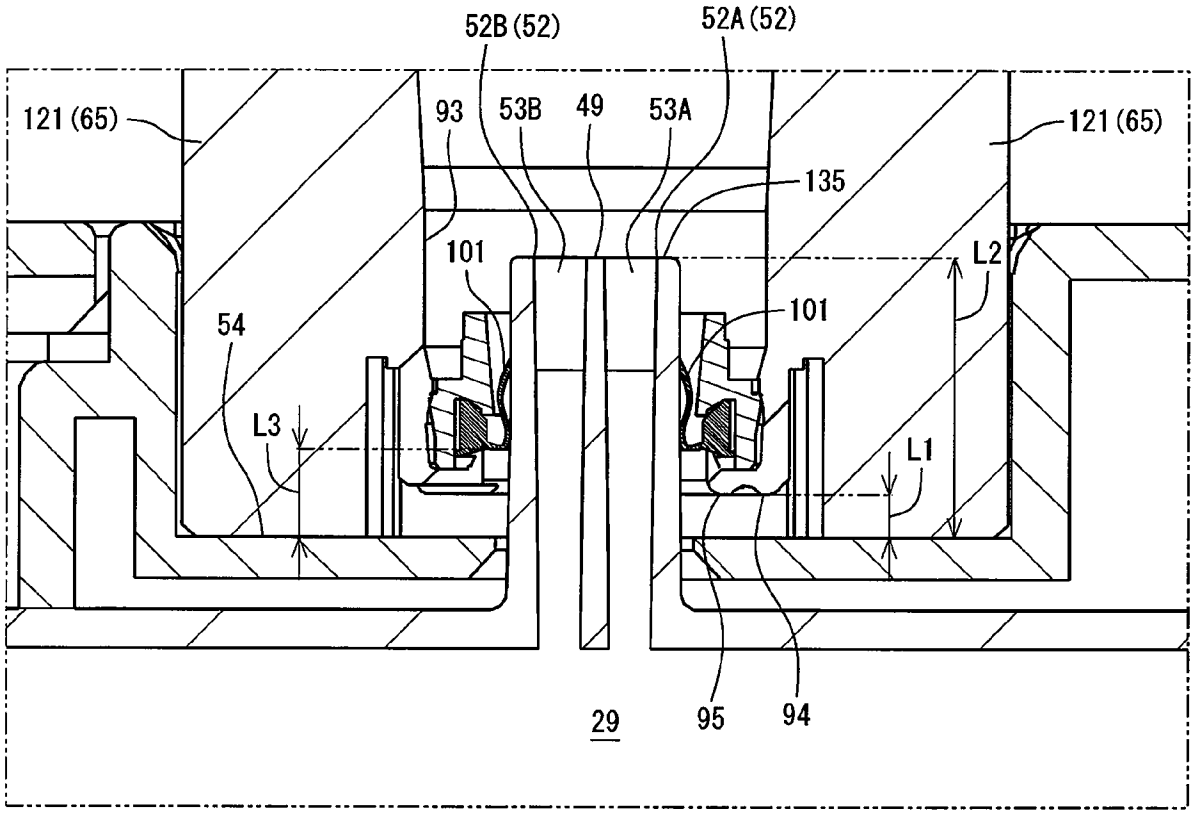
FIG. 27 is an enlarged view illustrating a region D shown in FIG. 26.

When the first projections 59 of the slot portion 54 in the adapter 38 of the tank unit 4 (shown in FIG. 10) are fit in the recesses 123 of the positioning elements 121 shown in FIG. 25, the ink outlet forming portion 65 of the ink bottle 62 is inserted into the ink filling portion 56 as shown in FIG. 11. In the ink outlet forming portion 65, the cylindrical portion 92 has a smaller dimension in the radial direction than the joint portion 91 (as shown in FIG. 25). This configuration causes the cylindrical portion 92 of the ink outlet forming portion 65 to avoid the cover member 39 that covers the adjacent ink filling portion 56 and enables the ink outlet forming portion 65 to be inserted into the ink filling portion 56. In this state, the connection tube 49 of the tank 10 is inserted into the delivery passage 93 of the ink outlet forming portion 65 as shown in the sectional view of FIG. 26. FIG. 26 illustrates a section of the tank 10, the adapter 38 and the ink bottle 62 shown in FIG. 11, taken along a YZ plane. In this state, the valve 101 is opened by the connection tube 49 as shown in FIG. 27 that is an enlarged view of a region D shown in FIG. 26.

In the state that the positioning elements 121 of the ink outlet forming portion 65 hit against the bottom of the slot portion 54, a distance L1 from the bottom of the slot portion 54 to the end face 94 and a distance L2 from the bottom of the slot portion 54 to a leading end 135 of the connection tube 49 satisfy the relationship of Expression (2) given below:

$$L1<L2 \quad (2)$$

According to the relationship of Expression (2) given above, the leading end 135 of the connection tube 49 moves through the ink outlet 95 into the delivery passage 93 in the state that the ink outlet forming portion 65 hits against the bottom of the slot portion 54. Accordingly, the connection tube 49 is connected with the ink outlet 95 in the state that the ink outlet forming portion 65 hits against the bottom of the slot portion 54. In the tank 10, the connection tube 49 is provided to be connectable with the ink outlet 95.

A distance L3 from the bottom of the slot portion 54 to the valve 101, the distance L1 and the distance L2 satisfy the relationship of Expression (3) given below:

$$L1<L3<L2 \quad (3)$$

According to the relationship of Expression (3) given above, the valve 101 is opened by the connection tube 49 in the state that the positioning elements 121 of the ink outlet forming portion 65 hit against the bottom of the slot portion 54. According to the above relationship, the positioning elements 121 specify the position of the valve 101 relative to the tank 10 in the state that the ink outlet 95 is connected with the connection tube 49 and that the valve 101 is opened.

This configuration causes the delivery passage 93 to communicate with inside of the tank 10 via the flow path 53A and the flow path 53B of the connection tube 49. This configuration accordingly causes the ink contained in the ink bottle 62 to be injected through the connection tube 49 into the tank 10. As described above, the inside of the connection tube 49 is divided into the two flow paths 53A and 53B. This configuration enables the ink contained in the ink bottle 62 to be flowed through one of the two flow paths 53A and 53B into the tank 10, while enabling the air present in the tank 10 to be flowed through the other of the two flow paths 53A and 53B into the ink bottle 62. This configuration accordingly accelerates exchange between the ink contained in the ink bottle 62 and the air present in the tank 10 (gas liquid exchange) via the connection tube 49 that is divided into the two flow paths 53A and 53B. As a result, the configuration of this embodiment enables the ink to be promptly filled from the ink bottle 62 into the tank 10 and accordingly has the improved convenience.

Figure 28:
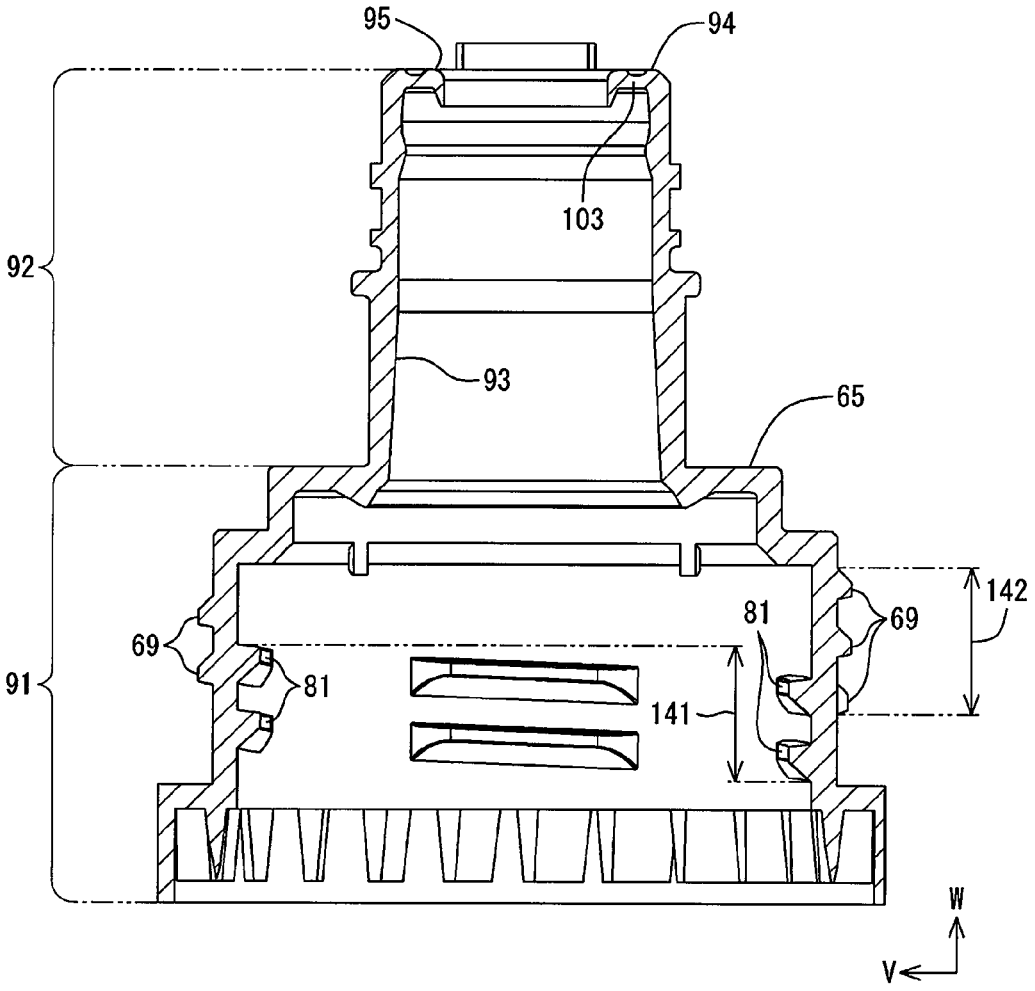
FIG. 28 is a sectional view illustrating the ink outlet forming portion according to the embodiment.

According to this embodiment, as shown in FIG. 28, in the ink outlet forming portion 65, at least part of a forming area 141 of the threads 81 along the W axis is arranged to overlap with a forming area 142 of the threads 69 along the W axis. More specifically, at least part of the forming area 141 in the W-axis direction of the threads 81 formed on the inner side of the joint portion 91 is arranged to overlap with the forming area 142 in the W-axis direction of the threads 69 formed on the outer side of the joint portion 91. The threads 69 correspond to a second thread, and the threads 81 correspond to a first thread. This configuration enables the threads 69 and the threads 81 to be efficiently arranged in the direction along the W axis. This configuration is thus likely to reduce the dimensions of the bottle set 61 and the ink bottle 62 along the W axis and is thereby likely to downsize the bottle set 61 and the ink bottle 62.

According to this embodiment, as shown in FIG. 23, the thread 108 formed in the cover member 63 are not continuously formed but are discontinuous. In other words, the threads 108 are disconnected intermittently in the cover member 63. From another point of view, it is also expressed that the threads 108 of the cover member 63 partly have cuts. The threads 108 are provided intermittently in the cover member 63. According to the embodiment, a space 145 shown in FIG. 24 is likely to be opened to the atmosphere via the disconnected portions of the threads 108.

The space 145 is a space closed by the cover member 63 and the ink outlet forming portion 65 in the state that the cover member 63 is mounted to the ink outlet forming portion 65. The space 145 is likely to have high airtightness. The high airtightness in the space 145 is likely to cause a variation of the pressure in the space 145 with a variation in the environmental temperature or a variation in the atmospheric pressure. The variation of the pressure in the space 145 is likely to cause, for example, deformation of the cover member 63. The deformation of the cover member 63 is likely to cause the cover member 63 to be detached from the ink outlet forming portion 65 or to be damaged. The deformation of the cover member 63 is also likely to decrease the adhesion between the plug element 111 and the cylindrical portion 92.

According to the configuration of this embodiment against this problem, the threads 108 are provided intermittently in the cover member 63, so that the space 145 is likely to be opened to the atmosphere via the disconnected portions of the threads 108. This configuration is likely to reduce a variation of the pressure in the space 145 and accordingly suppresses deformation of the cover member 63. As a result, this configuration suppresses leakage of ink from the ink outlet 95.

Figure 29:
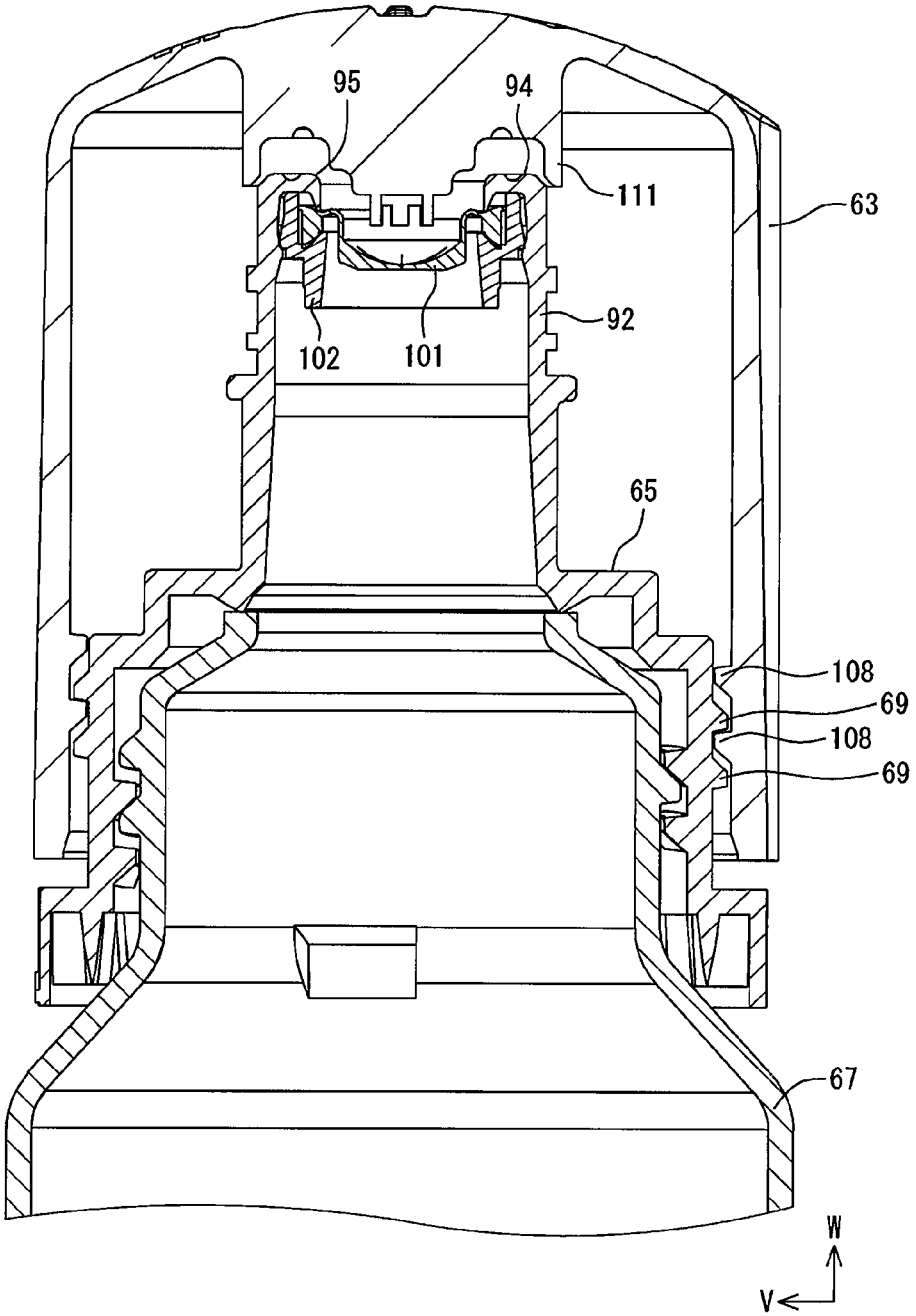
FIG. 29 is a sectional view illustrating the bottle set according to the embodiment.

According to this embodiment, as shown in FIG. 29, in the process of mounting the cover member 63 to the ink outlet forming portion 65, the plug element 111 is fit in the cylindrical portion 92 after engagement (mating) of the threads 108 formed in the cover member 63 with the threads 69 formed in the ink outlet forming portion 65. More specifically, before the plug element 111 is fit in the cylindrical portion 92, the threads 108 formed in the cover member 63 starts engaging with the threads 69 formed in the ink outlet forming portion 65. This configuration is likely to induce fitting of the plug element 111 into the cylindrical portion 92 and thereby prevents wrong fitting of the plug element 111 into the cylindrical portion 92. Additionally, this configuration causes a rotating force (torque) by engagement of the threads 108 with the threads 69 to be changed into a force in the direction along the W axis and thereby increases the force in the direction along the W axis even when the operator applies only a weak force. The operator is thus unlikely to feel a resisting force (load) against fitting of the plug element 111 into the cylindrical portion 92.

Figure 30:
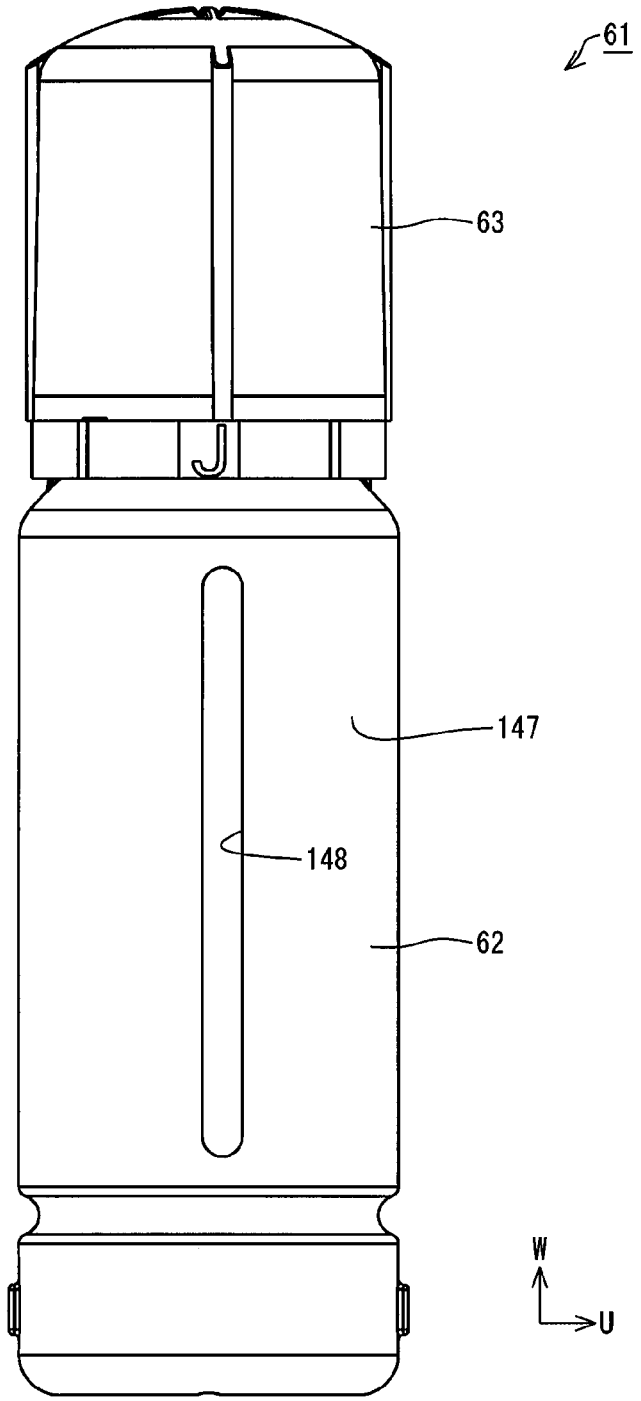
FIG. 30 is an appearance view illustrating the bottle set according to the embodiment.

According to this embodiment, as shown in FIG. 30, the bottle set 61 may be configured to have an exterior film 147 that is mounted to the ink bottle 62. The exterior film 147 is wound on the body portion 82 of the container main body 67 (shown in FIG. 20). According to this embodiment, the container main body 67 is made of a material having optical transparency. The ink contained in the container main body 67 is accordingly visible across the container main body 67.

The exterior film 147 shown in FIG. 30 has a light shielding function to cut off the outside light. The ink contained in the ink bottle 62 is thus invisible across the exterior film 147. The exterior film 147 also serves to suppress the ink contained in the ink bottle 62 from being exposed to the light. A label or sign indicating, for example, information regarding the ink is written on the exterior film 147. The information regarding the ink may be, for example, the type of ink, instructions for use or a note of caution.

According to this embodiment, the exterior film 147 has a slit 148. An inner area of the slit 148 has optical transparency. The ink contained in the ink bottle 62 is accordingly visible via the slit 148. This configuration enables the amount of ink left in the ink bottle 62 to be visually checked. From another point of view, it may be expressed that the slit 148 serves as a window (window portion) that causes the amount of ink left in the ink bottle 62 to be visible. The number of the slit 148 may be only one or may be multiple.

According to this embodiment, as shown in FIG. 21, the valve 101 is provided in the ink outlet forming portion 65 to seal the ink outlet 95 in an openable and closable manner. The valve 101 accordingly serves to suppress leakage of the ink contained in the container main body 67 from the ink outlet 95, for example, even when the ink bottle 62 is inclined with the ink outlet 95 facing down after detachment of the cover member 63 from the ink bottle 62. The valve 101 also serves to suppress leakage of the ink contained in the container main body 67 from the ink outlet 95, for example, even when the ink bottle 62 is swung during conveyance of the ink bottle 62 after detachment of the cover member 63 from the ink bottle 62.

Accordingly, the valve 101 serves as a check valve to prevent the flow of the fluid leaked from the ink outlet 95 to the outside that is opposite to the delivery passage 93. It may thus be expressed that the valve 101 is the check valve provided in the delivery passage 93. According to this embodiment, the valve 101 serving as the check valve is opened under the reduced pressure condition in which the internal pressure of the ink container portion 64 of the ink bottle 62 is lower than the atmospheric pressure. This causes the internal pressure of the ink container portion 64 to approach to the atmospheric pressure. The valve 101 serving as the check valve is unlikely to be opened, on the other hand, under the pressurized condition (accumulated pressure condition) in which the internal pressure of the ink container portion 64 is higher than the atmospheric pressure. The pressurized condition in the ink container portion 64 is thus not readily eliminated.

Figure 31:
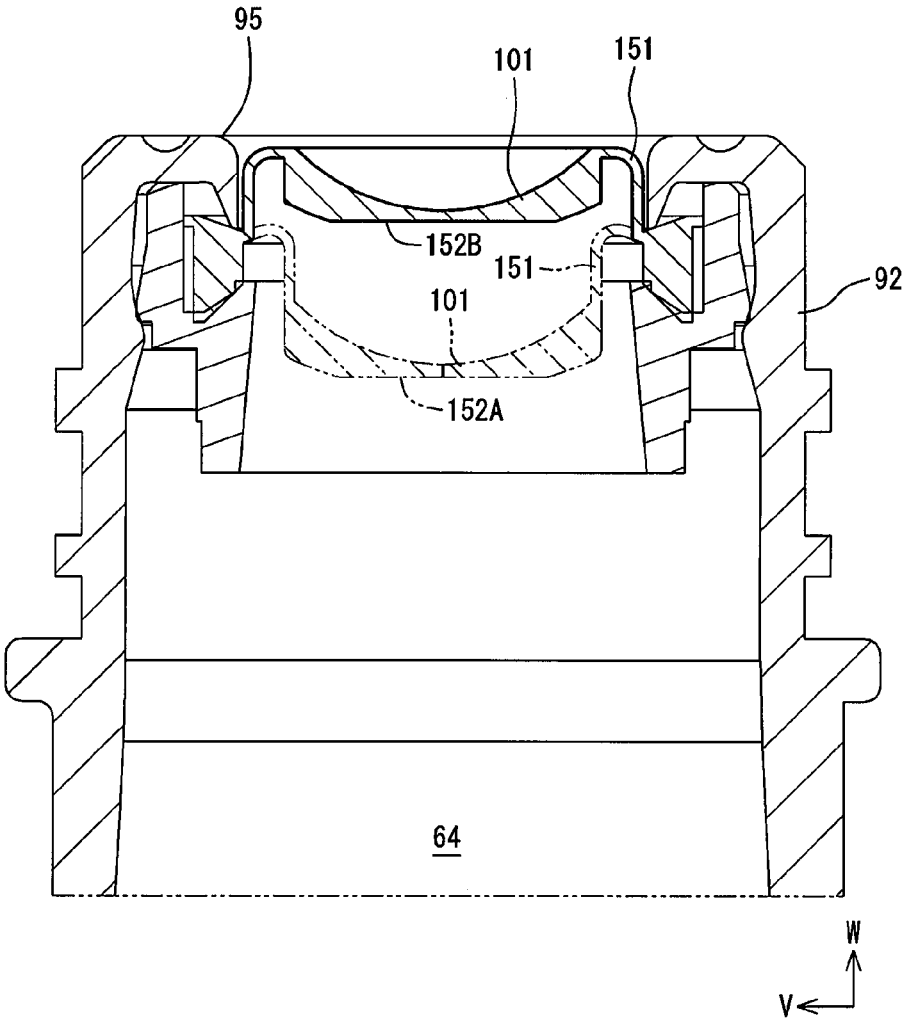
FIG. 31 is an enlarged view illustrating a region E shown in FIG. 21.

As shown in FIG. 31 that is an enlarged view of a region E shown in FIG. 21, with an increase in degree of the pressurized condition, a support portion 151 of the valve 101 is deformed in the W-axis direction, and the valve 101 is likely to be displaced to a position 152B that is protruded in the W-axis direction from an original position 152A. Protruding the valve 101 in the W-axis direction is expressed as inverting the valve 101. FIG. 31 illustrates the state that the valve 101 is protruded in the W-axis direction, i.e., the state that the valve 101 is inverted. The state that the valve 101 is inverted is the state that the valve 101 is closed against the internal pressure of the ink container portion 64. In this state, for example, when the ink bottle 62 is inclined with the ink outlet 95 facing down, the hydraulic head pressure of ink is also applied to the valve 101. When the total pressure exceeds a tolerable level of the valve 101, the ink contained in the ink container portion 64 is ejected out of the ink outlet 95.

Figure 32:
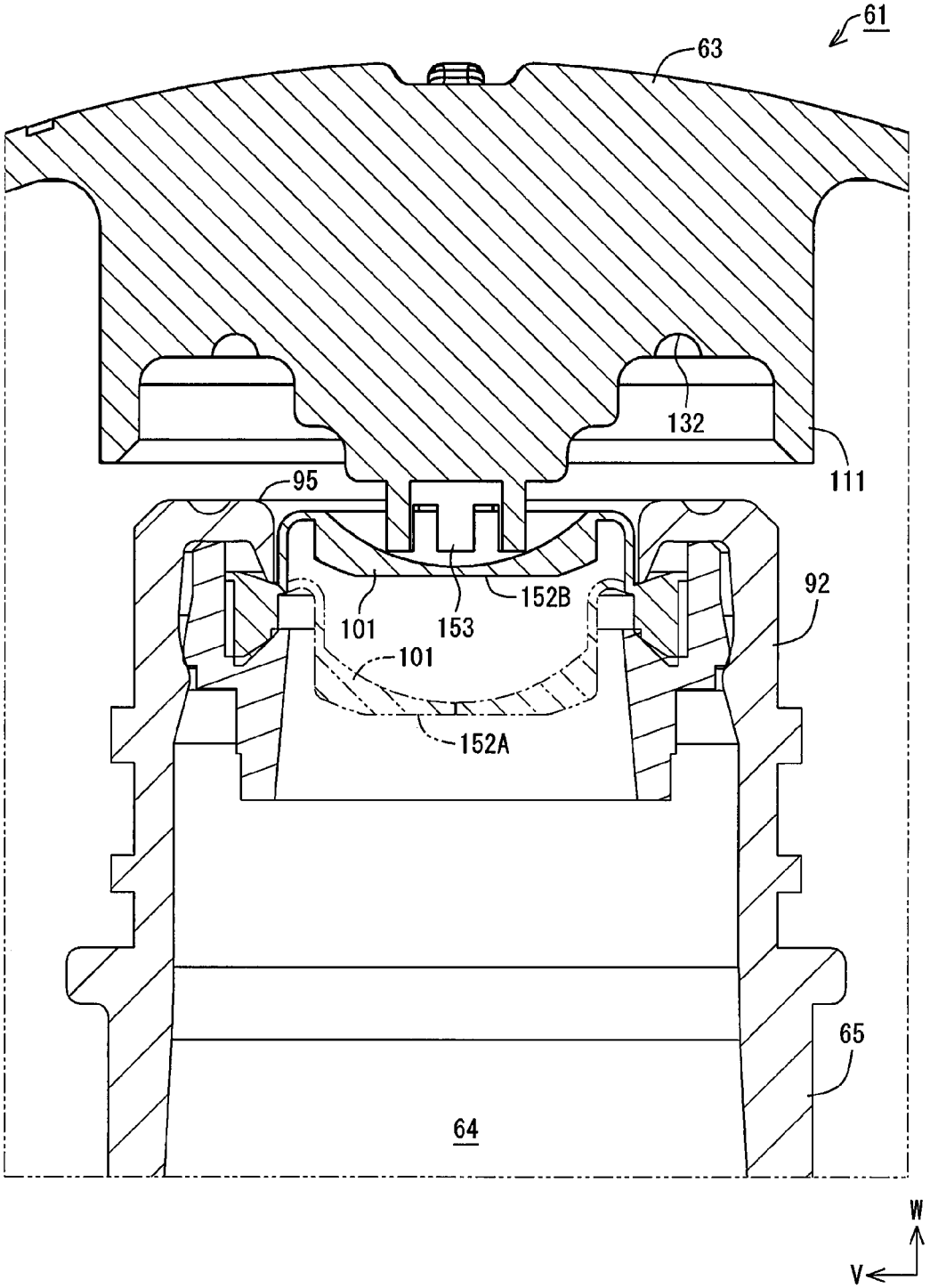
FIG. 32 is a sectional view illustrating the bottle set according to the embodiment.

When the cover member 63 is mounted to the ink outlet forming portion 65 in the state that the valve 101 is inverted, as shown in FIG. 32, protrusions 153 of the cover member 63 come into contact with the valve 101 before the plug element 111 comes into contact with the cylindrical portion 92 of the ink outlet forming portion 65. The protrusions 153 are provided in a region surrounded by the plug element 111. In the cover member 63, the protrusions 153 are protruded from the region surrounded by the plug element 111 toward the ink outlet forming portion 65, i.e., in the −W-axis direction.

The protrusions 153 are provided in an area opposed to the ink outlet 95 and have dimensions receivable in a region of the ink outlet 95. This configuration enables the protrusions 153 to come into contact with the valve 101 when the cover member 63 is mounted to the ink outlet forming portion 65 in the state that the valve 101 is inverted. The valve 101 is accordingly opened by the protrusions 153, so that the inside of the ink container portion 64 is opened and exposed to the atmosphere. This returns the valve 101 from the position 152B to the position 152A. This configuration enables the inverted valve 101 to be returned to the original position 152A when the cover member 63 is mounted to the ink outlet forming portion 65 in the state that the valve 101 is inverted.

Figure 33:
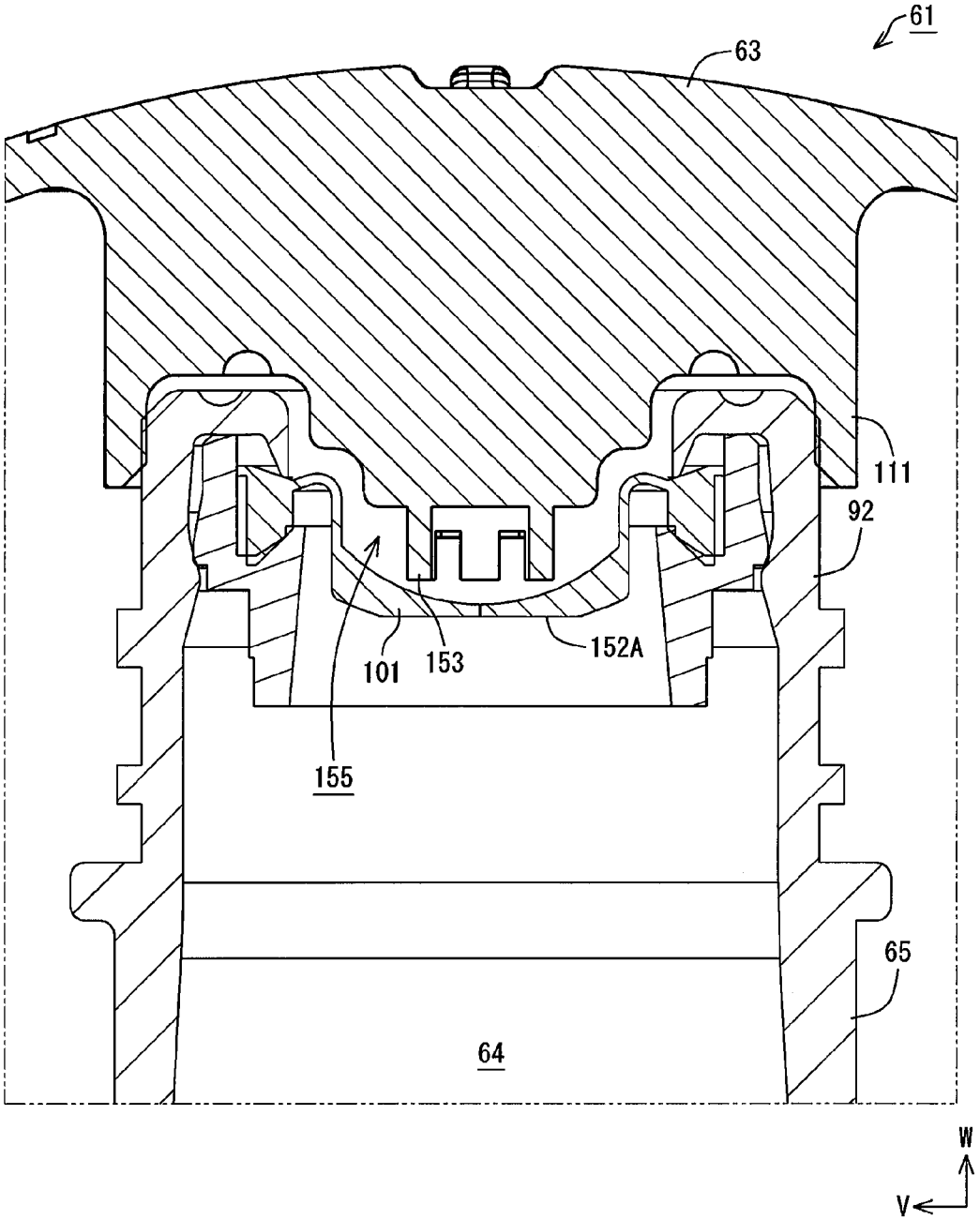
FIG. 33 is a sectional view illustrating the bottle set according to the embodiment.

On completion of mounting of the cover member 63 to the ink outlet forming portion 65, as shown in FIG. 33, a space 155 defined by the region surrounded by the plug element 111, the cylindrical portion 92 and the valve 101 is formed between the plug element 111 and the cylindrical portion 92. The state that mounting of the cover member 63 to the ink outlet forming portion 65 is completed is called mounted state. In the mounted state, the plug element 111 is fit in the cylindrical portion 92, so that the space 155 is sealed. In the mounted state, the space 155 is separated from the ink container portion 64 by the valve 101.

Figure 34:
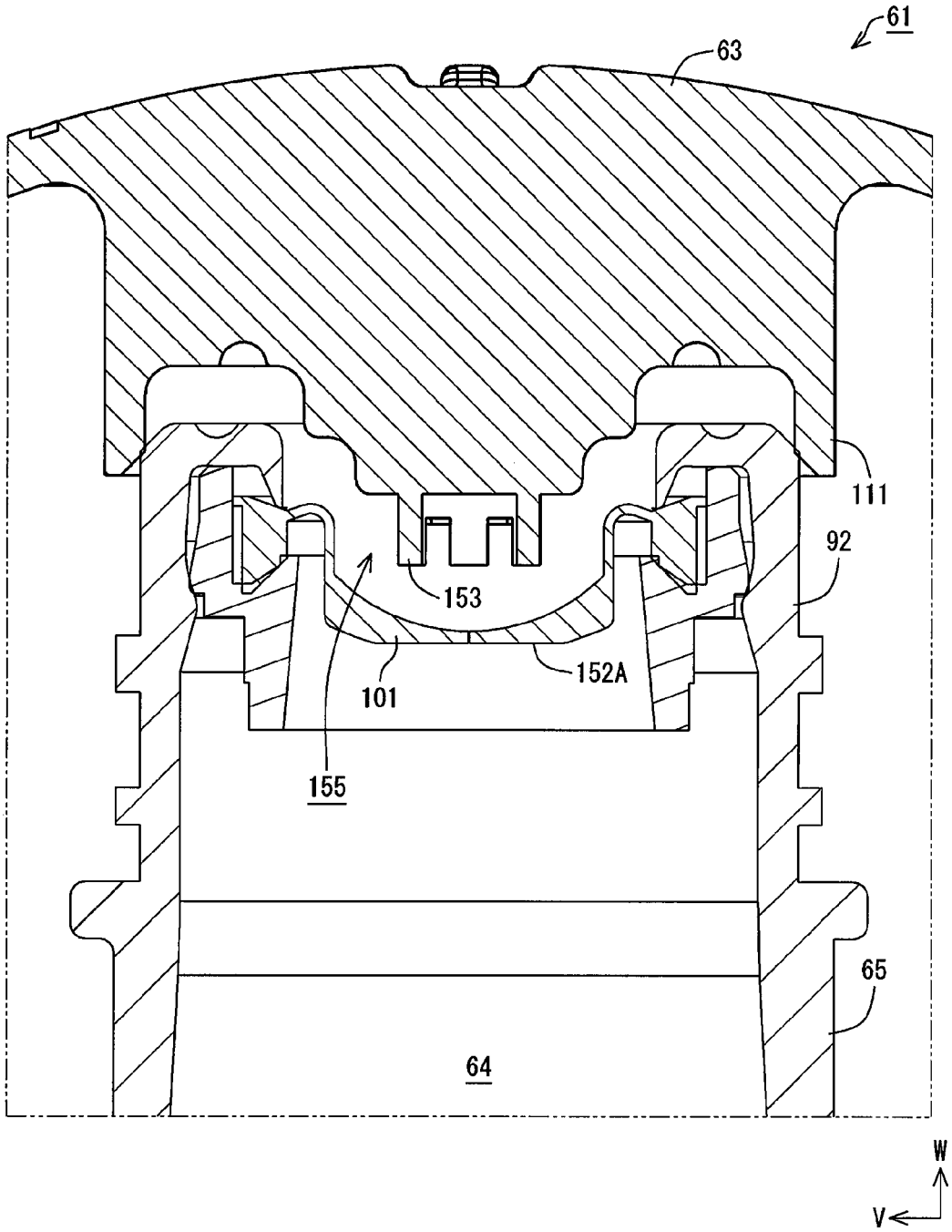
FIG. 34 is a sectional view illustrating the bottle set according to the embodiment.
Figure 35:
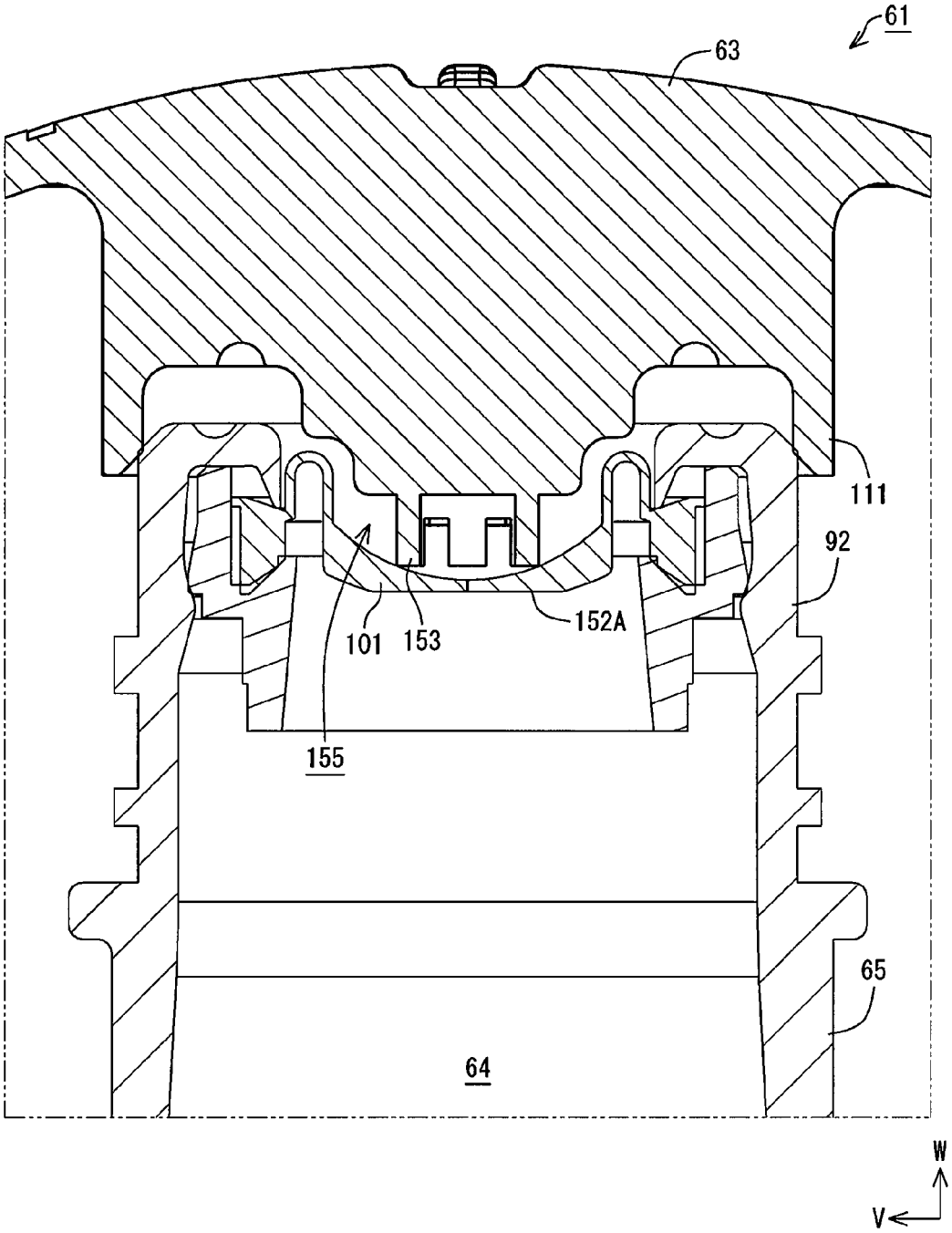
FIG. 35 is a sectional view illustrating the bottle set according to the embodiment.

In the mounted state, for example, when the bottle set 61 is exposed in a high temperature environment or in a low pressure environment, the inside of the ink container portion 64 and the inside of the space 155 become pressurized. In this state, no force is applied to displace the valve 101 since both the inside of the ink container portion 64 and the inside of the space 155 are under the pressurized condition. When the cover member 63 is detached from the ink outlet forming portion 65 in this state, as shown in FIG. 34, the internal pressure of the space 155 becomes lower than the internal pressure of the ink container portion 64 due to expansion of the volume of the space 155. In this state, the valve 101 is likely to be inverted as shown in FIG. 35.

The valve 101, however, comes into contact with the protrusions 153 before the valve 101 is inverted, i.e., before the valve 101 is displaced to the position 152B (shown in FIG. 32). In the state that the valve 101 is in contact with the protrusions 153, fitting of the plug element 111 into the cylindrical portion 92 is released. This causes the space 155 and the ink container portion 64 to be opened and exposed to the atmosphere in the open state of the valve 101. This configuration suppresses inversion of the valve 101 by detachment of the cover member 63 even when the inside of the ink container portion 64 and the inside of the space 155 become pressurized in the mounted state.

The accumulated pressure condition of the ink container portion 64 is likely to be generated by repetition of attachment and detachment of the cover member 63. When the cover member 63 is mounted to the ink outlet forming portion 65 as shown in FIG. 34, the volume of the space 155 is compressed in the process from a start of fitting of the plug element 111 into the cylindrical portion 92 to the mounted state shown in FIG. 33. This pressurizes the inside of the space 155. Pressurizing the inside of the space 155 causes the air present in the space 155 to be fed into the ink container portion 64. When the cover member 63 is detached from the ink outlet forming portion 65, on the contrary, the volume of the space 155 is expanded, so that the internal pressure of the space 155 becomes lower than the internal pressure of the ink container portion 64. In this state, the valve 101 serves to prevent the air present in the ink container portion 64 from moving to the space 155-side.

The inside of the ink container portion 64 is thus likely to become the accumulated pressure condition by repetition of attachment and detachment of the cover member 63 to and from the ink outlet forming portion 65. The valve 101 is likely to be inverted as shown in FIG. 35 by repetition of attachment and detachment of the cover member 63. As described above, however, the valve 101 comes into contact with the protrusions 153 before the valve 101 is inverted, i.e., before the valve 101 is displaced to the position 152B (shown in FIG. 32). The fitting of the plug element 111 into the cylindrical portion 92 is released in the state that the valve 101 is in contact with the protrusions 153. This causes the space 155 and the ink container portion 64 to be opened and exposed to the atmosphere in the open state of the valve 101. This configuration suppresses inversion of the valve 101 by detachment of the cover member 63 even when the inside of the ink container portion 64 and the inside of the space 155 become pressurized in the mounted state.

As described above, the configuration of the bottle set 61 according to the embodiment is likely to release the accumulated pressure condition of the ink container portion 64 and expose the inside of the ink container portion 64 to the atmosphere. This configuration is likely to suppress leakage of the ink contained in the ink bottle 62 in the process of filling ink from the ink bottle 62 into the tank 10. According to this embodiment, even when ink is splashed from the ink outlet 95 in the course of releasing the accumulated pressure condition and exposing the inside of the ink container portion 64 to the atmosphere by the cover member 63, the cover member 63 receives the splashed ink. This configuration is likely to suppress splash of ink out of the bottle set 61.

Figure 36:
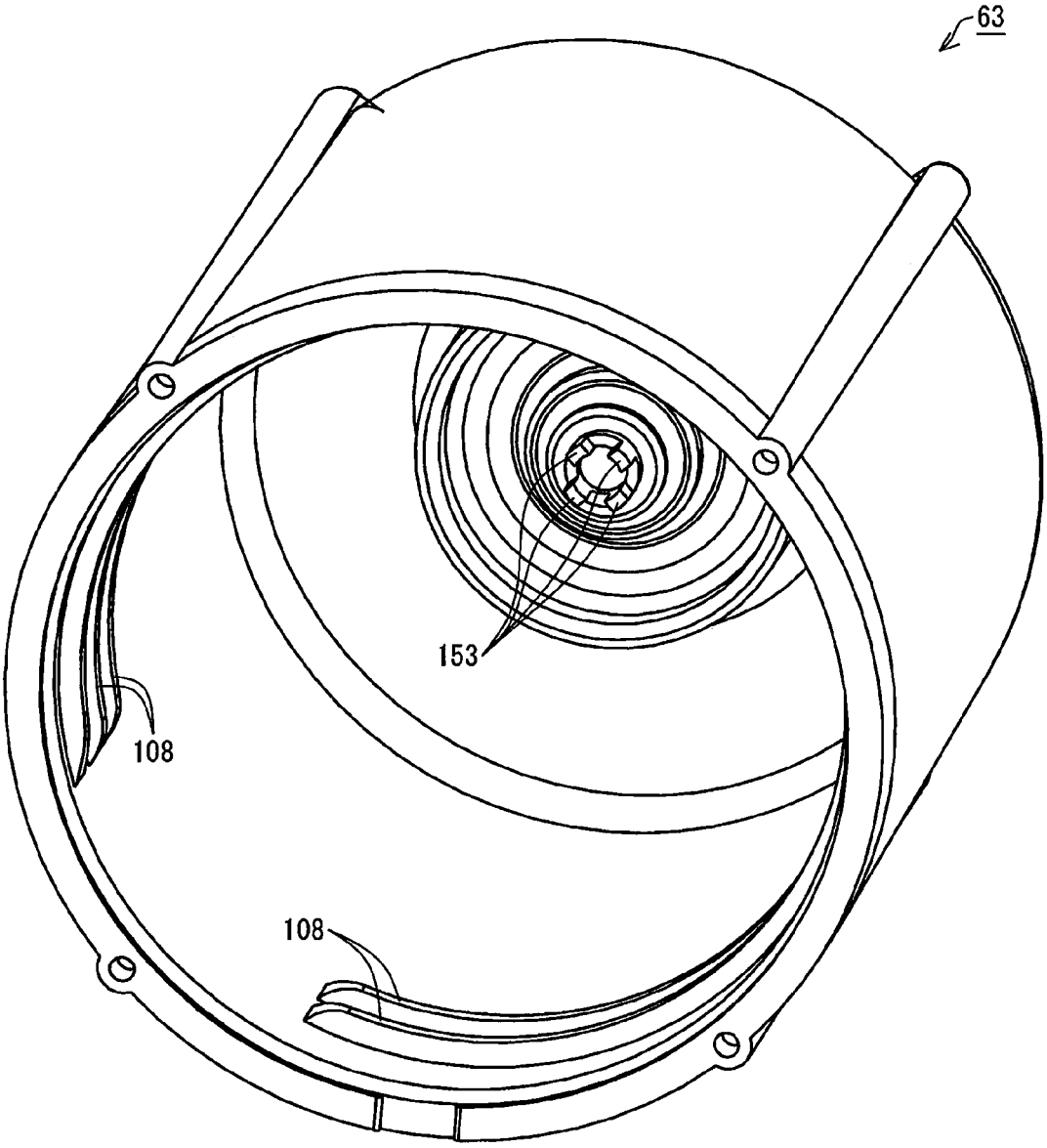
FIG. 36 is a perspective view illustrating a cover member according to the embodiment.

According to this embodiment, the protrusions 153 are provided separately in a circular area as shown in FIG. 36. In other words, the protrusions 153 are not connected in a ring shape according to this embodiment. From another point of view, it may be expressed that the plurality of protrusions 153 are arrayed in a ring shape. According to this embodiment, the four protrusions 153 are arrayed in a ring shape. From another point of view, it may be expressed that the protrusions 153 are formed by partly cutting a tubular wall that is connected in a ring shape.

Figure 37:
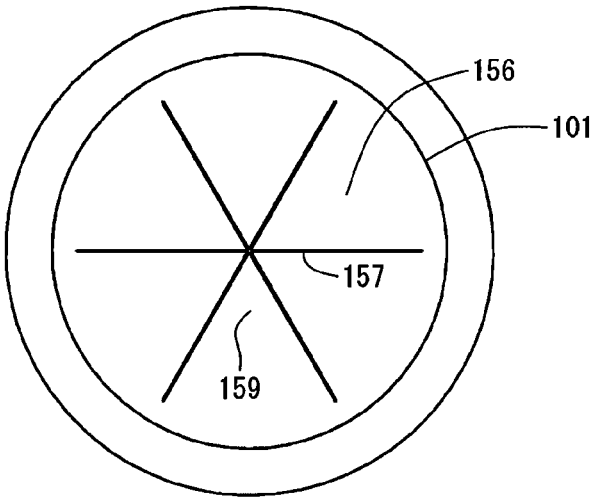
FIG. 37 is a plan view illustrating a valve according to the embodiment.

The valve 101 opposed to the protrusions 153 is configured by a plate-like member 156 that is made of an elastic material and has slits 157 formed therein as shown in FIG. 37. The slits 157 are formed radially in the plate-like member 156. According to this embodiment, the plate-like member 156 is parted into six areas by the slits 157. Each of the six areas parted by the slits 157 is called valve element 159. Application of an external force to the valve elements 159 opens the slits 157 and thereby opens the valve 101.

Figure 38:
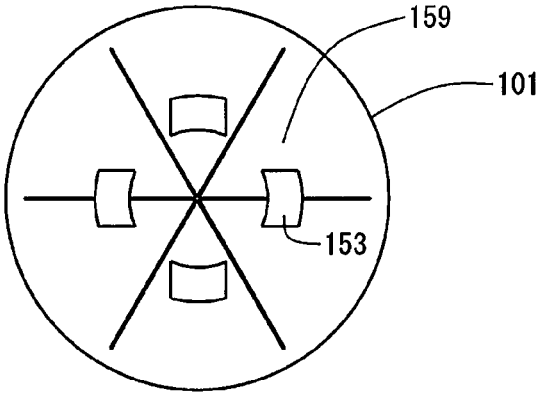
FIG. 38 is a plan view schematically illustrating a positional relationship between the valve and protrusions according to the embodiment.

According to this embodiment, as shown in FIG. 38, the four protrusions 153 are provided to be opposed to the six valve elements 159. When the valve elements 159 are pressed by the protrusions 153, the valve elements 159 are deformed to open the slits 157. As described above, the four protrusions 153 are arranged to be opposed to the six valve elements 159 according to this embodiment. This means that the number of the protrusions 153 is smaller than the number of the valve elements 159. According to this configuration, some protrusions 153 among the plurality of protrusions 153 come into contact with the slits 157, while the other protrusions 153 do not come into contact with the slits 157. This enables the slits 157 to be opened without fail.

Figure 39:
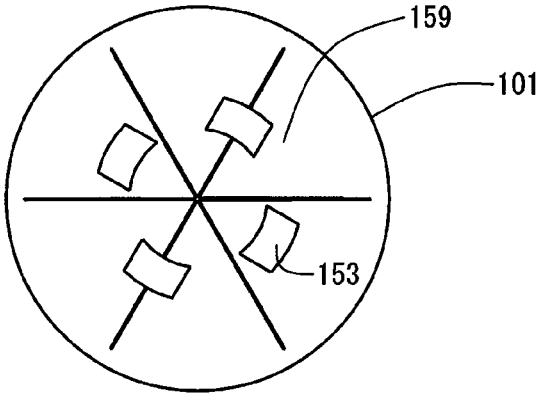
FIG. 39 is a plan view schematically illustrating the positional relationship between the valve and the protrusions according to the embodiment.

As described above, the cover member 63 provided with the protrusions 153 is configured to be engageable with the ink outlet forming portion 65 by means of the threads 108. As shown in FIG. 39, the cover member 63 and the valve 101 are thus rotated in reverse directions relative to each other when the cover member 63 is attached to and detached from the ink outlet forming portion 65. This configuration alternately changes the slits 157 which the protrusions 153 come into contact with in the rotating direction in the process of attachment and detachment of the cover member 63 to and from the ink outlet forming portion 65. According to this embodiment, some valve elements 159 come into contact with the protrusions 153, while the other valve elements 159 do not come into contact with the protrusions 153 in the process of attachment and detachment of the cover member 63 to and from the ink outlet forming portion 65. A difference in relative deformation between the valve elements 159 that come into contact with the protrusions 153 and the valve elements 159 that do not come into contact with the protrusions 153 enables the slits 157 to be opened without fail.

Figure 40:
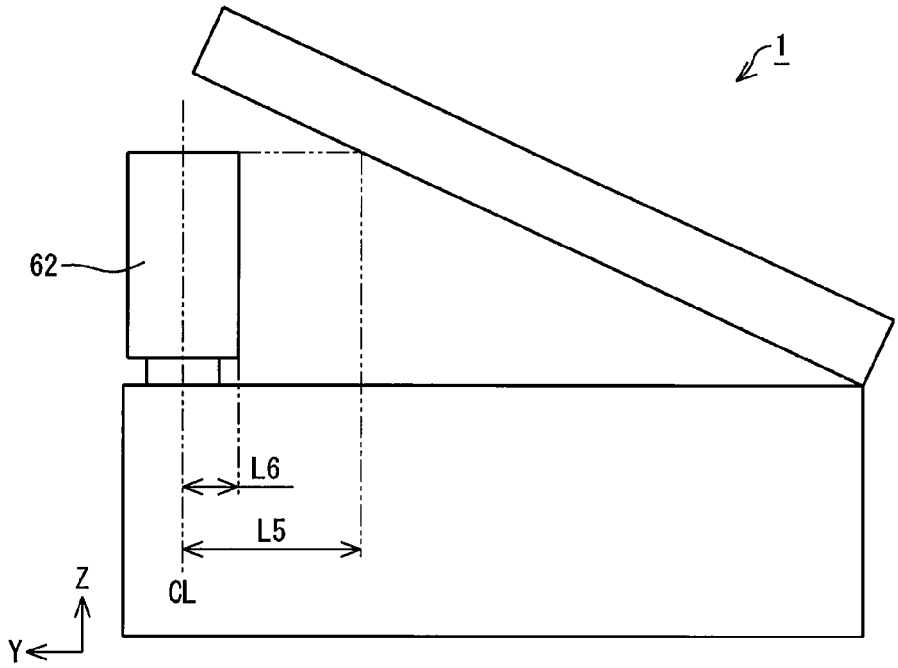
FIG. 40 is a side view schematically illustrating the printer and the ink bottle according to the embodiment.

The configuration of this embodiment may be expressed as follows from another point of view. The requirement shown in FIG. 14 is that the self-supported state of the ink bottle 62 relative to the tank unit 4 is maintained even when the scanner unit 5 is kept in the open state by the tank cover 36. This requirement may be expressed by the configuration that a distance L5 along the Y axis from the center axis CL to the scanner unit 5 is longer than a distance L6 along the Y axis from the center axis CL to a side face of the ink bottle 62 in the radial direction, as shown in FIG. 40.

The configuration of this embodiment may thus be expressed as follows from another point of view. When the ink bottle 62 is self-supported, the distance L5 from the axis to the scanner unit 5 that is one example of the main body cover is longer than the distance L6 from the axis to the side face of the ink container portion 64 in the radial direction at a position of an opposite end that is opposite to the connection tube 49-side of the ink container portion 64 in an axial direction about the center axis of the connection tube 49 of the tank 10 (shown in FIG. 7). This configuration forms a space between the scanner unit 5 and the ink bottle 62. This configuration accordingly maintains the self-supported attitude of the ink bottle 62 without interference with the scanner unit 5 and ensures stable ink filling, while downsizing the printer 1. The opposite end that is opposite to the connection tube 49-side of the ink container portion 64 is a +Z-axis direction end in the ink bottle 62 shown in FIG. 40. This corresponds to a −W-axis direction end in the ink bottle 62 shown in FIG. 17.

Figure 41:
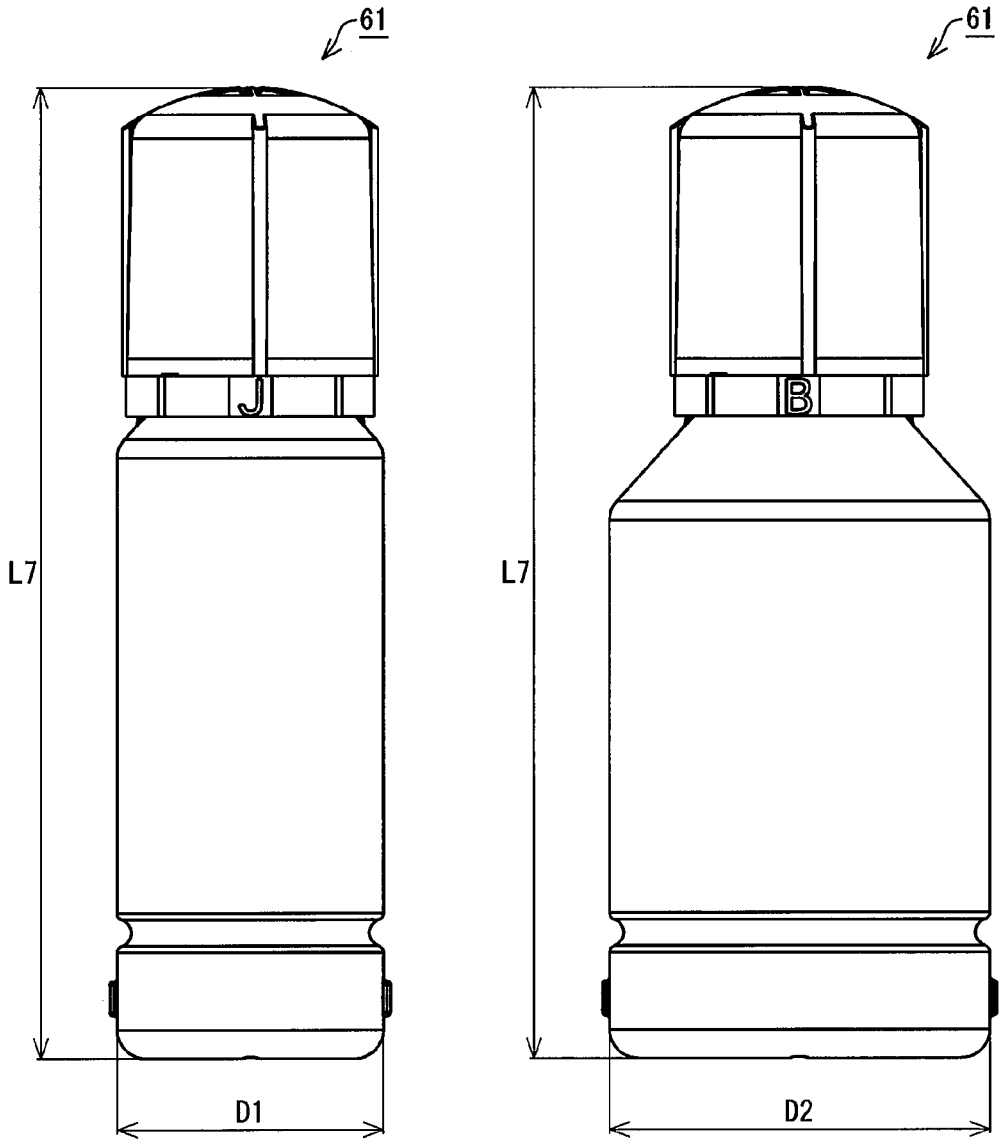
FIG. 41 is an appearance view illustrating the bottle set according to the embodiment.

The following describes some examples of various dimensions with respect to the printer 1 and the bottle set 61 according to the embodiment. A bottle set 61 shown in FIG. 41 has a dimension L7, a diameter D1 and a diameter D2 as given below:

L7=138 mm

D1=37.8 mm

D2=53.7 mm

Figure 42:
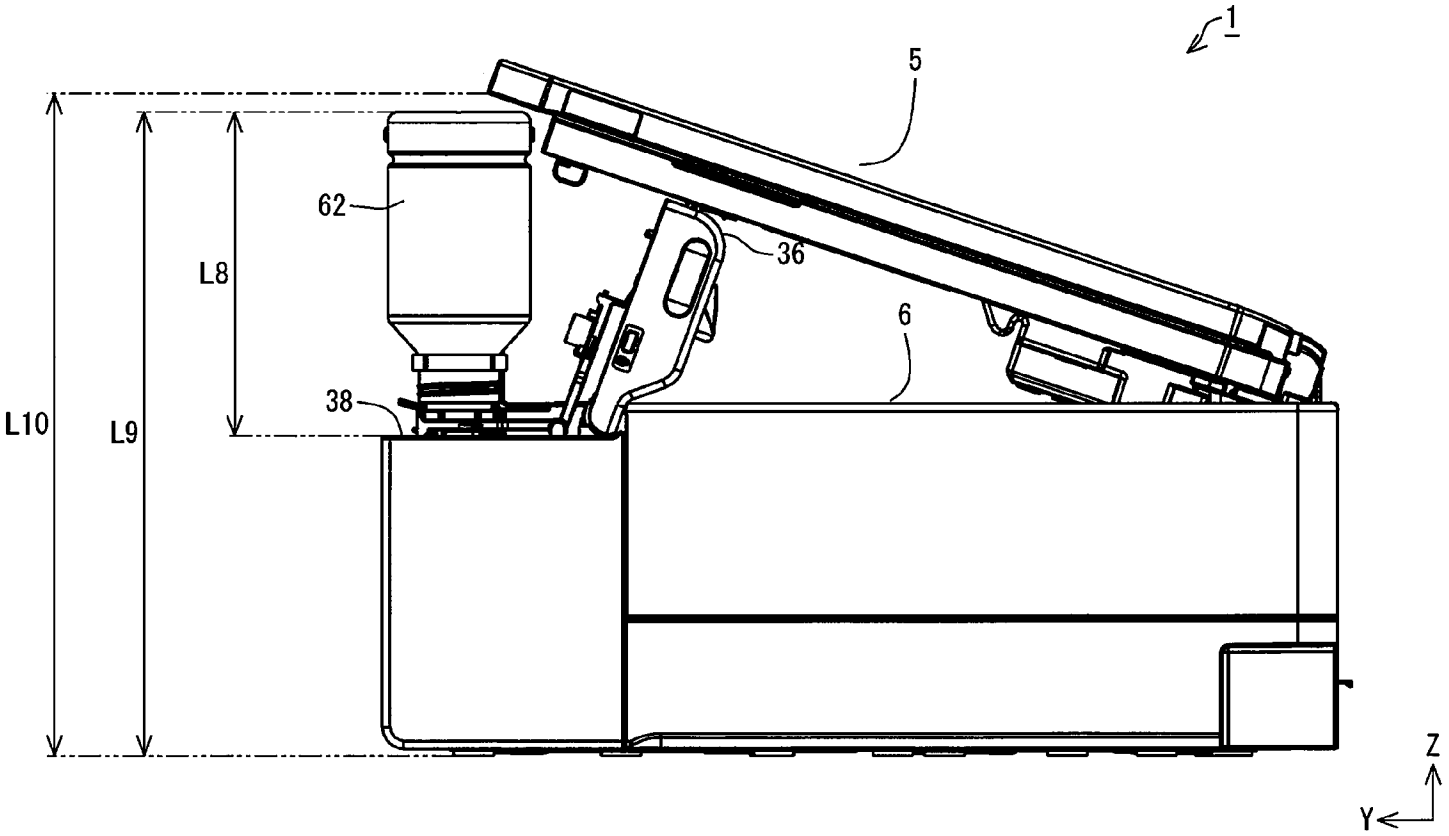
FIG. 42 is a side view illustrating the printer and the ink bottle according to the embodiment.

A printer 1 shown in FIG. 42 has dimensions L8, L9 and L10 as given below. FIG. 42 illustrates the container main body 67B as the container main body 67 of the ink bottle 62.

L8=121.6 mm

L9=239.2 mm

L10=244.8 mm

The dimension L8 is a dimension from the adapter 38 to a +Z-axis direction end of the self-supported ink bottle 62. The dimension L9 is a dimension from the bottom face of the printer 1 to the +Z-axis direction end of the self-supported ink bottle 62. The dimension L10 is a dimension from the bottom face of the printer 1 to a +Y-axis direction end of the scanner unit 5 when the scanner unit 5 is kept in the open state by the tank cover 36.

Figure 43:
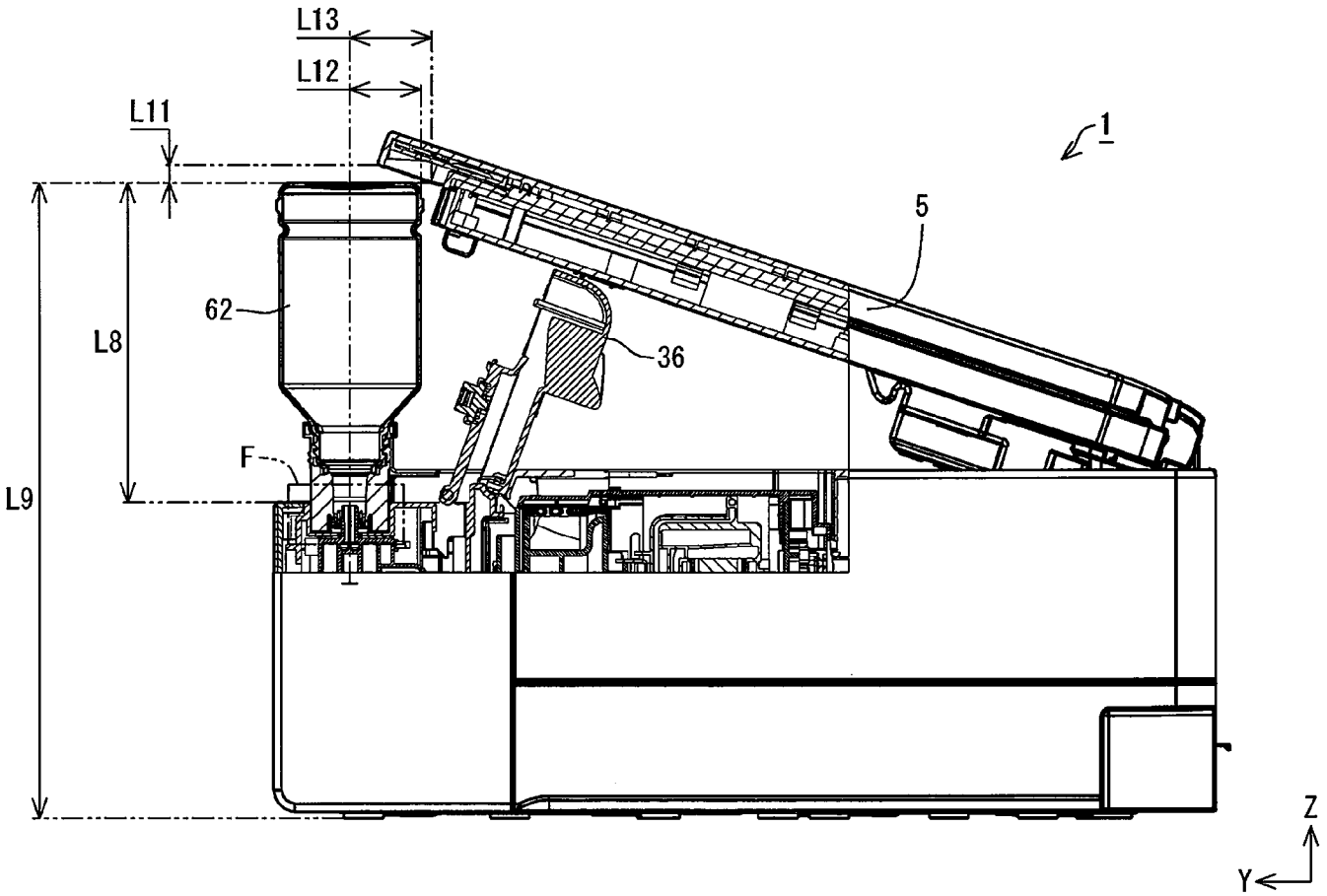
FIG. 43 is a sectional view illustrating the printer and the ink bottle according to the embodiment.

A printer 1 shown in FIG. 43 has dimensions L11, L12 and L13 as given below. FIG. 43 illustrates a section of the printer 1 and the ink bottle 62 taken along a YZ plane. FIG. 43 illustrates the container main body 67B as the container main body 67 of the ink bottle 62.

L11=4.9 mm

L12=26.9 mm

L13=36.2 mm

The dimension L11 is a dimension along the Z axis from a +Z-axis direction end of the self-supported ink bottle 62 to a +Y-axis direction end of the scanner unit 5. The dimension L12 is a dimension from the center axis of the connection tube 49 (shown in FIG. 7) of the self-supported ink bottle 62 to a −Y-axis direction end of the ink bottle 62. The dimension L13 is a dimension along the Y axis from the center axis of the connection tube 49 (shown in FIG. 7) of the self-supported ink bottle 62 to the scanner unit 5.

Figure 44:
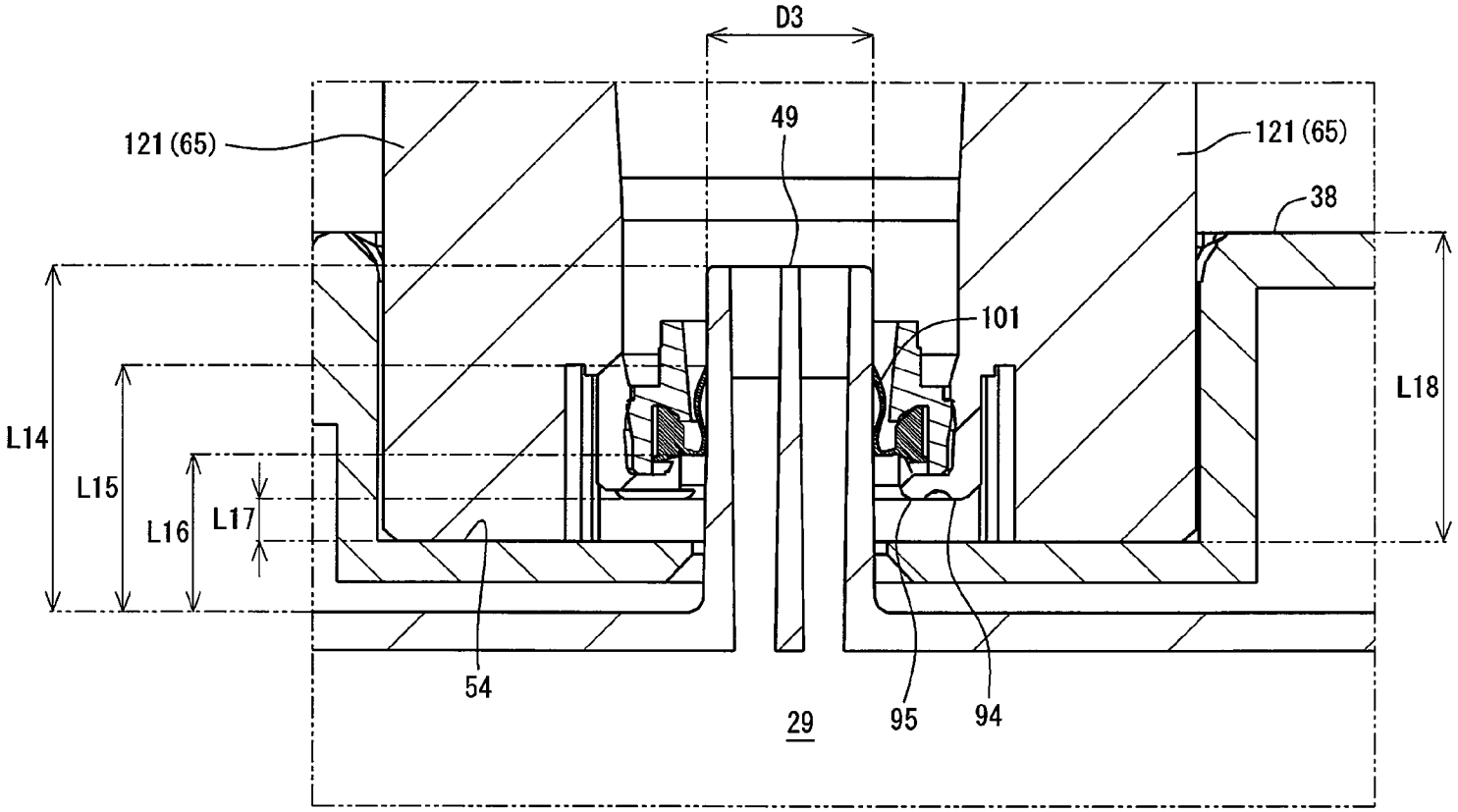
FIG. 44 is an enlarged view illustrating a region F shown in FIG. 43.

The printer 1 also has dimensions L14 to L18 and a diameter D3 shown in FIG. 44 that is an enlarged view of a region F shown in FIG. 43, as given below:

L14=12.6 mm

L15=11.4 mm

L16=5.8 mm

L17=1.8 mm

L18=9.7 mm

D3=6 mm

The dimension L14 is a dimension from a +Z-axis direction end of the tank 10 to a +Z-axis direction end of the connection tube 49. The dimension L15 is a dimension from a +Z-axis direction end of the valve 101 of the self-supported ink bottle 62 to the +Z-axis direction end of the tank 10. The dimension L16 is a dimension from a −Z-axis direction end of the valve 101 of the self-supported ink bottle 62 to the +Z-axis direction end of the tank 10. The dimension L17 is a dimension along the Z axis from the end face 94 of the self-supported ink bottle 62 to the bottom of the slot portion 54 (shown in FIG. 7). The dimension L18 is a dimension along the Z axis from a −Z-axis direction end of the positioning element 121 (shown in FIG. 25) of the self-supported ink bottle 62 to the adapter 38. The diameter D3 is an outer diameter of the connection tube 49.

In any of the embodiment and the examples described above, the liquid ejection apparatus may be a liquid ejection apparatus configured to inject, eject or apply and thereby consume any liquid other than ink. The state of a liquid ejected in the form of tracing amounts of droplets from the liquid ejection apparatus may include a granular shape, a teardrop shape and a tapered threadlike shape. The liquid herein may be any material that is consumable by the liquid ejection apparatus. The liquid may be any material in the liquid phase. The liquid may be, for example, any material in the liquid phase. The liquid may include, for example, liquid-state materials of high viscosity or low viscosity, sols, aqueous gels and other fluids including inorganic solvents, organic solvents, solutions, liquid resins and liquid metals (metal melts). The liquid is not limited to the liquid state as one of the three states of matter but may include solutions, dispersions and mixtures of the functional solid material particles, such as pigment particles or metal particles, solved in, dispersed in or mixed with a solvent. Typical examples of the liquid may include ink described in the above embodiment and liquid crystal. The ink herein may include general water-based inks and oil-based inks, as well as various liquid compositions, such as gel inks and hot-melt inks. Additionally, the ink may be sublimation transfer ink. The sublimation transfer ink denotes ink containing a sublimation color material such as a sublimation dye. The printing method causes the sublimation transfer ink to be ejected onto a transfer medium by the liquid ejection apparatus. The printing method subsequently causes the transfer medium to come into contact with a printing material and heats the transfer medium and the printing material to sublimate the color material and transfer the color material onto the printing material. The printing material may be, for example, a T-shirt or a smartphone. The ink containing the sublimation color material may be used for printing on various printing materials (printing media). The liquid ejection apparatus may include, for example, a liquid ejection apparatus configured to eject a liquid that includes a material such as an electrode material or a color material in the form of a dispersion or in the form of a solution and is used for manufacturing liquid crystal displays, EL (electroluminescence) displays, field emission displays, and color filters. The liquid ejection apparatus may also include a liquid ejection apparatus configured to eject a bioorganic material used for manufacturing biochips, a liquid ejection apparatus used as a precision pipette and configured to eject a sample liquid, a printing apparatus and a microdispenser. The liquid ejection apparatus may further include a liquid ejection apparatus for pinpoint ejection of lubricating oil on precision machines such as watches and cameras and a liquid ejection apparatus configured to eject a transparent resin solution, such as an ultraviolet curable resin solution, onto a substrate in order to manufacture a hemispherical microlens (optical lens) used for, for example, optical communication elements. Another example of the liquid ejection apparatus may be a liquid ejection apparatus configured to eject an acidic or alkaline etching solution in order to etch a substrate or the like.

The invention is not limited to any of the embodiment and the examples described above but may be implemented by a diversity of other configurations without departing from the scope of the invention. For example, the technical features of any of the embodiment and the examples corresponding to the technical features of each of the aspects described in SUMMARY may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. An ink bottle configured to fill ink into a tank of a printer, the printer comprising: a print head configured to eject ink; a housing configured to place the print head therein; a main body cover configured to change over a state by rotation between a closed state to cover an opening formed in the housing and an open state to open the opening; a tank including an ink container portion configured to contain the ink that is to be supplied to the print head, and an ink inlet configured such that the ink is filled through the ink inlet into the ink container portion; and a tank cover configured to change over a state by rotation between a closed state to cover the ink inlet and an open state to expose the ink inlet, and the ink bottle comprising a container portion configured to contain the ink that is to be injected into the ink inlet, and a delivery portion configured to deliver the ink contained in the container portion toward the ink inlet, wherein:

in a use attitude when the print head is in use, in a plan view of the main body cover in the closed state, the main body cover is arranged to cover at least part of the tank cover and at least part of the ink inlet, in the open state of both the main body cover and the tank cover, the ink bottle is self-supported and configured to deliver the ink from the delivery portion of the ink bottle to the ink inlet, and a space is formed between the main body cover and the ink bottle when the ink bottle is self-supported, and at least part of the ink bottle is located in a locus drawn by the main body cover during rotation of the main body cover between the closed state and the open state, and wherein the container portion with an opening formed on one end side of the container portion and the delivery portion that is included on the one end side of the container portion are configured separately, and the delivery portion comprises:

an engagement portion in a tubular shape configured to be engaged with the container portion when the engagement portion is arranged to cover the opening of the container portion;

an outlet formed on an opposite side of a container portion side of the engagement portion and configured to flow out the ink contained in the container portion to outside;

a first thread formed on an inner side of the engagement portion to be engaged with a thread formed in the container portion; and a second thread formed on an outer side of the engagement portion to be engaged with a thread formed in a cover member that is configured to cover the outlet, wherein when a direction from the opening of the container portion toward the outlet of the delivery portion is specified as a first direction, at least part of a forming area of the first thread in the first direction overlaps with a forming area of the second thread in the first direction.

2. An ink bottle configured to fill ink into a tank of a printer, the printer comprising: a print head configured to eject ink; a housing configured to place the print head therein; a main body cover configured to change over a state by rotation between a closed state to cover an opening formed in the housing and an open state to open the opening; a tank including an ink container portion configured to contain the ink that is to be supplied to the print head, and an ink inlet configured such that the ink is filled through the ink inlet into the ink container portion; and a tank cover configured to change over a state by rotation between a closed state to cover the ink inlet and an open state to expose the ink inlet, the ink bottle comprising a container portion configured to contain the ink that is to be injected into the ink inlet, and a delivery portion configured to deliver the ink contained in the container portion toward the ink inlet, wherein in a use attitude when the print head is in use, in a plan view of the main body cover in the closed state, the main body cover is arranged to cover at least part of the tank cover and at least part of the ink inlet, in the open state of both the main body cover and the tank cover, the ink bottle is self-supported and configured to deliver the ink from the delivery portion of the ink bottle to the ink inlet, and when the ink bottle is self-supported, a distance from an axis to the main body cover is longer than a distance from the axis to a side face of the ink bottle in a radial direction at a position of an opposite end that is opposite to the ink inlet of the ink bottle in an axial direction about a center axis of the ink inlet.

* * * * *